US007191745B2

(12) United States Patent
Mandal et al.

(10) Patent No.: US 7,191,745 B2
(45) Date of Patent: Mar. 20, 2007

(54) VALVE OPERATING ASSEMBLY

(75) Inventors: Dhruva Mandal, Vernon Hills, IL (US); Carroll Williams, Pocahontas, AR (US)

(73) Assignee: MacLean-Fogg Company, Mundelein, IL (US)

( * ) Notice: Subject to any disclaimer, the term of this patent is extended or adjusted under 35 U.S.C. 154(b) by 53 days.

(21) Appl. No.: 10/316,264

(22) Filed: Oct. 18, 2002

(65) Prior Publication Data

US 2004/0074462 A1 Apr. 22, 2004

(51) Int. Cl.
*F01L 1/14* (2006.01)

(52) U.S. Cl. ..... 123/90.52; 123/90.48; 123/90.45

(58) Field of Classification Search ..... 123/90.45, 123/90.52, 90.48; 29/888.03
See application file for complete search history.

(56) References Cited

U.S. PATENT DOCUMENTS 188,764 A 3/1877 Adams
626,594 A 6/1899 Chapman
703,838 A 7/1902 Scobee
794,683 A 7/1905 Riotte
872,598 A 12/1907 Watts et al.
948,248 A 2/1910 Reaugh
992,089 A 5/1911 Watt
993,875 A 5/1911 Richards et al.
1,000,722 A 8/1911 Danver
1,001,265 A 8/1911 Graham
1,061,700 A 5/1913 Steinbecker
1,066,069 A 7/1913 Willshaw
1,080,733 A 12/1913 Thomson
1,084,514 A 1/1914 Whitlock
1,101,935 A 6/1914 Jacobs et al.
1,129,555 A 2/1915 Curran
1,198,115 A 9/1916 De La Bar
1,210,871 A 1/1917 Suffa
1,220,380 A 3/1917 Turner
1,245,552 A 11/1917 Becket
1,246,343 A 11/1917 Snadecki
1,247,366 A 11/1917 Brockway
1,252,692 A 1/1918 Harris
1,254,227 A 1/1918 Huber
1,292,312 A 1/1919 Gronkwist
1,331,787 A 2/1920 Schlatter
1,336,447 A 4/1920 Suffa
1,345,942 A 7/1920 McCain
1,350,989 A 8/1920 Cox
1,354,852 A 10/1920 Schneider
1,358,459 A 11/1920 Pache
1,363,398 A 12/1920 Davids
1,374,059 A 4/1921 Church
1,377,866 A 5/1921 White (Continued)

OTHER PUBLICATIONS

IDS (02716) Labeled to show the different features.*

(Continued)

*Primary Examiner*—Thomas Denion
*Assistant Examiner*—Zelalem Eshete
(74) *Attorney, Agent, or Firm*—Dana Andrew Alden

(57) ABSTRACT

The present invention relates to a lash adjuster body, comprising A lash adjuster body, comprising an outer surface, enclosing a cavity, wherein the cavity includes an inner surface configured to accommodate an insert and a spring; and the cavity is fabricated through forging.

142 Claims, 52 Drawing Sheets

U.S. PATENT DOCUMENTS

| | | | |
|---|---|---|---|
| 1,399,839 | A | 12/1921 | Alborn |
| 1,409,625 | A | 3/1922 | Vosbrink |
| 1,409,878 | A | 3/1922 | Mainland |
| 1,410,771 | A | 3/1922 | Strohl |
| 1,427,111 | A | 8/1922 | Knudsen |
| 1,428,492 | A | 9/1922 | Pagé |
| 1,461,560 | A | 7/1923 | Rich |
| 1,464,082 | A | 8/1923 | Leo |
| 1,475,557 | A | 11/1923 | Albrecht |
| 1,479,735 | A | 1/1924 | Page |
| 1,515,201 | A | 11/1924 | Hewitt |
| 1,537,529 | A | 5/1925 | Enberg |
| 1,543,438 | A | 6/1925 | Hutt |
| 1,565,223 | A | 12/1925 | Church |
| 1,566,923 | A | 12/1925 | Roberts |
| 1,573,962 | A | 2/1926 | Charnock |
| 1,582,883 | A | 4/1926 | Rich |
| 1,594,471 | A | 8/1926 | Short |
| 1,605,494 | A | 11/1926 | Anderson |
| 1,607,128 | A | 11/1926 | Johansen |
| 1,613,012 | A | 1/1927 | Baker |
| 1,623,826 | A | 4/1927 | Burleson |
| 1,674,310 | A | 6/1928 | Topping |
| 1,682,821 | A | 9/1928 | Woolson |
| 1,696,866 | A | 12/1928 | Seaman |
| 1,728,149 | A | 9/1929 | Berne |
| 1,735,695 | A | 11/1929 | Rich |
| 1,741,093 | A | 12/1929 | Briggs |
| 1,741,230 | A | 12/1929 | Goodwin |
| 1,748,086 | A | 2/1930 | Small |
| 1,784,257 | A | 12/1930 | Thomas |
| 1,797,105 | A | 3/1931 | Shoblom |
| 1,798,738 | A | 3/1931 | Hoern |
| 1,798,938 | A | 3/1931 | Hallett |
| 1,802,330 | A | 4/1931 | Boland |
| 1,820,299 | A | 8/1931 | Church |
| 1,834,285 | A | 12/1931 | Loeffler |
| 1,835,622 | A | 12/1931 | Willgoos |
| 1,840,633 | A | 1/1932 | Morehouse |
| 1,844,021 | A | 2/1932 | Stewart |
| 1,847,312 | A | 3/1932 | Seufert |
| 1,848,083 | A | 3/1932 | Wetherald |
| 1,874,471 | A | 8/1932 | Du Bois |
| 1,899,251 | A | 2/1933 | Zerk |
| 1,907,506 | A | 5/1933 | Coburn |
| 1,915,867 | A | 6/1933 | Penick |
| 1,930,261 | A | 10/1933 | Berry |
| 1,930,368 | A | 10/1933 | Nelson |
| 1,930,568 | A | 10/1933 | Short |
| 1,955,844 | A | 4/1934 | Woolman |
| 1,956,014 | A | 4/1934 | Fink et al. |
| 1,962,057 | A | 6/1934 | Clutterbuck |
| 1,968,982 | A | 8/1934 | Baranaby et al. |
| 1,971,083 | A | 8/1934 | Im Schlaa |
| 1,977,778 | A | 10/1934 | Rice |
| 1,985,447 | A | 12/1934 | Grubbs |
| 2,000,635 | A | 5/1935 | Edwards |
| 2,002,196 | A | 5/1935 | Ucko |
| 2,015,991 | A | 10/1935 | Breeler |
| 2,019,138 | A | 10/1935 | Kliesrath et al. |
| 2,019,252 | A | 10/1935 | Cottingham |
| 2,027,406 | A | 1/1936 | Spatta |
| 2,036,936 | A | 4/1936 | Halford |
| 2,051,415 | A | 8/1936 | Payson |
| 2,053,743 | A | 9/1936 | Russell |
| 2,055,341 | A | 9/1936 | Dyer |
| 2,067,114 | A | 1/1937 | Ashton |
| 2,071,051 | A | 2/1937 | Van Ranst |
| 2,071,719 | A | 2/1937 | Wurtele |
| 2,073,178 | A | 3/1937 | Rich |
| 2,081,390 | A | 5/1937 | Trapp |
| 2,089,478 | A | 8/1937 | Heiss |
| 2,091,451 | A | 8/1937 | Phillips |
| 2,091,674 | A | 8/1937 | Dostal |
| 2,097,413 | A | 10/1937 | Hurst et al. |
| 2,098,115 | A | 11/1937 | Voorhies |
| 2,107,456 | A | 2/1938 | Trapp |
| 2,109,815 | A | 3/1938 | Best |
| 2,114,655 | A | 4/1938 | Leibing |
| 2,116,749 | A | 5/1938 | Daisley |
| 2,117,434 | A | 5/1938 | Krebs |
| 2,120,389 | A | 6/1938 | Bettison |
| 2,127,245 | A | 8/1938 | Breeler |
| 2,131,948 | A | 10/1938 | Graham |
| 2,142,224 | A | 1/1939 | Turlay |
| 2,151,832 | A | 3/1939 | Bugatti |
| 2,154,494 | A | 4/1939 | Corlett |
| 2,163,969 | A | 6/1939 | Whalen |
| 2,166,968 | A | 7/1939 | Rohlin |
| 2,174,526 | A | 10/1939 | Parker |
| 2,175,466 | A | 10/1939 | Johnson |
| 2,179,354 | A | 11/1939 | Scott |
| 2,185,991 | A | 1/1940 | Voorhies et al. |
| 2,187,008 | A | 1/1940 | Baxter |
| 2,199,096 | A | 4/1940 | Berglund |
| 2,207,324 | A | 7/1940 | L'Orange |
| 2,209,479 | A | 7/1940 | Spencer |
| 2,227,127 | A | 12/1940 | Dillström |
| 2,247,278 | A | 6/1941 | Daisley |
| 2,247,299 | A | 6/1941 | Klavik |
| 2,250,011 | A | 7/1941 | Dayton |
| 2,250,814 | A | 7/1941 | Rohlin |
| 2,272,074 | A | 2/1942 | Voorhies |
| 2,280,753 | A | 4/1942 | Essl |
| 2,308,858 | A | 1/1943 | Burkhardt |
| 2,309,740 | A | 2/1943 | Voorhies |
| 2,319,546 | A | 5/1943 | Insley et al. |
| 2,322,172 | A | 6/1943 | Spencer |
| 2,322,173 | A | 6/1943 | Spencer |
| 2,322,174 | A | 6/1943 | Spencer |
| 2,322,195 | A | 6/1943 | Mock |
| 2,324,322 | A | 7/1943 | Reese et al. |
| 2,339,238 | A | 1/1944 | Buckley |
| 2,344,285 | A | 3/1944 | Cormode |
| 2,346,737 | A | 4/1944 | Essl |
| 2,349,203 | A | 5/1944 | Spencer |
| 2,356,900 | A | 8/1944 | Voorhies |
| 2,381,339 | A | 8/1945 | Doman |
| 2,385,309 | A | 9/1945 | Spencer |
| 2,386,317 | A | 10/1945 | Jenny et al. |
| 2,392,933 | A | 1/1946 | Mallory |
| 2,394,738 | A | 2/1946 | Anthony |
| 2,405,927 | A | 8/1946 | Tornblom |
| 2,408,325 | A | 9/1946 | Luce et al. |
| 2,410,411 | A | 11/1946 | Gregory |
| 2,434,386 | A | 1/1948 | Bradshaw |
| 2,435,727 | A | 2/1948 | Spencer |
| 2,438,631 | A | 3/1948 | Bergmann |
| 2,443,999 | A | 6/1948 | Wright |
| 2,451,395 | A | 10/1948 | Klukan |
| 2,483,779 | A | 10/1949 | Mucher |
| 2,485,760 | A | 10/1949 | Millis et al. |
| 2,494,128 | A | 1/1950 | Holmquist et al. |
| 2,508,557 | A | 5/1950 | Wood, Jr. |
| 2,516,775 | A | 7/1950 | Johansen |
| 2,518,272 | A | 8/1950 | Beckwith |
| 2,522,326 | A | 9/1950 | Winter, Jr. |
| 2,526,239 | A | 10/1950 | Kincaid, Jr. |
| 2,527,604 | A | 10/1950 | Walk |
| 2,528,983 | A | 11/1950 | Weiss |
| 2,542,036 | A | 2/1951 | Knaggs |
| 2,548,342 | A | 4/1951 | Brook et al. |
| 2,563,699 | A | 8/1951 | Winter, Jr. |
| 2,564,902 | A | 8/1951 | Houser et al. |

2,572,968 A 10/1951 Bachle
2,595,583 A 5/1952 Johnson
2,618,297 A 11/1952 Gosselin
2,619,946 A 12/1952 Michelich
2,629,639 A 2/1953 Johansen
2,631,576 A 3/1953 Schowalter
2,642,051 A 6/1953 Russell
2,665,669 A 1/1954 Ellis
2,688,319 A 9/1954 Humphreys
2,694,389 A 11/1954 Turkish
2,705,482 A 4/1955 Randol
2,733,619 A 2/1956 Smith
2,735,313 A 2/1956 Dickson
2,737,934 A 3/1956 Banker
2,739,580 A 3/1956 Brown
2,743,712 A 5/1956 Hulsing
2,743,713 A 5/1956 Russell
2,745,391 A 5/1956 Winkler, Jr.
2,763,250 A 9/1956 Bensinge
2,765,783 A 10/1956 Randol
2,773,761 A 12/1956 Fuqua et al.
2,781,868 A 2/1957 House
2,784,707 A 3/1957 Skinner
2,795,217 A 6/1957 Ware
2,797,673 A 7/1957 Black
2,797,701 A 7/1957 Nurkiewicz
2,807,251 A 9/1957 Peras
2,808,818 A 10/1957 Sampietro
2,815,740 A 12/1957 Slater
2,818,050 A 12/1957 Papenguth
2,818,844 A 1/1958 Wood
2,821,970 A 2/1958 Line
2,827,887 A 3/1958 Van Slooten
2,829,540 A 4/1958 Niemeyer
2,840,063 A 6/1958 Purchas, Jr.
2,842,111 A 7/1958 Braun
2,845,914 A 8/1958 Cobo
2,846,988 A 8/1958 Iskenderian
2,849,997 A 9/1958 Kravits
2,853,984 A 9/1958 Sampietro
2,857,895 A 10/1958 Scheibe
2,859,510 A 11/1958 Baxa
2,863,430 A 12/1958 Sampietro
2,863,432 A 12/1958 O'Brien
2,865,352 A 12/1958 Thompson
2,874,685 A 2/1959 Line
2,875,742 A 3/1959 Dolza
2,882,876 A 4/1959 Bergmann
2,887,098 A 5/1959 Thompson
2,891,525 A 6/1959 Moore
2,908,260 A 10/1959 Bergmann, Sr.
2,918,047 A 12/1959 Mick
2,919,686 A 1/1960 Mick
2,925,074 A 2/1960 Dadd
2,925,808 A 2/1960 Baumann
2,926,884 A 3/1960 Clickenbeard
2,932,290 A 4/1960 Christensen
2,934,051 A 4/1960 Drew
2,934,052 A 4/1960 Longenecker
2,935,059 A 5/1960 Thompson
2,935,878 A 5/1960 Wirsching
2,937,632 A 5/1960 Voorhies
2,938,508 A 5/1960 Papenguth
2,942,595 A 6/1960 Bergmann, Sr. et al.
2,947,298 A 8/1960 Dolza
2,948,270 A 8/1960 Bergmann
2,948,274 A 8/1960 Wood
2,954,015 A 9/1960 Line
2,956,557 A 10/1960 Dadd
2,962,012 A 11/1960 Howson
2,963,012 A 12/1960 Kolbe
2,964,027 A 12/1960 Dadd
2,983,991 A 5/1961 Carlson
2,988,805 A 6/1961 Thompson
2,997,991 A 8/1961 Roan
3,009,450 A 11/1961 Engermann
3,016,887 A 1/1962 Streit et al.
3,021,593 A 2/1962 Cousino
3,021,826 A 2/1962 De Fezzy et al.
RE25,154 E 4/1962 Bergmann
3,028,479 A 4/1962 Tauschek
3,029,832 A 4/1962 Tischler et al.
3,054,392 A 9/1962 Thompson
3,070,080 A 12/1962 Van Slooten
3,078,194 A 2/1963 Thompson
3,079,903 A 3/1963 Humphreys
3,086,507 A 4/1963 Mooney, Jr.
3,089,472 A 5/1963 Thompson
3,090,367 A 5/1963 Ayres
3,101,077 A 8/1963 Engle
3,101,402 A 8/1963 Gondek
3,108,580 A 10/1963 Crane, jr.
3,109,418 A 11/1963 Exline et al.
3,111,118 A 11/1963 Weiman
3,111,119 A 11/1963 Bergmann
3,114,361 A 12/1963 Mullen
3,124,114 A 3/1964 Voorhies
3,124,115 A 3/1964 Voorhies
3,128,749 A 4/1964 Dadd
3,137,282 A 6/1964 Voorhies
3,137,283 A 6/1964 Sampietro
3,138,146 A 6/1964 Hutchison
3,139,076 A 6/1964 Flaherty
3,139,078 A 6/1964 Slooten
3,139,872 A 7/1964 Thompson
3,144,010 A 8/1964 Van Slooten
3,147,745 A 9/1964 Kilgore
3,151,603 A 10/1964 Schumm
3,153,404 A 10/1964 Slooten
3,166,057 A 1/1965 Konrad et al.
3,169,515 A 2/1965 Kilgore et al.
3,176,669 A 4/1965 Kuchen et al.
3,177,857 A 4/1965 Kuchen et al.
3,180,328 A 4/1965 Engle
3,194,439 A 7/1965 Beduerftig
3,200,801 A 8/1965 Dornbos
3,220,393 A 11/1965 Schlink
3,224,243 A 12/1965 Van Deberg
3,225,752 A 12/1965 Robinson
3,234,815 A 2/1966 Line
RE25,974 E 3/1966 Dadd
3,240,195 A 3/1966 Sossna
3,255,513 A 6/1966 Robinson et al.
3,267,918 A 8/1966 Ayres
3,267,919 A 8/1966 Wortman
3,270,724 A 9/1966 Dolza
3,273,514 A 9/1966 Bender
3,273,546 A 9/1966 Von Arx
3,273,547 A 9/1966 Lesher
3,273,548 A 9/1966 Hoffman
3,273,998 A 9/1966 Knoth et al.
3,277,874 A 10/1966 Wagner
3,280,806 A 10/1966 Iskenderian
3,280,807 A 10/1966 Bardy
3,291,107 A 12/1966 Cornell
3,299,869 A 1/1967 Sicklesteel
3,299,986 A 1/1967 Briggs et al.
3,301,239 A 1/1967 Thauer
3,301,241 A 1/1967 Iskanderian
3,303,833 A 2/1967 Melling
3,304,925 A 2/1967 Rhoads
3,314,303 A 4/1967 Maat
3,314,404 A 4/1967 Thompson
3,322,104 A 5/1967 Abell, Jr.
3,332,405 A 7/1967 Haviland
3,354,898 A 11/1967 Barnes 3,365,979 A 1/1968 Ericson
3,367,312 A 2/1968 Jonsson
3,379,180 A 4/1968 Kabel et al.
3,385,274 A 5/1968 Shunta et al.
3,400,696 A 9/1968 Thompson
3,405,699 A 10/1968 Laas
3,410,366 A 11/1968 Winter, Jr.
3,413,965 A 12/1968 Gavasso
3,422,803 A 1/1969 Stivender
3,426,651 A 2/1969 Arendarski
3,430,613 A 3/1969 Barnes
3,437,080 A 4/1969 Abell, Jr.
3,439,659 A 4/1969 Bouwkamp
3,439,660 A 4/1969 Lesher
3,439,662 A 4/1969 Jones et al.
3,448,730 A 6/1969 Abell, Jr.
3,450,228 A 6/1969 Wortman et al.
3,455,346 A 7/1969 Stork
3,463,131 A 8/1969 Dolby
3,470,857 A 10/1969 Stivender
3,470,983 A 10/1969 Briggs
3,476,093 A 11/1969 Line
3,490,423 A 1/1970 Shunta et al.
3,502,058 A 3/1970 Thompson
3,518,976 A 7/1970 Thuesen
3,520,287 A 7/1970 Calvin
3,521,633 A 7/1970 Yahner
3,523,459 A 8/1970 Mowbray
3,528,451 A 9/1970 Hansen
3,542,001 A 11/1970 Line
3,547,087 A 12/1970 Siegler
3,549,430 A 12/1970 Kies et
3,549,431 A 12/1970 de Coye de Ca
3,572,300 A 3/1971 Stager et al.
3,587,539 A 6/1971 Dadd
3,590,796 A 7/1971 Harkness
3,598,095 A 8/1971 Ayres
3,630,179 A 12/1971 Dadd
3,633,555 A 1/1972 Raggi
3,641,988 A 2/1972 Torazza et al.
3,650,251 A 3/1972 Pelizzoni
3,662,725 A 5/1972 Dragon et al.
3,664,312 A 5/1972 Miller, Jr.
3,665,156 A 5/1972 Lee
3,668,945 A 6/1972 Hofmann
3,690,959 A 9/1972 Thompson
3,716,036 A 2/1973 Kruger
3,717,134 A 2/1973 Cornell
3,722,484 A 3/1973 Gordini
3,741,240 A 6/1973 Berriman
3,742,921 A 7/1973 Rendine
3,782,345 A 1/1974 Erickson et al.
3,786,792 A 1/1974 Pelizzoni et al.
3,795,229 A 3/1974 Weber
3,799,129 A 3/1974 Cornell
3,799,186 A 3/1974 Bulin
3,805,753 A 4/1974 Bergmann et al.
3,822,683 A 7/1974 Clouse
3,831,457 A 8/1974 Kern
3,838,669 A 10/1974 Dadd
3,848,188 A 11/1974 Ardezzone et al.
3,855,981 A 12/1974 Loon
3,859,969 A 1/1975 Davis, Jr.
3,860,457 A 1/1975 Vourinen et al.
3,870,024 A 3/1975 Ridgeway
3,875,908 A 4/1975 Ayres
3,875,911 A 4/1975 Joseph
3,877,445 A 4/1975 Barnes
3,877,446 A 4/1975 Morgan
3,879,023 A 4/1975 Pearce et al.
3,880,127 A 4/1975 Abell, Jr.
3,886,808 A 6/1975 Weber
3,893,873 A 7/1975 Hanai et al.
3,902,467 A 9/1975 Cornell
3,911,879 A 10/1975 Altmann
3,915,129 A 10/1975 Rust et al.
3,921,609 A 11/1975 Rhoads
3,945,367 A 3/1976 Turner, Jr.
3,958,900 A 5/1976 Ueno
3,964,455 A 6/1976 Brown
3,967,602 A 7/1976 Brown
3,977,370 A 8/1976 Humphreys
3,992,663 A 11/1976 Seddick
3,998,190 A 12/1976 Keske
4,004,558 A 1/1977 Scheibe
4,007,716 A 2/1977 Jones
4,009,695 A 3/1977 Ule
4,009,696 A 3/1977 Cornell
4,050,435 A 9/1977 Fuller, Jr. et al.
4,061,123 A 12/1977 Janes
4,064,844 A 12/1977 Matsumoto et al.
4,064,861 A 12/1977 Schulz
4,080,941 A 3/1978 Bertrand
4,086,887 A 5/1978 Schoonover et al.
4,089,234 A 5/1978 Henson et al.
4,094,279 A 6/1978 Kueny
4,098,240 A 7/1978 Abell, Jr.
4,104,991 A 8/1978 Abdoo
4,104,996 A 8/1978 Hosono et al.
4,105,267 A 8/1978 Mori
4,107,921 A 8/1978 Iizuka
4,114,588 A 9/1978 Jordan
4,114,643 A 9/1978 Aoyama et al.
4,133,332 A 1/1979 Benson et al.
4,141,333 A 2/1979 Gilbert
4,151,817 A 5/1979 Mueller
4,152,953 A 5/1979 Headley
4,164,917 A 8/1979 Glasson
4,167,931 A 9/1979 Iizuka
4,173,209 A 11/1979 Jordan
4,173,954 A 11/1979 Speckhart
4,175,534 A 11/1979 Jordan
4,184,464 A 1/1980 Svihlik
4,188,933 A 2/1980 Iizuka
4,191,142 A 3/1980 Kodama
4,192,263 A 3/1980 Kitagawa et al.
4,200,081 A 4/1980 Meyer et al.
4,203,397 A 5/1980 Soeters, Jr.
4,204,814 A 5/1980 Matzen
4,206,734 A 6/1980 Perr et al.
4,207,775 A 6/1980 Lintott
4,213,442 A 7/1980 Mihalic
4,221,199 A 9/1980 Buuck et al.
4,221,200 A 9/1980 Soeters, Jr.
4,221,201 A 9/1980 Soeters, Jr.
4,222,354 A 9/1980 Uitvlugt
4,222,793 A 9/1980 Grindahl
4,227,149 A 10/1980 Faure et al.
4,227,494 A 10/1980 Uitvlugt
4,227,495 A 10/1980 Krieg
4,228,771 A * 10/1980 Krieg ..... 123/90.55
4,230,076 A 10/1980 Mueller
4,231,267 A 11/1980 Van Slooten
4,237,832 A 12/1980 Hartig et al.
4,245,596 A 1/1981 Bruder et al.
4,249,488 A 2/1981 Siegla
4,249,489 A 2/1981 Bruder et al.
4,252,093 A 2/1981 Hazelrigg
4,256,070 A 3/1981 Mueller
4,258,671 A 3/1981 Takizawa et al.
4,258,673 A 3/1981 Stoody, Jr. et al.
4,262,640 A 4/1981 Clark
4,284,042 A 8/1981 Springer
4,285,310 A 8/1981 Takizawa et al.
4,305,356 A 12/1981 Walsh
4,325,589 A 4/1982 Hirt 4,326,484 A 4/1982 Amrhein
4,335,685 A 6/1982 Clouse
4,336,775 A 6/1982 Meyer
4,337,738 A 7/1982 Bubniak et al.
4,338,894 A 7/1982 Kodama
4,356,799 A 11/1982 Clark
4,361,120 A 11/1982 Kueny
4,362,991 A 12/1982 Carbine
4,363,300 A 12/1982 Honda
4,367,701 A 1/1983 Buente
4,369,627 A 1/1983 Kasting et al.
4,380,219 A 4/1983 Walsh
4,385,599 A 5/1983 Hori et al.
4,387,674 A 6/1983 Connell
4,387,675 A 6/1983 Hori et al.
4,387,680 A 6/1983 Tsunetomi et al.
4,397,270 A 8/1983 Aoyama
4,401,064 A 8/1983 Nakamura et al.
4,402,285 A 9/1983 Arai et al.
4,406,257 A 9/1983 Keske et al.
4,408,580 A 10/1983 Kosuda et al.
4,411,229 A 10/1983 Curtis et al.
4,414,935 A 11/1983 Curtis et al.
4,437,439 A 3/1984 Speil
4,437,738 A 3/1984 Headley et al.
4,438,736 A 3/1984 Hara et al.
4,440,121 A 4/1984 Clancy et al.
4,442,806 A 4/1984 Matsuura et al.
4,448,155 A 5/1984 Hillebrand et al.
4,448,156 A 5/1984 Henault
4,452,187 A 6/1984 Kosuda et al.
4,457,270 A 7/1984 Kodama et al.
4,459,946 A 7/1984 Burandt
4,462,353 A 7/1984 Arai et al.
4,462,364 A 7/1984 Kodama
4,463,714 A * 8/1984 Nakamura ..... 123/90.57
4,465,038 A 8/1984 Speil
4,466,390 A 8/1984 Babitzka et al.
4,469,061 A 9/1984 Ajiki et al.
4,475,489 A 10/1984 Honda
4,475,497 A 10/1984 Honda et al.
4,480,617 A 11/1984 Nakano et al.
4,481,913 A 11/1984 Wirth
4,481,919 A 11/1984 Honda et al.
4,483,281 A 11/1984 Black
4,484,546 A 11/1984 Burandt
4,488,520 A 12/1984 Almor
4,498,432 A 2/1985 Hara et al.
4,499,870 A 2/1985 Aoyama
4,502,425 A 3/1985 Wride
4,502,428 A 3/1985 Paar
4,503,818 A 3/1985 Hara et al.
4,506,635 A 3/1985 van Rinsum
4,509,467 A 4/1985 Arai et al.
4,515,121 A 5/1985 Matsuura et al.
4,515,346 A 5/1985 Gaterman, III
4,517,936 A 5/1985 Burgio di Aragona
4,519,345 A 5/1985 Walter
4,523,550 A 6/1985 Honda et al.
4,524,731 A 6/1985 Rhoads
4,526,142 A 7/1985 Hara et al.
4,534,323 A 8/1985 Kato et al.
4,535,732 A 8/1985 Nakano et al.
4,537,164 A 8/1985 Ajiki et al.
4,537,165 A 8/1985 Honda et al.
4,539,951 A 9/1985 Hara et al.
4,541,878 A 9/1985 Mühlberger et al.
4,545,342 A 10/1985 Nakano et al.
4,546,734 A 10/1985 Kodama
4,549,509 A 10/1985 Burtchell
4,556,025 A 12/1985 Morita
4,559,909 A 12/1985 Honda et al.
4,561,393 A 12/1985 Kopel
4,567,861 A 2/1986 Hara et al.
4,570,582 A 2/1986 Speil
4,576,128 A 3/1986 Kenichi
4,579,094 A 4/1986 Döppling et al.
4,584,974 A 4/1986 Aoyama et al.
4,584,976 A 4/1986 Hillebrand
4,587,936 A 5/1986 Matsuura et al.
4,589,383 A 5/1986 Showalter
4,589,387 A 5/1986 Miura et al.
4,590,898 A 5/1986 Buente et al.
RE32,167 E 6/1986 Buente
4,596,213 A 6/1986 Hillebrand
4,602,409 A 7/1986 Schaeffler
4,607,599 A 8/1986 Buente et al.
4,611,558 A 9/1986 Yoshizaki et al.
4,612,884 A 9/1986 Ajiki et al.
4,614,171 A 9/1986 Malhotra
4,615,306 A 10/1986 Wakeman
4,615,307 A 10/1986 Kodama et al.
4,624,223 A 11/1986 Wherry et al.
4,628,874 A 12/1986 Barlow
4,633,827 A 1/1987 Buente
4,635,593 A 1/1987 Kodama
4,637,357 A 1/1987 Ohmi
4,638,773 A 1/1987 Bonvallet
4,643,141 A 2/1987 Bledsoe
4,648,360 A 3/1987 Schaeffler
4,653,441 A 3/1987 Belsanti
4,655,176 A 4/1987 Sheehan
4,656,977 A 4/1987 Nagahiro et al.
4,671,221 A 6/1987 Geringer et al.
4,674,451 A 6/1987 Rembold et al.
4,677,723 A 7/1987 Greene, Sr.
4,690,110 A 9/1987 Nishimura et al.
4,693,214 A 9/1987 Titolo
4,694,788 A 9/1987 Craig
4,696,265 A 9/1987 Nohira
4,697,473 A 10/1987 Patel
4,699,094 A 10/1987 Stegeman
4,704,995 A 11/1987 Soeters, Jr.
4,708,102 A 11/1987 Schmid
4,711,202 A 12/1987 Baker
4,711,207 A 12/1987 Bonvallet
4,716,863 A 1/1988 Pruzan
4,718,379 A 1/1988 Clark
4,724,802 A 2/1988 Ishii
4,724,804 A 2/1988 Wirth
4,724,822 A 2/1988 Bonvallet
4,726,332 A 2/1988 Nishimura et al.
4,727,830 A 3/1988 Nagahiro et al.
4,727,831 A 3/1988 Nagahiro et al.
4,738,231 A 4/1988 Patel et al.
4,741,297 A 5/1988 Nagahiro et al.
4,741,298 A 5/1988 Rhoads
4,745,888 A 5/1988 Kapp
4,747,376 A 5/1988 Speil et al.
4,756,282 A 7/1988 Kunz et al.
4,759,321 A 7/1988 Matsumoto et al.
4,759,322 A 7/1988 Konno
4,762,096 A 8/1988 Kamm et al.
4,765,288 A 8/1988 Linder et al.
4,765,289 A 8/1988 Masuda et al.
4,768,467 A 9/1988 Yamada et al.
4,768,475 A 9/1988 Ikemura
4,771,741 A 9/1988 Leer
4,771,742 A 9/1988 Nelson et al.
4,773,359 A 9/1988 Titolo
4,779,583 A 10/1988 Laffter et al.
4,779,589 A 10/1988 Matsuura et al.
4,782,799 A 11/1988 Goppelt et al.
4,784,095 A 11/1988 Golding et al.
4,787,347 A 11/1988 Schaeffler
4,790,274 A 12/1988 Inoue et al.

4,791,895 A 12/1988 Tittizer
4,793,295 A 12/1988 Downing
4,793,296 A 12/1988 Inoue et al.
4,796,483 A 1/1989 Patel et al.
4,796,573 A 1/1989 Wakeman et al.
4,799,463 A 1/1989 Konno
4,800,850 A 1/1989 Yoshida et al.
4,802,448 A 2/1989 Ableitner
4,803,334 A 2/1989 Burke et al.
4,805,567 A 2/1989 Heimburg
4,809,651 A 3/1989 Gerchow et al.
4,815,424 A 3/1989 Buuck et al.
4,825,717 A 5/1989 Mills
4,825,823 A 5/1989 Schaeffler
4,829,948 A 5/1989 Yoshida et al.
4,840,153 A 6/1989 Aida et al.
4,844,022 A 7/1989 Konno
4,844,023 A 7/1989 Konno et al.
4,848,180 A 7/1989 Mills
4,848,285 A 7/1989 Konno
4,850,311 A 7/1989 Sohn
4,858,574 A 8/1989 Fukuo et al.
4,869,214 A 9/1989 Inoue et al.
4,872,429 A 10/1989 Anderson et al.
4,876,114 A 10/1989 Schaeffler et al.
4,876,944 A 10/1989 Wilson et al.
4,876,994 A 10/1989 Speil et al.
4,876,997 A 10/1989 Zorn et al.
4,883,027 A 11/1989 Oikawa et al.
4,887,561 A 12/1989 Kishi
4,887,563 A 12/1989 Ishida et al.
4,887,566 A 12/1989 Shida
4,896,635 A 1/1990 Willermet et al.
4,899,701 A 2/1990 Inoue et al.
4,905,639 A 3/1990 Konno
4,909,195 A 3/1990 Hasebe et al.
4,909,197 A 3/1990 Perr
4,917,056 A 4/1990 Yagi et al.
4,917,059 A 4/1990 Umeda
4,919,089 A 4/1990 Fujiyoshi et al.
4,920,935 A 5/1990 Shida
4,921,064 A 5/1990 Wazaki et al.
4,924,821 A 5/1990 Teerman
4,926,804 A 5/1990 Fukuo
4,930,465 A 6/1990 Wakeman et al.
4,940,048 A 7/1990 Mills
4,944,257 A 7/1990 Mills
4,951,619 A 8/1990 Schaeffler
4,957,076 A 9/1990 Inoue et al.
4,959,794 A 9/1990 Shiraishi et al.
RE33,411 E 10/1990 Inoue et al.
4,969,102 A 11/1990 Tamura et al.
4,971,164 A 11/1990 Fujita et al.
4,986,227 A 1/1991 Dewey, III
4,993,150 A 2/1991 Reinhardt et al.
4,995,281 A 2/1991 Allor et al.
5,003,939 A 4/1991 King
5,010,856 A 4/1991 Ojala
5,010,857 A 4/1991 Hempelmann et al.
5,018,487 A 5/1991 Shinkai
5,022,356 A 6/1991 Morel, Jr. et al.
5,025,761 A 6/1991 Chen
5,028,281 A 7/1991 Hayes et al.
5,033,420 A 7/1991 Matayoshi et al.
5,036,807 A 8/1991 Kaneko
5,040,651 A 8/1991 Hampton et al.
5,042,436 A 8/1991 Yamamoto et al.
5,042,437 A 8/1991 Sakuragi et al.
5,046,462 A 9/1991 Matayoshi et al.
5,048,475 A 9/1991 Mills
5,069,173 A 12/1991 Mallas
5,070,827 A 12/1991 Krieg et al.
5,074,260 A 12/1991 Yagi et al.
5,074,261 A 12/1991 Hamburg et al.
5,080,053 A 1/1992 Parsons
5,088,455 A 2/1992 Moretz
5,090,364 A 2/1992 McCarroll et al.
5,099,806 A 3/1992 Murata et al.
5,099,807 A 3/1992 Devine
5,107,806 A 4/1992 Döhring et al.
5,113,813 A 5/1992 Rosa
RE33,967 E 6/1992 Honda et al.
5,119,774 A 6/1992 Krieg et al.
5,127,374 A 7/1992 Morel, Jr. et al.
5,129,373 A 7/1992 Cuatt et al.
5,148,783 A 9/1992 Shinkai et al.
5,150,672 A 9/1992 Fischer et al.
5,161,493 A 11/1992 Ma
5,163,389 A 11/1992 Fujikawa et al.
5,178,107 A 1/1993 Morel, Jr. et al.
5,181,485 A 1/1993 Hirose et al.
5,184,581 A 2/1993 Aoyama et al.
5,186,130 A 2/1993 Melchior
5,188,067 A 2/1993 Fontichiaro et al.
5,188,068 A 2/1993 Gaterman, III et al.
5,189,997 A 3/1993 Schneider
5,193,496 A 3/1993 Kruger
5,199,393 A 4/1993 Baldassini
5,239,951 A 8/1993 Rao et al.
5,247,913 A 9/1993 Manolis
5,253,621 A 10/1993 Dopson et al.
5,259,346 A 11/1993 Mills
5,261,361 A 11/1993 Speil
5,263,386 A 11/1993 Campbell et al.
5,273,005 A 12/1993 Philo et al.
5,287,830 A 2/1994 Dopson et al.
5,301,636 A 4/1994 Nakamura
5,307,769 A 5/1994 Meagher et al.
5,320,082 A 6/1994 Murata et al.
5,343,833 A 9/1994 Shirai
5,345,898 A 9/1994 Krebs
5,347,965 A 9/1994 Decuir
5,351,662 A 10/1994 Dopson et al.
5,353,756 A 10/1994 Murata et al.
5,357,916 A 10/1994 Matterazzo
5,361,733 A 11/1994 Spath et al.
5,365,896 A 11/1994 Hara et al.
5,379,730 A 1/1995 Schaeffler
5,385,124 A 1/1995 Hillebrand et al.
5,386,806 A 2/1995 Hurr et al.
5,394,843 A 3/1995 Decuir
5,398,648 A 3/1995 Spath et al.
5,402,756 A 4/1995 Bohme et al.
5,419,290 A 5/1995 Hurr et al.
5,429,079 A 7/1995 Murata et al.
5,430,934 A 7/1995 Groh et al.
5,431,133 A 7/1995 Spath et al.
5,454,353 A 10/1995 Elendt et al.
5,501,186 A 3/1996 Hara et al.
5,509,385 A 4/1996 LaVieri
5,520,144 A 5/1996 Philo et al.
5,544,626 A 8/1996 Diggs et al.
5,546,899 A 8/1996 Sperling et al.
5,549,081 A 8/1996 Ohlendorf et al.
5,553,584 A 9/1996 Konno
5,555,861 A 9/1996 Mayr et al.
5,560,265 A 10/1996 Miller
5,560,329 A 10/1996 Hayman
5,566,652 A 10/1996 Deppe
5,584,268 A 12/1996 Natkin et al.
5,592,907 A 1/1997 Hasebe et al.
5,603,294 A 2/1997 Kawai
5,613,469 A 3/1997 Rygiel
5,642,694 A 7/1997 Dura et al.
5,651,335 A 7/1997 Elendt et al.
5,653,198 A 8/1997 Diggs

| | | | |
|---|---|---|---|
| 5,655,487 | A | 8/1997 | Maas et al. |
| 5,655,488 | A | 8/1997 | Hampton et al. |
| 5,660,153 | A | 8/1997 | Hampton et al. |
| 5,673,661 | A | 10/1997 | Jesel |
| 5,678,514 | A | 10/1997 | Mazzella et al. |
| 5,697,333 | A | 12/1997 | Church et al. |
| 5,706,773 | A | 1/1998 | Dura et al. |
| 5,746,165 | A | 5/1998 | Speil et al. |
| 5,775,275 | A | 7/1998 | Philo |
| 5,797,364 | A | 8/1998 | Meek et al. |
| 5,806,475 | A | 9/1998 | Hausknecht |
| 5,875,748 | A | 3/1999 | Haas et al. |
| 5,893,344 | A | 4/1999 | Church |
| 5,908,015 | A | 6/1999 | Kreuter |
| 5,924,396 | A | 7/1999 | Ochiai et al. |
| 5,934,232 | A | 8/1999 | Greene et al. |
| 5,960,756 | A | 10/1999 | Miyachi et al. |
| 5,983,848 | A | 11/1999 | Calka |
| 6,006,706 | A | 12/1999 | Kanzaki |
| 6,032,624 | A | 3/2000 | Tsuruta et al. |
| 6,058,895 | A | 5/2000 | Hermsen |
| 6,092,497 | A | 7/2000 | Preston et al. |
| 6,186,101 | B1 | 2/2001 | Kreuter |
| 6,196,175 | B1 | 3/2001 | Church |
| 6,273,039 | B1 | 8/2001 | Church |
| 6,321,704 | B1 | 11/2001 | Church et al. |
| 6,321,705 | B1 | 11/2001 | Fernandez et al. |
| 6,325,030 | B1 | 12/2001 | Spath et al. |
| 6,325,034 | B1 | 12/2001 | Edelmayer |
| 6,328,009 | B1 | 12/2001 | Brothers |
| 6,418,904 | B2 | 7/2002 | Hannon et al. |
| 6,439,179 | B2 | 8/2002 | Hendriksma et al. |
| 6,513,470 | B1 | 2/2003 | Hendriksma et al. |
| 2003/0196620 | A1 | 10/2003 | Spath |

OTHER PUBLICATIONS

"GM Displacement on Demand," Jim Kerr, Canadian Driver, Oct. 25, 2002, 01468-01469.
"Eaton adds variability to Displacement on Demand," Frank Bokulich, Automotive Engineering International Tech Brief, Jan. 2002, 01471-01473.
"GM Power Train Displaces on Demand," Jean L. Broge, Automotive Engineering International Online, Jul. 2001, 01474-01476.
"GM Technology," Daniel J. Holt, Service Tech Magazine, Jul. 2001, 01477-01479.
"Eaton adds variability to Displacement on Demand," Frank Bokulich, Automotive Engineering International Tech Brief, Jan. 2002, 01480-01483.
Prints, Mar. 14, 2000, 01484-01485.
Prints, Nov. 30, 2000, 01486-01494.
Print, Feb. 25, 2000, 01495.
"Hydraulic Valve Lifter," Delphi, Jul. 2, 2002, 01511-01513.
Prints, Aug. 24, 2001, 01566.
Prints, Jul. 16, 2001, 01567.
Prints, Aug. 24, 2001, 01568.
Prints, Jul. 17, 2001, 01572-01573.
Prints, Jan. 16, 2002, 01610.
Correspondence, Dhruva Mandal, Jun. 15, 2001, 01635-01638.
Prints, Aug. 24, 2001, 01640.
Prints, Jul. 16, 2001, 01641.
Prints, Jun. 7, 2001, 01642.
Prints, Jun. 17, 2000, 01643.
Prints, Jan. 16, 2002, 01644.
Prints, Jul. 17, 2000, 01645-01646.
Prints, Jun. 17, 2000, 01703.
Prints, May 30, 2001, 01704.
Drawings, undated, 01705.
Prints, Jun. 21, 1999, 01710.
Prints, Jun. 21, 1999, 01721.
Prints, Jun. 21, 1999, 01725.
Prints, Sep. 5, 2001, 01726.
Prints, Nov. 22, 2000, 01727.
Prints, Jul. 16, 2001, 01732.
Prints, Aug. 24, 2001, 01767.
Prints, Jul. 17, 2001, 01768.
Prints, Sep. 5, 2001, 01769.
Prints, Jul. 16, 2001, 01770.
Prints, Jun. 21, 1999, 01771.
Correspondence, Jerry Giessinger, Sep. 11, 2001, 01775-01788.
Prints, Sep. 9, 2001, 01789-01792.
Prints, Nov. 22, 2000, 01807.
Prints, Jul. 16, 2001, 01812.
Prints, Jul. 16, 2001, 01817.
Prints, Jul. 17, 2001, 01822.
Prints, Aug. 1, 2001, 01836.
Prints, Jul. 25, 2001, 01837.
Prints, Aug. 20, 2001, 01838.
Roller Lifter Body Powerpoint, Feb. 6, 2002, 01839-01843.
Prints, Aug. 20, 2001, 01844-01849.
Flyer, undated, 01850-01851.
Prints, Jan. 26, 1989, 01853-01854.
Prints, Oct. 7, 1985, 01856.
Prints, May 1, 1985, 01857.
Prints, May 31, 1985, 01859.
Prints, Mar. 6, 1986, 01860.
Prints, Oct. 7, 1985, 01862-01863.
Prints, Feb. 20, 1989, 01864.
Prints, Jan. 29, 1986, 01865.
Prints, Mar. 6, 1986, 01866.
Prints, May 30, 2001, 01921.
Prints, Mar. 14, 2000, 01922.
Prints, Jul. 17, 2000, 01946.
Prints, Mar. 14, 2000, 01922.
Prints, Jul. 17, 2000, 01950.
Prints, Mar. 14, 2000, 01952.
Prints, Nov. 30, 2000, 01953-01961.
Prints, Feb. 25, 2000, 01962.
Prints, Jun. 21, 1999, 01966-01967.
Correspondence, Jan. 31, 2002, 02011-02014.
Prints, Dec. 12, 2001, 02035.
Prints, Dec. 17, 2001, 02037.
Prints, Jun. 21, 1999, 02039.
Prints, Jun. 21, 1999, 02041.
Prints, Dec. 10, 2001, 02043.
Prints, Dec. 7, 2001, 02045.
Prints, Dec. 10, 2001, 02047.
Prints, Dec. 7, 2001, 02048.
Prints, Jul. 16, 2001, 02053.
Prints, Nov. 22, 2000, 02054.
Prints, Jul. 17, 2001, 02055.
Prints, Jun. 21, 1999, 02956.
Prints, Jul. 16, 2001, 02057.
Prints, Jul. 16, 2001, 02063.
Prints, Nov. 22, 2000, 02064.
Prints, Jul. 17, 2001, 02065.
Prints, Jun. 21, 1999, 02066.
Prints, Jul. 16, 2001, 02067.
Prints, Jul. 16, 2001, 02071.
Prints, Nov. 22, 2000, 02072.
Prints, Jul. 17, 2001, 02073.
Prings, Jun. 21, 1999, 02074.
Prints, Jul. 16, 2001, 02075.
Prints, Jun. 21, 1999, 02082.
Prints, Jun. 21, 1999, 02088-02089.
Prints, Jul. 16, 2001, 02097-2098.
Prints, Jul. 17, 2001, 02105.
Prints, Jul. 17, 2001, 02107.
Prints, Nov. 22, 2000, 02115-02116.
Prints, Jul. 16, 2001, 02124-02125.
Prints, Jul. 15, 1988, 02166.
Prints, Oct. 2, 1985, 02302.
Correspondence, Bob McCormick, Aug. 6, 1986, 02303-02304.
Report, D. Burkeen, May 9, 1985, 02429-02430.
Prints, Oct. 7, 1985, 02445.
Prints, Feb. 12, 1986, 02446.

Prints, Jul. 16, 1986, 02448.
Prints, Apr. 11, 1990, 02449.
Prints, Jun. 18, 1992, 02451.
Prints, Jan. 26, 1989, 02452.
Prints, Mar. 16, 1984, 02462-02463.
Prints, Jul. 20, 1984, 02464.
Prints, Dec. 10, 1984, 02465.
Prints, Jan. 2, 1985, 02474.
Prints, Feb. 12, 1986, 02475-02478.
Prints, Jul. 10, 1985, 02483.
Prints, Jul. 8, 1985, 02484.
Print, May 18, 1985, 02486.
Print, Jun. 6, 1985.
Prints, Jul. 26, 1985, 02488-02489.
Print, Jan. 2, 1985, 02492.
Print, Dec. 10, 1984, 02493.
Print, Jan. 2, 1995, 02494.
Print, Mar. 6, 1985, 02520.
Prints, Jan. 26, 1989, 02521-02522.
Print, Jun. 23, 1969, 02543.
Prints, Jun. 12, 1967, 02544.
Print, undated, 02545.
Print, Jun. 23, 1969, 02554.
Print, Jun. 12, 1967, 02555.
Print, undated, 02556.
Print, Dec. 10, 1984, 02635.
Prints, Oct. 7, 1985, 02644-02645.
Print, Jul. 22, 1974, 02646.
Prints, Sep. 7, 1972, 02647.
Print, Nov. 9, 1982, 02655.
Print, Aug. 21, 1981, 02656.
Print, Sep. 3, 1986, 02657.
Prints, Apr. 19, 1982, 02659-02660.
Prints, Apr. 19, 1982, 02662-02663.
Print, Jan. 2, 1985, 02664.
Print, Sep. 5, 1985, 02665.
Print, Oct. 3, 1985, 02666-02669.
Prints, Sep. 11, 1985, 02670-02671.
Print, Oct. 7, 1985, 02672.
Print, Sep. 23, 1985, 02673.
Print, Jan. 2, 1985, 02674.
Print, Dec. 10, 1984, 02675.
Print, Mar. 4, 1985, 02676.
Print, Jul. 12, 1982, 02677.
Prints, Jan. 6, 1986, 02678-02679.
Print, May 7, 1984, 02680.
Print, Aprl. 5, 1985, 02681.
Print, Sep. 17, 1985, 02682.
Print, Sep. 23, 1985, 02683.
Prints, Sep. 17, 1985, 02684-02686.
Print, Sep. 5, 1985, 02687.
Print, Dec. 10, 1984, 02688.
Print, Oct. 7, 1985, 02689.
Prints, Feb. 12, 1986, 02690-02691.
Prints, Oct. 7, 1985, 02692-02693.
Print, Feb. 12, 1986, 02694.
Print, Mar. 16, 1984, 02697.
Prints, May 7, 1981, 02698-02699.
Print, Jul. 11, 1984, 02700.
Print, Jun. 1, 1984, 02701.
Print, Mar. 16, 1984, 02702.
Print, Feb. 25, 1984, 02703.
Print, Mar. 21, 1984, 02704.
Print, Mar. 16, 1984, 02705.
Print, Mar. 27, 1986, 02706.
Prints, Sep. 17, 1985, 02707.
Print, Dec. 10, 1984, 02708.
Print, Jan. 26, 1989, 02709.
Prints, Mar. 23, 1989, 02710-02712.
Print, Sep. 7, 1972, 02713.
Print, Jul. 22, 1974, 02714.
Print, Oct. 7, 1985, 02715.
Print, Dec. 4, 1984, 02716.
Prints, Jan. 6, 1986, 02717-02718.
Print, Sep. 17, 1985, 02719.
Prints, Feb. 12, 1986, 02720-02723.
Prints, Jan. 6, 1986, 02724-02725.
Print, Jul. 15, 1982, 02726.
Prints, May 26, 1982, 02727-02735.
Print, Sep. 7, 1972, 02736.
Print, Jul. 22, 1974, 02738.
Print, Sep. 7, 1972, 02739.
Print, Apr. 3, 1982, 02740.
Print, May 16, 1980, 02742.
Print, Aug. 20, 1980, 02743.
Print, May 26, 1982, 02744.
Print, May 16, 1980, 02746.
Print, Aug. 20, 1980, 02747.
Prints, Dec. 10, 1984, 02748-02749.
Print, Jul. 16, 1984, 02750.
Print, Jul. 16, 1984, 02751
Print, Feb. 18, 1980, 02753.
Print, May 7, 1981, 02754.
Prints, May 7, 1981, 02755-02758.
Print, Oct. 29, 1982, 02759.
Prints, Sep. 26, 1983, 02760-02761.
Print, Oct. 29, 1982, 02762.
Print, Aug. 22, 1985, 02763.
Print, Oct. 7, 1985, 02764.
Print, Mar. 23, 1989, 02765.
Print, Jan. 26, 1989, 02766.
Print, Oct. 7, 1985, 02770.
Print, Apr. 4, 1986, 02771.
Prints, Feb. 12, 1986, 02772-02773.
Print, Oct. 7, 1985, 02774.
Print, Oct. 18, 1985, 02775.
Prints, Mar. 23, 1989, 02777-02779.
Prints, Jun. 3, 1982, 02780-02781.
Prints, undated, 02782-02783.
Print, Apr. 30, 1986, 02785.
Print, Jun. 23, 1986, 02786.
Print, Apr. 30, 1986, 02787.
Print, Jul. 11, 1984, 02788.
Print, Oct. 18, 1985, 02789.
Prints, Jul. 11, 1984, 02790-02791.
Prints, Sep. 16, 1986, 02792-02793.
Print, Jul. 10, 1984, 02794.
Print, Apr. 30, 1987, 02797.
Prints, Oct. 4, 1966, 02798-02799.
Print, Oct. 4, 1966, 02802.
Print, Feb. 18, 1980, 02804.
Print, May 7, 1981, 02805.
Print, Oct. 4, 1966, 02807.
Print, Mar. 21, 1984, 02808.
Print, Feb. 18, 1980, 02810.
Print, May 7, 1981, 02811.
Print, Undated, 02812.
Prints, Apr. 1, 1985, 02813-02815.
Prints, Sep. 9, 1984, 02816.
Prints, Sep. 26, 1984, 02817.
Prints, Sep. 28, 1984, 02818.
Prints, Jan. 24, 1986, 02819-02822.
Prints, Sep. 28, 1984, 02823.
Prints, Sep. 26, 1984, 02824-02826.
Prints, Dec. 4, 1984, 02827.
Prints, Sep. 28, 1984, 02828.
Prints, Feb. 11, 1986, 02829.
Prints, Sep. 28, 1984, 02830.
Prints, Sep. 28, 1984, 02831-02833.
Prints, Sep. 26, 1984, 02834-02837.
Prints, Sep. 28, 1984, 02838.
Prints, Sep. 28, 1982, 02839.
Prints, Undated, 02840-02841.
Prints, Dec. 17, 1985, 02842.
Prints, Oct. 5, 1985, 02843.
Prints, Oct. 7, 1985, 02844.

Prints, Oct. 2, 1985, 02846.
Prints, Dec. 6, 1990, 02949.
Prints, Undated, 02950-02951.
Prints, Dec. 12, 1973, 02952.
Prints, Jun. 25, 1981, 02953.
Prints, Jun. 10, 1969, 02954.
Prints, Dec. 8, 1965, 02955-02956.
Prints, Jun. 10, 1969, 02957-02960.
Prints, Oct. 2, 1985, 02961.
Prints, Oct. 30, 1985, 02962.
Prints, Oct. 31, 1985, 02963-02964.
Prints, Undated, 02965.
Prints, Apr. 16, 1985, 02966.
Prints, Aug. 8, 1988, 02867.
Print, Feb. 21, 1985, 02868.
Print, Oct. 31, 1985, 02869.
Print, Oct. 30, 1985, 02870.
Print, Oct. 31, 1985, 02871.
Print, Feb. 21, 1985, 02872.
Correspondence, Richard Bizer, Aug. 22, 1984, 02873-02878.
Print, Mar. 21, 1984, 02881.
Print, Sep. 26, 1984, 02882.
Print, Sep. 25, 1984, 02883.
Print, Nov. 9, 1982, 02884.
Print, Sep. 26, 1984, 02885.
Print, Jul. 11, 1984, 02886.
Print, Undated, 02887.
Print, Mar. 6, 1985, 02888.
Print, Jul. 1, 1988, 02890.
Print, Dec. 9, 1988, 02891.
Print, Oct. 31, 1985, 02892.
Print, Undated, 02893.
Print, Undated, 02894-02895.
Prints, Undated, 02896-02898.
Prints, Jul. 24, 1981, 02899-02900.
Print, Oct. 22, 1985, 02901.
Print, Oct. 28, 1985, 02902.
Print, Undated, 02903.
Print, Oct. 30, 1985, 02904.
Print, Undated, 02905.
Prints, Undated, 02906-02911.
Correspondence, Herb Earl, Sep. 17, 1991, 02912-02914.
Print, Sep. 5, 1985, 02976.
Print, Apr. 30, 1986, 02979.
Prints, Feb. 12, 1986, 02983-02984.
Correspondence, Dan Berg, Mar. 19, 1986, 03133-03135.
Print, Mar. 23, 1989, 03211.
Print, Mar. 23, 1989, 03228.
Print, Mar. 23, 1989, 03309.
Print, Oct. 7, 1985, 03373.
Print, Dec. 4, 1984, 03441.
Print, Dec. 4, 1984, 03443.
Print, May 1, 1985, 03498.
Print, Mar. 27, 1984, 03502.
Correspondence, Dan McMillan, Aug. 2, 1990, 03539-03541.
Print, Undated, 03640.
Print, Date Stamped Nov. 13, 1989, 03644.
Print, Sep. 28, 1989, 03645.
Print, Date Stamped Feb. 2, 1990, 03646.
Print, Oct. 22, 1986, 03648.
Print, Oct. 7, 1985, 03649.
Print, Date Stamped Dec. 1, 1986, 03651.
Print, Aug. 29, 1985, 03652.
Print, Mar. 6, 1990, 03653-03655.
Print, Date Stamped Jul. 15, 1987, 03657.
Print, Date Stamped, Sep. 1, 1986, 03658.
Print, Date Stamped, Oct. 13, 1989, 03659.
Print, Feb. 6, 1990, 03660-03661.
Print, Dated Stamped Feb. 2, 1990, 03662-03665.
Print, May 31, 1985, 03676.
Print, Apr. 1, 1986, 03687.
Prints, Sep. 7, 1972, 03720-03721.
Print, Jun. 22, 1974, 03723.
Print, Aug. 21, 1981, 03726.
Print, Feb. 22, 1981, 03727.
Print, May 1, 1985, 03733.
Print, Mar. 27, 1984, 03736-03737.
Correspondence, Mike S., Jul. 24, 1992, 03745-03747.
Print, May 1, 1985, 03755-03756.
Print, Dec. 13, 1984, 03757.
Print, Jan. 29, 1986, 03783.
Print, Jan. 2, 1985, 03807.
Print, Jun. 12, 1973, 03809.
Print, Nov. 20, 1985, 03818.
Print, Oct. 4, 1966, 03825.
Print, Jun. 12, 1967, 03826.
Print, Undated, 03827.
Print, Undated, 03832.
Print, Undated, 03834.
Print, Dec. 4, 1984, 03843.
Print, Dec. 4, 1984, 03850.
Print, Oct. 4, 1966, 03879.
Print, Jun. 12, 1967, 03880.
Print, Undated, 03881.
Print, May 6, 1986, 03883.
Print, Oct. 4, 1966, 03898.
Print, Jun. 12, 1967, 03899.
Print, Undated, 03900-03901.
Print, Feb. 18, 1967, 03902.
Print, Jan. 2, 1985, 03933.
Print, Apr. 30, 1986, 03942.
Print, Jun. 12, 1967, 03947.
Print, Undated, 03948-03949.
Print, Dec. 18, 1967, 03950.
Print, Undated, 03951-03952.
Print, Dec. 18, 1967, 03953-03954.
Print, Jun. 12, 1967, 03955-03956.
Print, Undated, 03958.
Print, Undated, 03961.
Prints, Sep. 28, 1984, 03972-03974.
Print, Undated, 03975.
Print, Jun. 12, 1967, 03976.
Print, Dec. 4, 1984, 03988-03991.
Prints, Jan. 29, 1986, 03992-03993.
Print, Dec. 26, 1984, 03994.
Prints, Jan. 6, 1986, 03995-03996.
Print, May 1, 1985, 03997.
Print, Nov. 21, 1985, 03998.
Print, Dec. 3, 1985, 03999.
Print, Sep. 23, 1985, 04000.
Print, May 31, 1985, 04001.
Print, Mar. 6, 1986, 04002.
Print, Dec. 4, 1984, 04003.
Prints, May 1, 1985, 04004-04006.
Print, Dec. 4, 1984, 04007.
Print, May 1, 1985, 04008.
Print, Dec. 4, 1984, 04009-04010.
Print, May 1, 1985, 04011.
Print, May 3, 1984, 04012.
Print, Mar. 27, 1984, 04013.
Print, May 31, 1985, 04014.
Print, Mar. 6, 1986, 04015.
Print, May 1, 1985, 04016.
Print, May 1, 1985, 04022.
Print, May 1, 1985, 04023.
Print, Feb. 20, 1989, 04024.
Print, Feb. 25, 1984, 04025.
Print, Jun. 11, 1984, 04026.
Print, Sep. 27, 1984, 04027.
Print, Jan. 15, 1985, 04028.
Print, Feb. 8, 1985, 04029.
Print, Dec. 3, 1988, 04030.
Print, Jan. 29, 1986, 04031.
Print, Mar. 13, 1985, 04032.
Print, Feb. 20, 1989, 04033.
Print, Feb. 20, 1989, 04034.

Print, May 1, 1985, 04036.
Print, Mar. 27, 1984, 04037.
Prints, Dec. 4, 1984, 04038-04043.
Prints, Jan. 6, 1986, 04043-04046.
Print, Jun. 3, 1985, 04047.
Print, Undated, 04051.
Prints, Date Stamped Oct. 14, 1986, 04052-04054.
Print, Dec. 4, 1984, 04055-04061.
Print, Jul. 12, 1984, 04062.
Print, Jul. 12, 1984, 04063.
Print, Mar. 27, 1984, 04064.
Print, Mar. 27, 1984, 04065.
Print, Mar. 27, 1984, 04066.
Print, Mar. 27, 1984, 04067.
Print, Jul. 12, 1984, 04068.
Print, Mar. 27, 1984, 04069.
Print, Mar. 27, 1984, 04071.
Prints, Feb. 20, 1989, 04072-04073.
Print, May 31, 1985, 04074.
Prints, Apr. 11, 1989, 02170.
Drawing depicting leakdown plunger, Jan. 10, 1984, 02439.
Drawing depicting leakdown plunger in dye block, Oct. 29, 1985, 02471.
Drawing depicting grain flow, Jun. 19, 1985, 02485.
Drawing depicting leakdown plunger, Oct. 3, 1986, 02505.
Print predating Oct. 18, 2002, 02509.
Print predating Oct. 18, 2002, 02519.
Print, Apr. 3, 1989, 02768.
Prints, Jun. 19, 1987, 02795-02796.
Drawing depicting leakdown plunger predating Oct. 18, 2002, 03213.
Drawing, Jan. 8, 1985, 03759.
Drawings predating Oct. 18, 2002, 03791-03794.
Print predating Oct. 18, 2002, 03795.
Drawing predating Oct. 18, 2002, 03808.
Drawing predating Oct. 18, 2002, 03811-03812.
Drawing predating Oct. 18, 2002, 03813-03814.
Drawing predating Oct. 18, 2002, 03815-03817.
Drawing predating Oct. 18, 2002, 03837.
Drawing predating Oct. 18, 2002, 03838.
Drawing predating Oct. 18, 2002, 03853-03858.
Drawing predating Oct. 18, 2002, 03930.
Drawing predating Oct. 18, 2002, 03932.
Print showing leakdown plunger predating Oct. 18, 2002, 03934.
Drawing showing leakdown plunger and tooling predating Oct. 18, 2002, 03959.
Print, Jul. 16, 2001, 01519.
Prints, Nov. 22, 2000, 01521.
Print, Jul. 17, 2001, 01523.
Print, Jun. 21, 1999, 01525.
Print, Jul. 16, 2001, 01527.
Print, Sep. 10, 1985, 02433.
Print, Jun. 6, 1985, 02491.
Print, Undated, 02509.
Print, Undated, 02519.
Print, Jan. 26, 1989, 02524.
Print, Undated, 02768.
Print, Aug. 4, 1988, 02769.
Print, Jun. 27, 1986, 02848.
Print, Undated, 03100.
Print, Jul. 15, 1988, 03264.
Print, Jul. 25, 1985, 03312.
Print, Jan. 6, 1986, 03360.
Print, Jan. 29, 1986, 03478.
Print, Dec. 4, 1984, 03716.
Prints, Apr. 11, 1990, 03740-03741.
Print with Handwritten Notes, Undated, 03748.
Print, Dec. 10, 1984, 03753.
Print, Dec. 3, 1985, 03758.
Prints, Jan. 29, 1981, 03820-03821.
Print, Jan. 2, 1985, 03929.
Print, Sep. 5, 1985, 03936.
Print, Feb. 24, 1989, 03987.
Print, Jun. 23, 1986, 04021.
Print, Dec. 4, 1984, 04050.
Print, Aug. 16, 2001, 04075.
Prints, Sep. 11, 2001, 01755-01763.
Print, May 2, 1986, 03942.
Interoffice Memorandum, Nov. 6, 2001, 01515-01516.
Interoffice Memorandum, Aug. 27, 2001, 01517-01528.
Prints, Feb. 2, 1980, 02344-02345.

* cited by examiner

VALVE OPERATING ASSEMBLY

FIELD OF THE INVENTION

The invention relates to bodies for lash adjusters, and particularly to lash adjusters used in combustion engines.

BACKGROUND OF THE INVENTION

Lash adjuster bodies are known in the art and are used in camshaft internal combustion engines. Lash adjuster bodies open and close valves that regulate fuel and air intake. As noted in U.S. Pat. No. 6,328,009 to Brothers, the disclosure of which is hereby incorporated herein by reference, Lash adjusters are typically fabricated through machining. Col. 8, II. 1–3. However, machining is inefficient, resulting in increased labor and decreased production.

The present invention is directed to overcoming this and other disadvantages inherent in prior-art lifter bodies.

SUMMARY OF THE INVENTION

The scope of the present invention is defined solely by the appended claims, and is not affected to any degree by the statements within this summary. Briefly stated, the present invention relates to a lash adjuster body, comprising an outer surface, enclosing a cavity, wherein the cavity includes an inner surface configured to accommodate an insert and a spring; and the cavity is fabricated through forging.

DETAILED DESCRIPTION OF THE PRESENTLY PREFERRED EMBODIMENT

Figure 1:
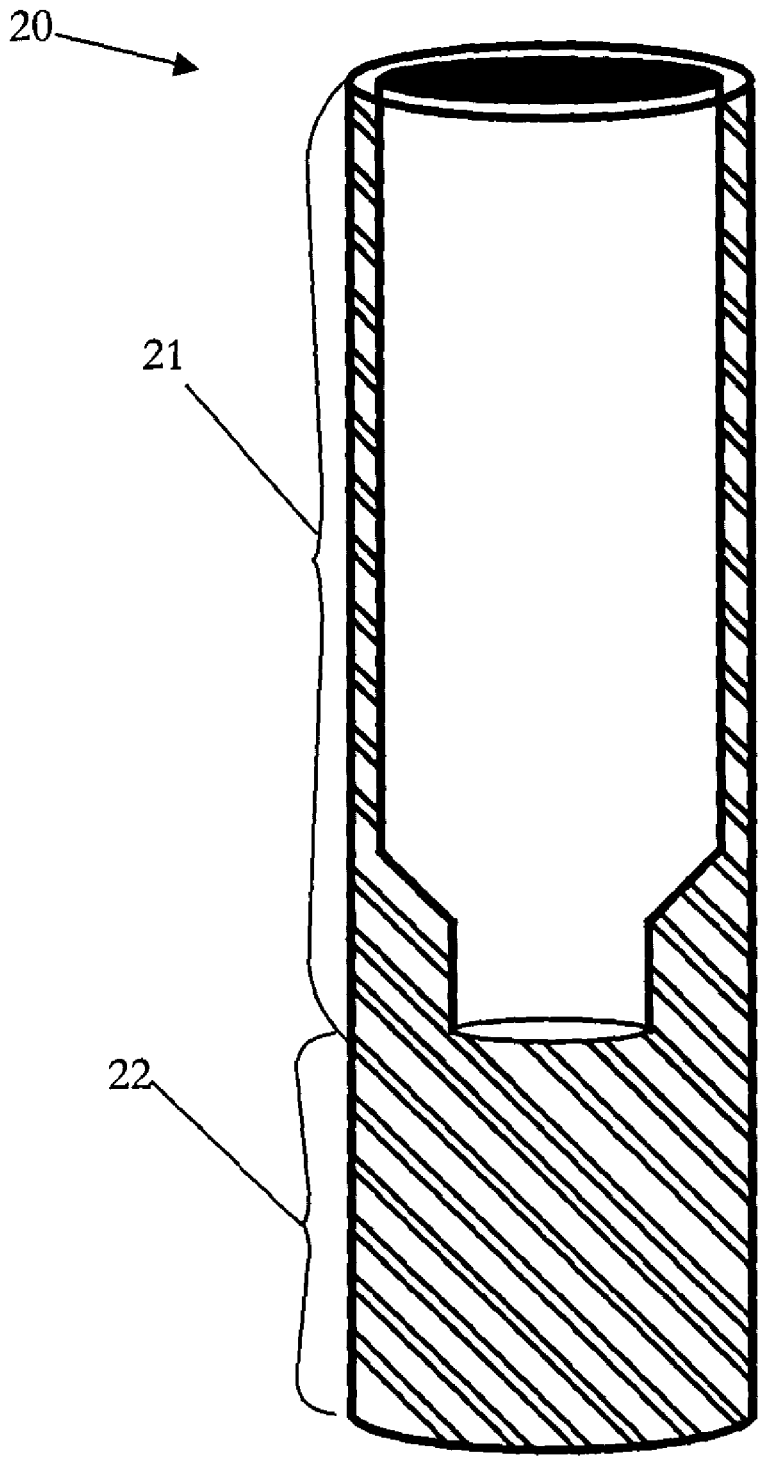
FIG. 1 depicts a preferred embodiment of an adjusting body.
Figure 2:
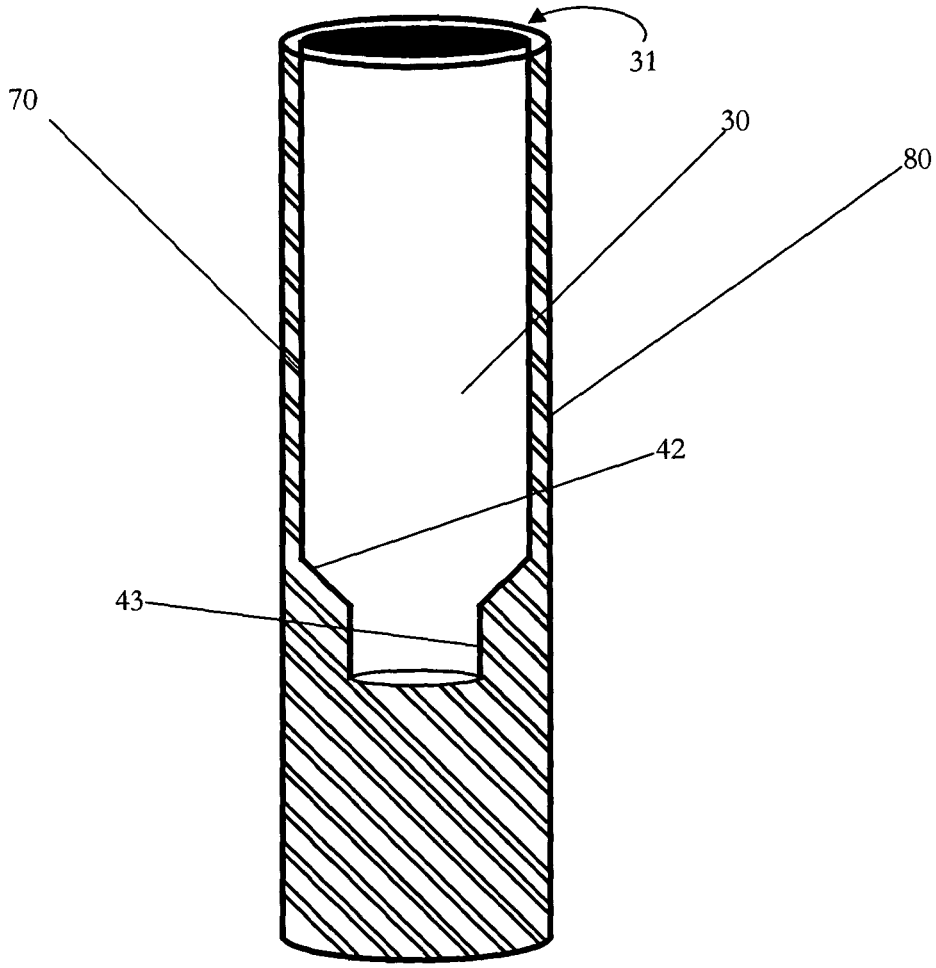
FIG. 2 depicts a preferred embodiment of an adjusting body.
Figure 3:
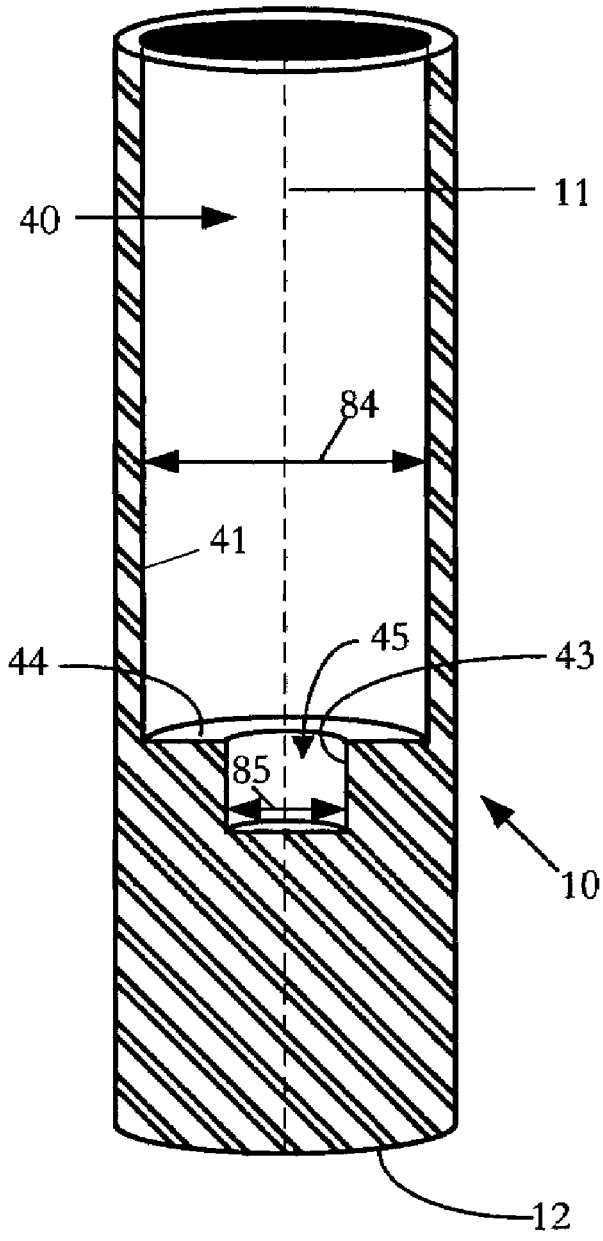
FIG. 3 depicts the top view of a preferred embodiment of an adjusting body.

Turning now to the drawings, FIGS. 1, 2, and 3 show a lash adjuster body 10 constituting a preferred embodiment of the present invention. The lash adjuster body 10 is composed of a metal, preferably aluminum. According to one aspect of the present invention, the metal is cooper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the lash adjuster body 10 is composed of pearlitic material. According to still another aspect of the present invention, the lash adjuster body 10 is composed of austenitic material. According to another aspect of the present invention, the metal is a ferritic material.

The body 20 functions to accommodate a plurality of inserts. According to one aspect of the present invention, the body 20 accommodates a leakdown plunger, such as that disclosed in "Leakdown Plunger," application Ser. No. 10/274,519, filed on Oct. 18, 2002, a copy of which is attached hereto, the disclosure of which is hereby incorporated herein by reference. According to another aspect of the present invention, the body 20 accommodates a push rod seat (not shown). According to yet another aspect of the present invention, the body 20 accommodates a metering socket such as that disclosed in "Metering Socket," application Ser. No. 10/316,262, filed on Oct. 18, 2002, a copy of which is attached hereto, the disclosure of which is hereby incorporated herein by reference.

The body 20 is provided with a plurality of outer surfaces and inner surfaces. FIG. 2 depicts a cross-sectional view of the preferred embodiment of the present invention. As shown in FIG. 2, the body 20 is provided with an outer surface 80 which is configured to be inserted into another body. According to one aspect of the present invention, the outer surface 80 is configured to be inserted into a roller lifter body such as that disclosed in Applicant's "Valve Lifter Body," application Ser. No. 10/316,263, filed on Oct. 18, 2002, a copy of which is attached hereto, the disclosure of which is incorporated herein by reference. According to another aspect of the present invention, the outer surface 80 is configured to be inserted into a roller follower such as that disclosed in Applicant's "Roller Follower Body," application Ser. No. 10/316,261, filed on Oct. 17, 2002.

The outer surface 80 encloses a plurality of cavities. As depicted in FIG. 2, the outer surface 80 encloses a cavity 30. The cavity 30 is configured to cooperate with a plurality of inserts. According to one aspect of the present invention, the cavity 30 is configured to cooperate with a leakdown plunger, preferably the leakdown plunger 210. According to another aspect of the present invention, the cavity 30 is configured to cooperate with a metering socket, preferably the socket 310. According to yet another aspect of the present invention, the cavity 30 is configured to cooperate with a push rod. According to still yet another aspect of the present invention, the cavity is configured to cooperate with a push rod seat.

Referring to FIG. 2, the body 20 of the present invention is provided with a cavity 30 that includes an opening 31. The opening 31 is in a circular shape. The cavity 30 is provided with an inner surface 40.

The inner surface 40 includes a plurality of surfaces. According to one aspect of the present invention, the inner surface 40 includes a cylindrical surface. According to another aspect of the present invention, the inner surface 40 includes a conical or frustoconical surface.

As depicted in FIG. 2, the inner surface 40 is provided with a first cylindrical surface 41, preferably concentric relative to the outer surface 80. Adjacent to the first cylindrical surface 41 is a conical surface 42. Adjacent to the conical surface 42 is a second cylindrical surface 43. However, those skilled in the art will appreciate that the inner surface 40 can be fabricated without the conical surface 42.

Figure 7:
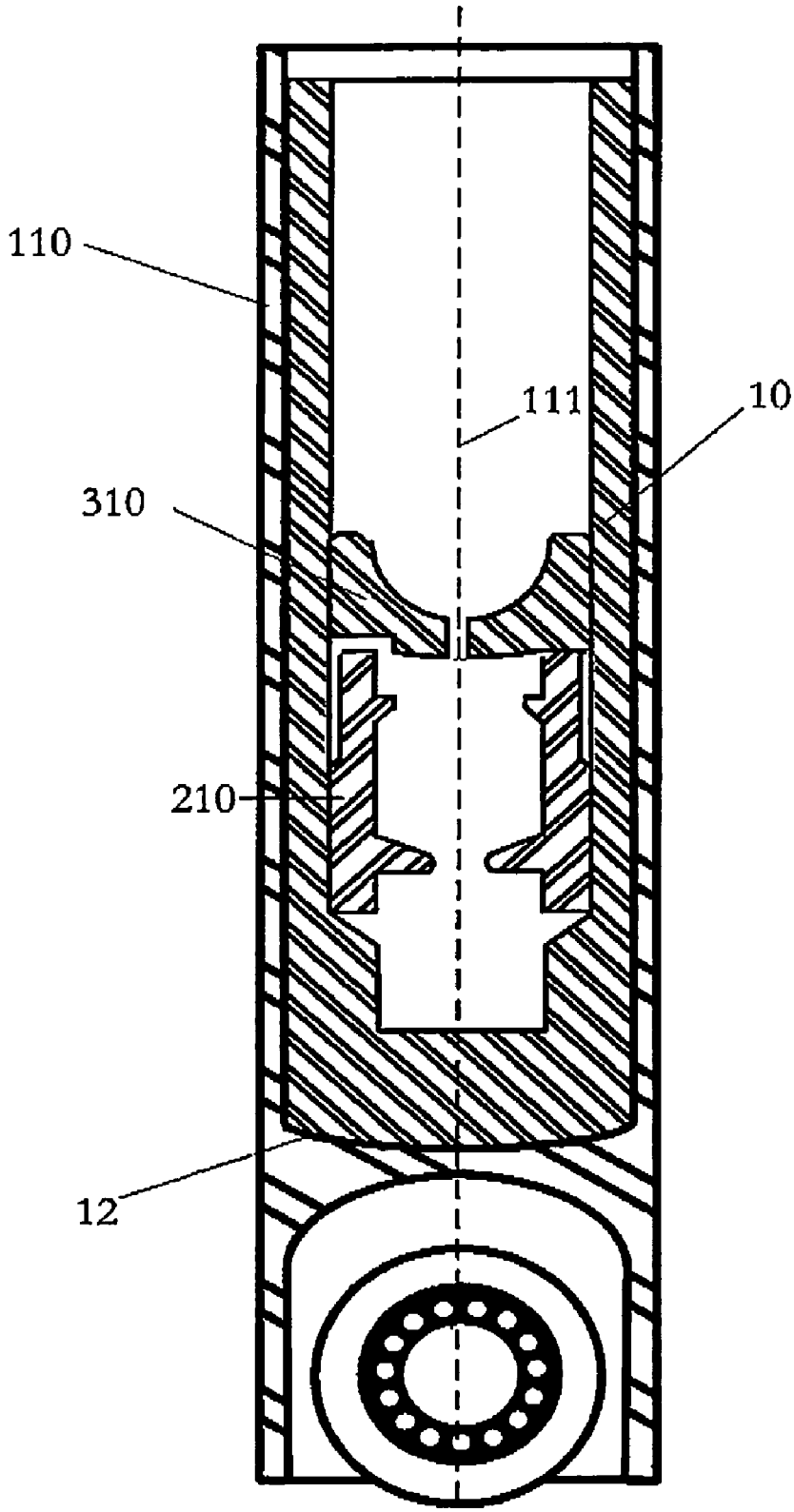
FIG. 7 depicts an adjusting body, a valve lifter body, a leakdown plunger, and a socket of the presently preferred embodiment.
Figure 49:
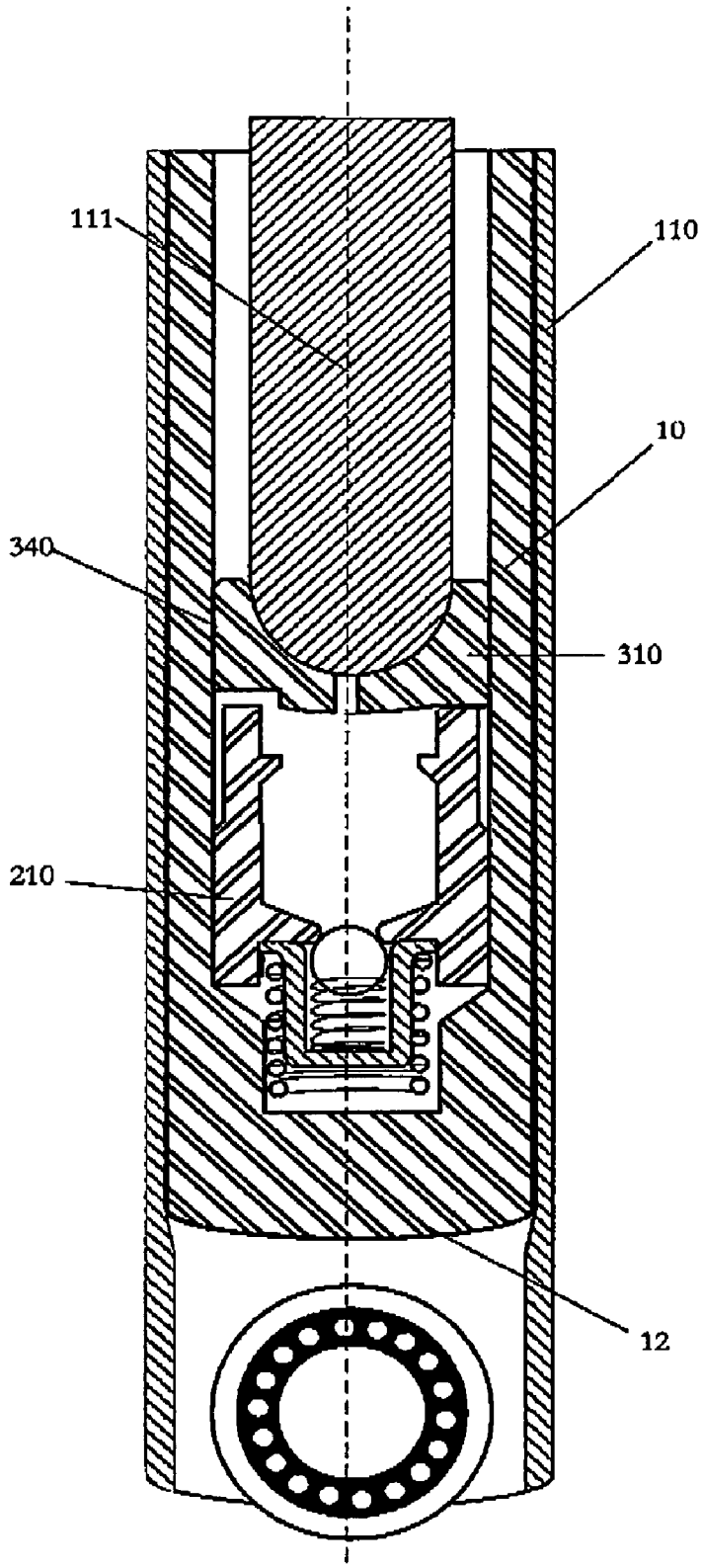
FIG. 49 depicts an embodiment of a socket cooperating with an engine work piece.

FIG. 3 depicts a cut-away view of the body 20 of another embodiment. The body 20 is provided with an axis 11 depicted as a dashed line designated "11" on FIG. 3 and a bottom surface 12 located on the outer surface 80 at the end of the body 20. The inner surface 40 is provided with a first cylindrical surface 41 that includes a first inner diameter 184. The first cylindrical surface 41 abuts an annular surface 44 with an annulus 45. The annulus 45 abuts and defines a second cylindrical surface 43 that includes a second inner diameter 85. In the embodiment depicted, the second inner diameter 85 is smaller than the first inner diameter 84. The annular surface 44 and the bottom surface 12 are oriented to be orthogonal to the axis 11 of the body 20, and, when the body 20 is inserted into a valve lifter body 110 (as represented in FIG. 7 and FIG. 49) the annular surface 44 and the bottom surface 12 are oriented to be orthogonal to the axis of the valve lifter body 110 (referred to herein as a "valve lifter axis 111").

The body 20 of the present invention is fabricated through a plurality of processes. According to one aspect of the present invention, the body 20 is machined. According to another aspect of the present invention, the body 20 is forged. According to yet another aspect of the present invention, the body 20 is fabricated through casting. The preferred embodiment of the present invention is forged. As used herein, the term "forge," "forging," or "forged" is intended to encompass what is known in the art as "cold forming," "cold heading," "deep drawing," and "hot forging."

The preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

The process of forging the preferred embodiment begins with a metal wire or metal rod which is drawn to size. The ends of the wire or rod are squared off by a punch. After being drawn to size, the wire or rod is run through a series of dies or extrusions.

The cavity 30 is extruded through use of a punch and an extruding pin. After the cavity 30 has been extruded, the cavity 30 is forged. The cavity 30 is extruded through use of an extruding punch and a forming pin.

Alternatively, the body 20 is fabricated through machining. As used herein, machining means the use of a chucking machine, a drilling machine, a grinding machine, or a broaching machine. Machining is accomplished by first feeding the body 20 into a chucking machine, such as an ACME-Gridley automatic chucking machine. Those skilled in the art will appreciate that other machines and other manufacturers of automatic chucking machines can be used.

To machine the cavity 30, the end containing the opening 31 is faced so that it is substantially flat. The cavity 30 is bored. Alternatively, the cavity 30 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the cavity 30 is ground using an internal diameter grinding machine, such as a Heald grinding machine. Those skilled in the art will appreciate that the cavity 30 can be ground using other grinding machines.

Figure 4:
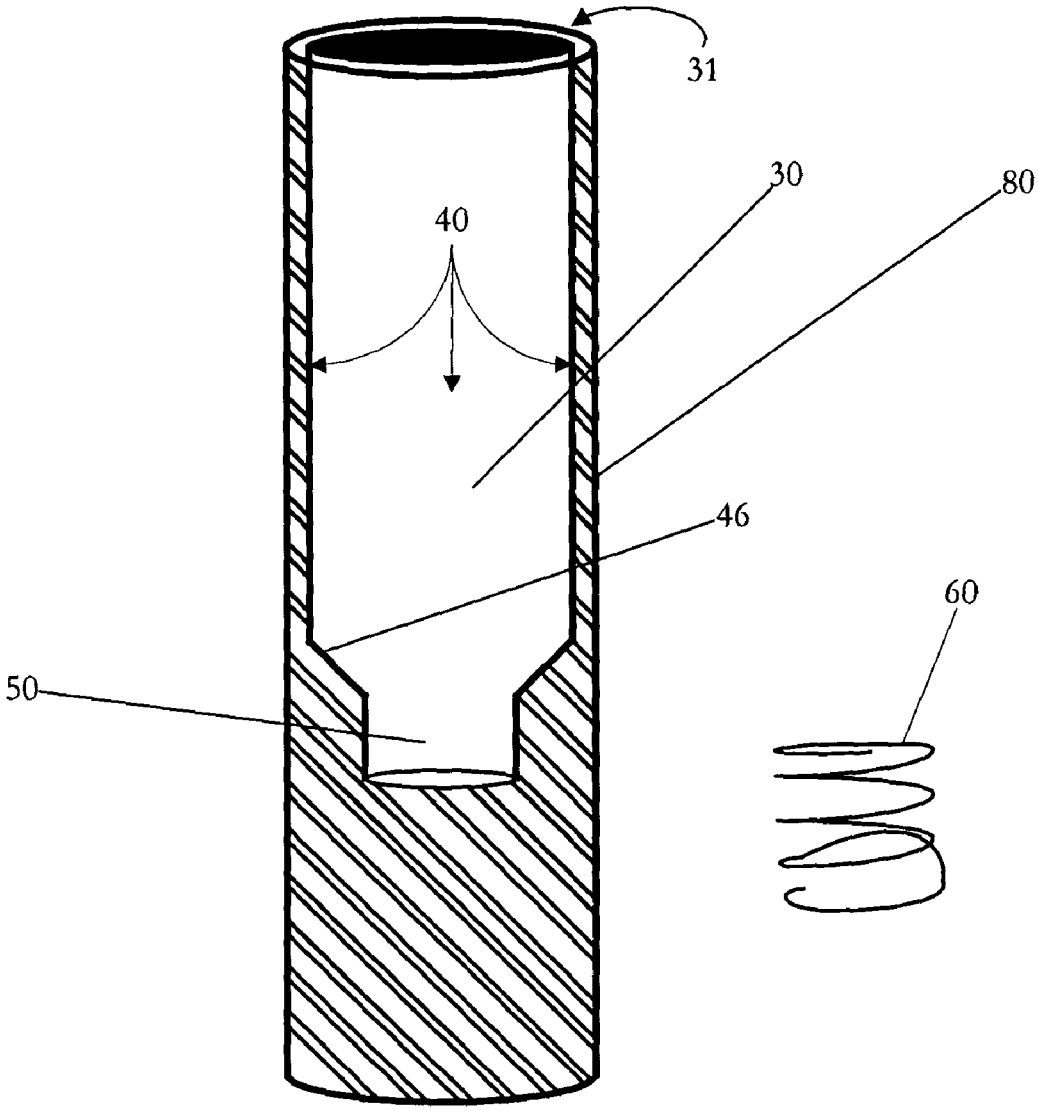
FIG. 4 depicts the top view of another preferred embodiment of an adjusting body.

FIG. 4 depicts the inner surface 40 provided with a well 50. The well 50 is shaped to accommodate a spring 60. In the embodiment depicted in FIG. 4, the well 50 is cylindrically shaped at a diameter that is smaller than the diameter of the inner surface 40. The cylindrical shape of the well 50 is preferably concentric relative to the outer surface 80. The well 50 is preferably forged through use of an extruding die pin.

Alternatively, the well 50 is machined by boring the well 50 in a chucking machine. Alternatively, the well 50 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the well 50 is ground using an internal diameter grinding machine, such as a Heald grinding machine. Those skilled in the art will appreciate that the well 50 can be ground using other grinding machines.

Adjacent to the well 50, the embodiment depicted in FIG. 4 is provided with a conically-shaped lead surface 46 which can be fabricated through forging or machining. However, those skilled in the art will appreciate that the present invention can be fabricated without the lead surface 46.

Figure 5:
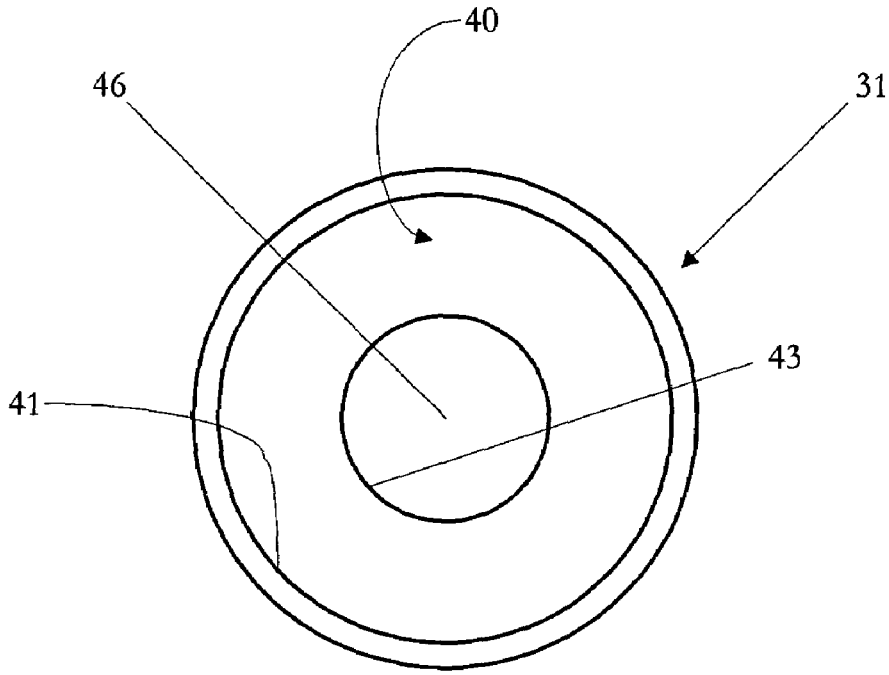
FIG. 5 depicts a second embodiment of an adjusting body.

FIG. 5 depicts a view of the opening 31 that reveals the inner surface 40 of an embodiment of the present invention. The inner surface 40 is provided with a first cylindrical surface 41. The well 50 is defined by a second cylindrical surface 43. As shown in FIG. 5, the second cylindrical surface 43 is concentric relative to the first cylindrical surface 41.

Figure 6:
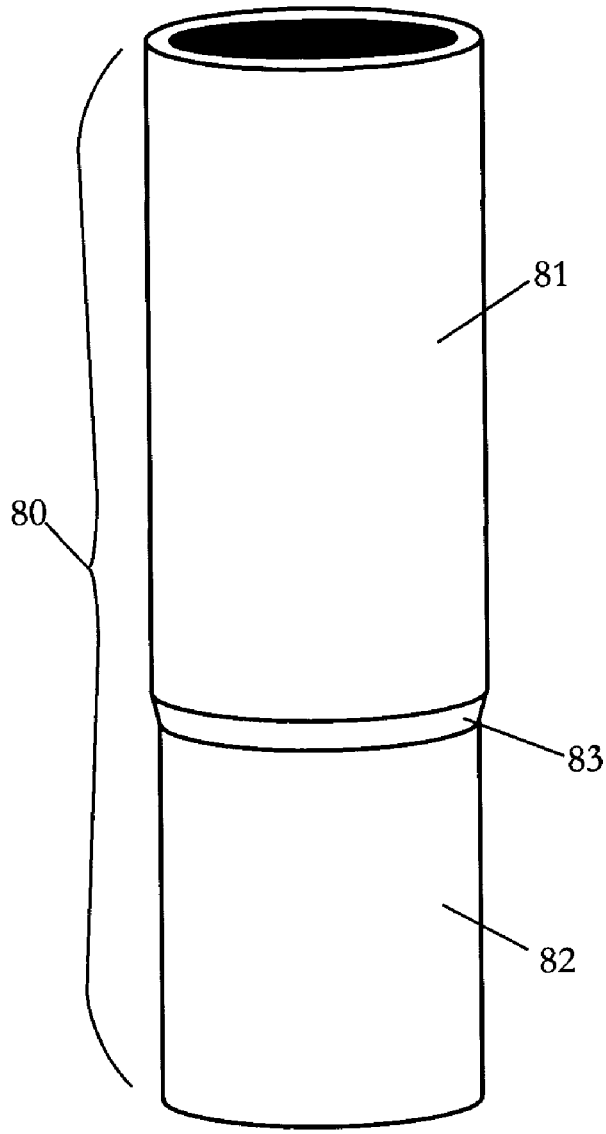
FIG. 6 depicts the top view of another preferred embodiment of an adjusting body.

Depicted in FIG. 6 is another alternative embodiment. As shown in FIG. 6, the body 20 is provided with an outer surface 80. The outer surface 80 includes a plurality of surfaces. In the embodiment depicted in FIG. 6, the outer surface 80 includes a cylindrical surface 81, an undercut surface 82, and a conical surface 83. As depicted in FIG. 6, the undercut surface 82 extends from one end of the body 20 and is cylindrically shaped. The diameter of the undercut surface 82 is smaller than the diameter of the cylindrical surface 81.

The undercut surface 82 is preferably forged through use of an extruding die. Alternatively, the undercut surface 82 is fabricated through machining. Machining the undercut surface 82 is accomplished through use of an infeed centerless grinding machine, such as a Cincinnati grinder. The surface is first heat-treated and then the undercut surface 82 is ground via a grinding wheel. Those skilled in the art will appreciate that additional surfaces can be ground into the outer surface with minor alterations to the grinding wheel.

As depicted in FIG. 6, the conical surface 83 is located between the cylindrical surface and the undercut surface. The conical surface 83 is preferably forged through use of an extruding die. Alternatively, the conical surface 83 is fabricated through machining. Those with skill in the art will appreciate that the outer surface 80 can be fabricated without the conical surface 83 so that the cylindrical surface 81 and the undercut surface 82 abut one another.

Those skilled in the art will appreciate that the features of the present invention may be fabricated through a combination of machining, forging, and other methods of fabrication. Aspects of the cavity 30 can be machined, other aspects of the cavity can be forged.

Turning now to FIG. 7, the lash adjuster body 10 is shown located within another body. As depicted therein, the lash adjuster body 10 is preferably located within a valve lifter body 110. Advantageously, the lash adjuster body 10 telescopes within the valve lifter body 110.

Figure 8:
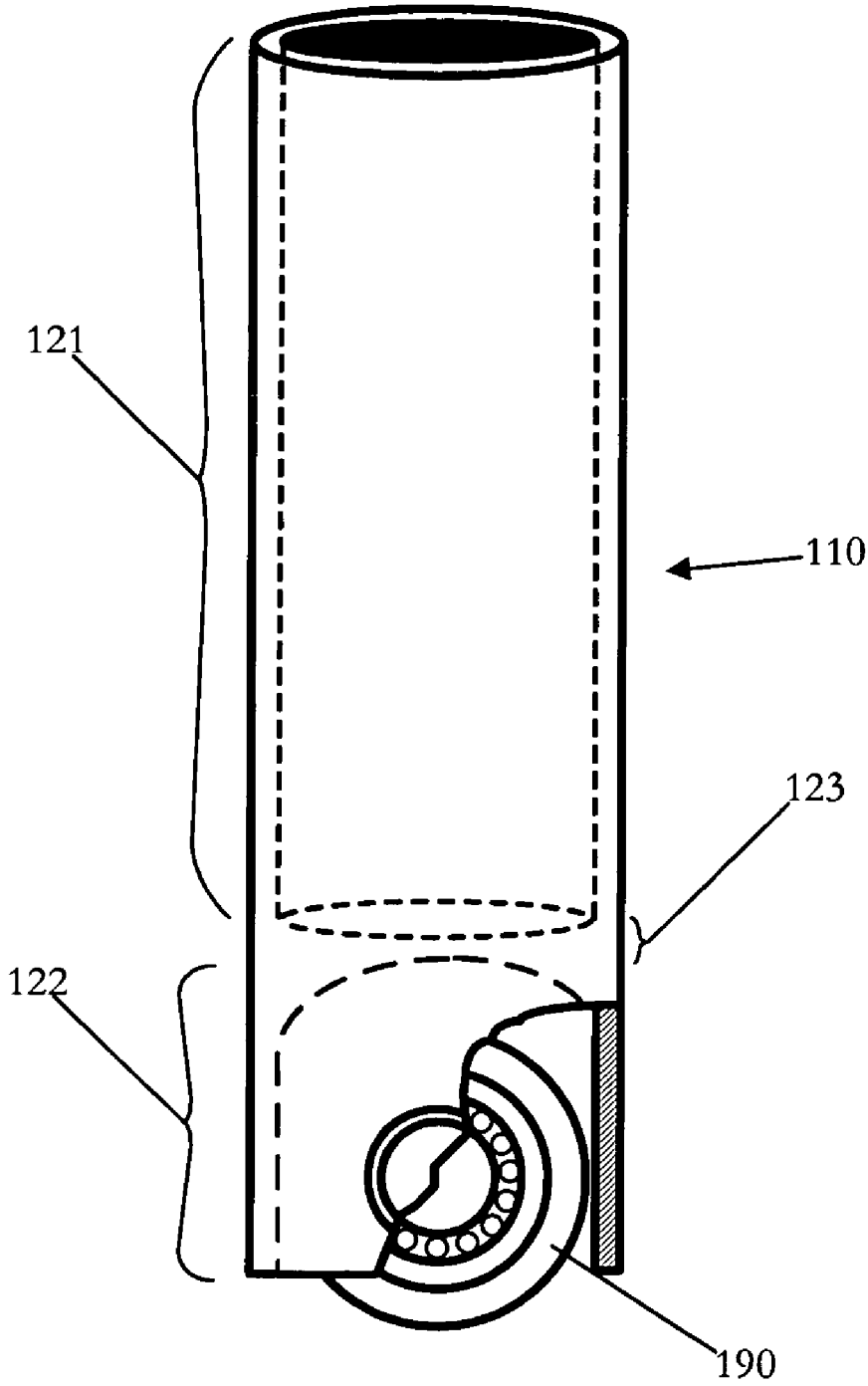
FIG. 8 depicts a preferred embodiment of a valve lifter body.
Figure 9:
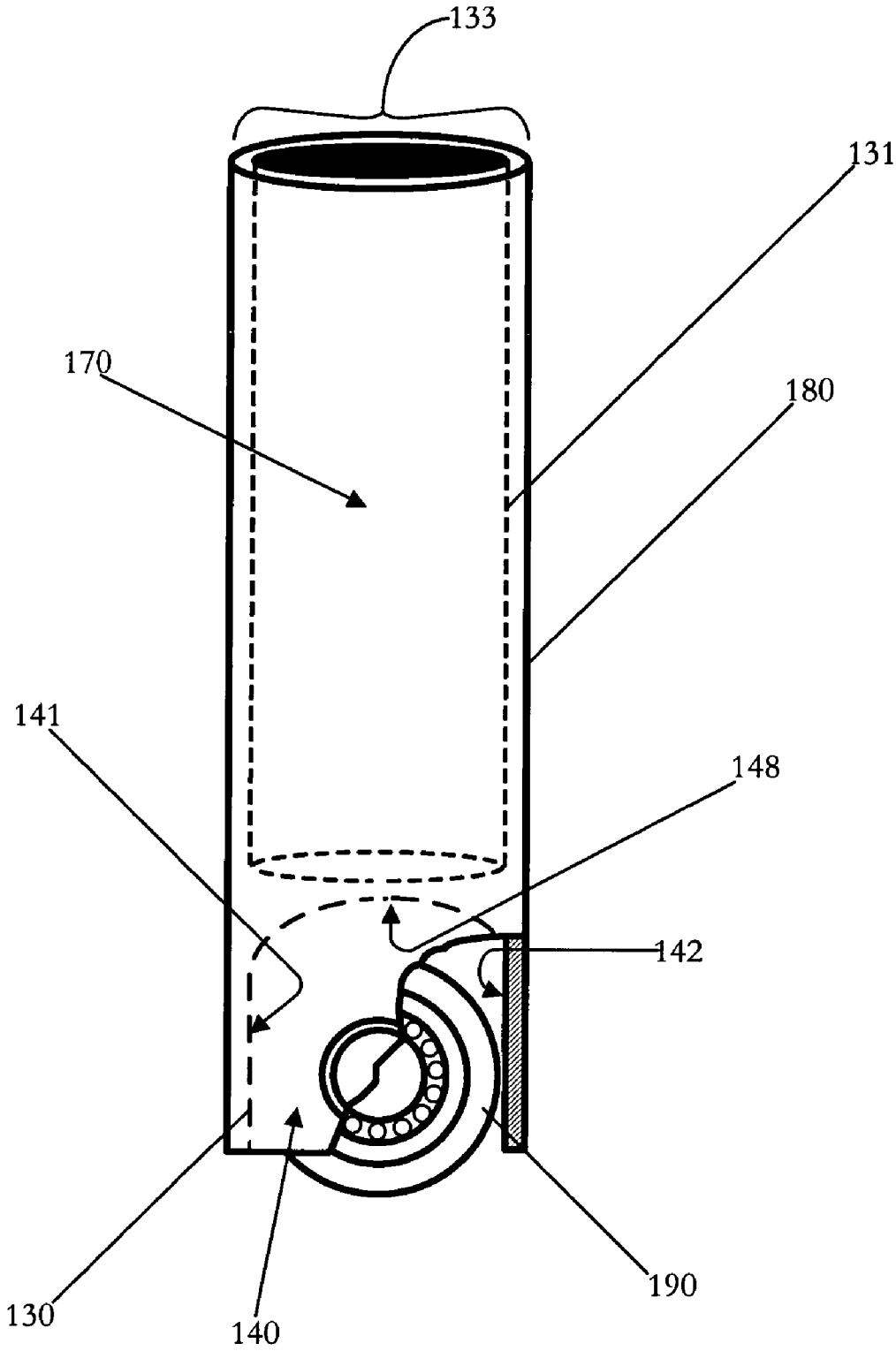
FIG. 9 depicts a preferred embodiment of a valve lifter body.
Figure 10:
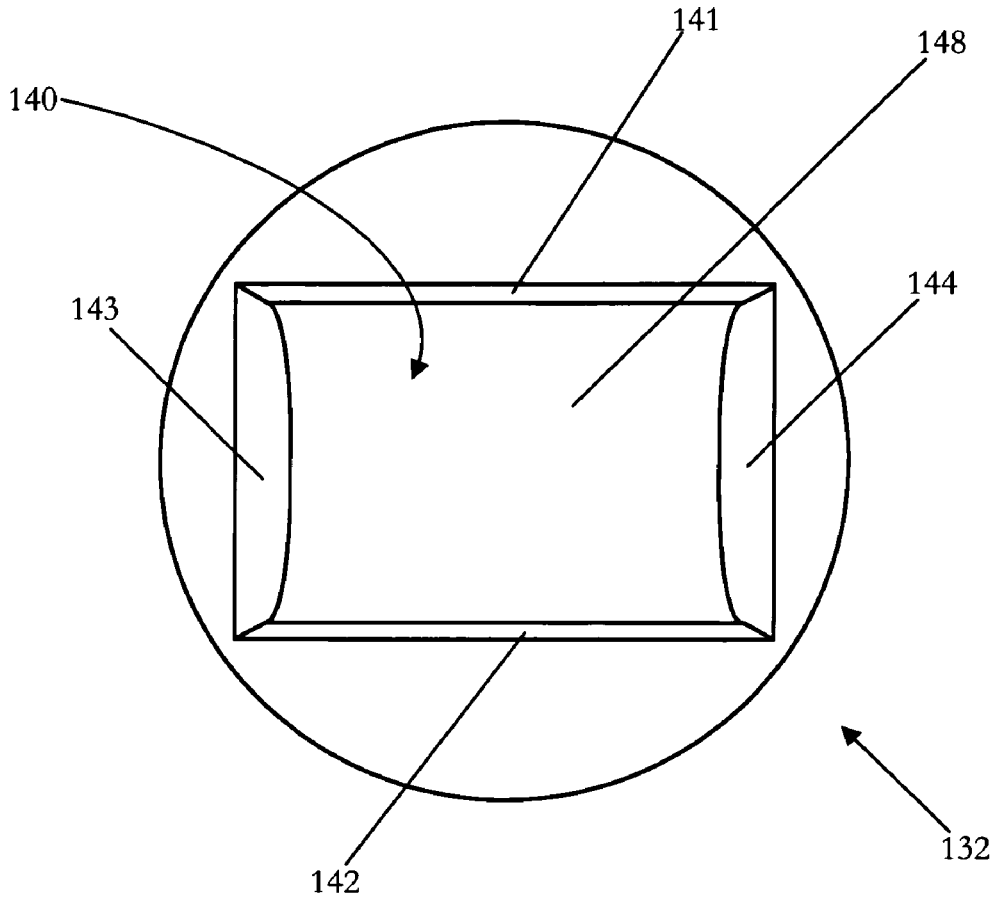
FIG. 10 depicts the top view of a preferred embodiment of a valve lifter body.

FIGS. 8, 9, and 10 show the valve lifter body 110 of the preferred embodiment. The valve lifter body 110 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the valve lifter body 110 is composed of pearlitic material. According to still another aspect of the present invention, the valve lifter body 110 is composed of austenitic material. According to another aspect of the present invention, the metal is a ferritic material.

The valve lifter body 110 is composed of a plurality of lifter elements. According to one aspect of the present invention, the lifter element is cylindrical in shape. According to another aspect of the present invention, the lifter element is conical in shape. According to yet another aspect of the present invention, the lifter element is solid. According to still another aspect of the present invention, the lifter element is hollow.

FIG. 8 depicts a cross-sectional view of the valve lifter body 110 of the preferred embodiment of the present invention composed of a plurality of lifter elements. FIG. 8 shows the valve lifter body, generally designated 110, with a roller 190. The valve lifter body 110 of the preferred embodiment is fabricated from a single piece of metal wire or rod and is described herein as a plurality of lifter elements. The valve lifter body 110 includes a first hollow lifter element 121, a second hollow lifter element 122, and a solid lifter element 123. In the preferred embodiment, the solid lifter element 123 is located between the first hollow lifter element 121 and the second hollow lifter element 122.

The valve lifter body 110 functions to accommodate a plurality of inserts. According to one aspect of the present invention, the valve lifter body 110 accommodates a lash adjuster body, such as the adjusting body 10. According to another aspect of the present invention, the valve lifter body 110 accommodates a leakdown plunger, such as the leakdown plunger 210. According to another aspect of the present invention, the valve lifter body 110 accommodates a push rod seat (not shown). According to yet another aspect of the present invention, the valve lifter body 110 accommodates a socket, such as the metering socket 10.

The valve lifter body 110 is provided with a plurality of outer surfaces and inner surfaces. FIG. 9 depicts a cross-sectional view of the valve lifter body 110 of the preferred embodiment of the present invention. As shown in FIG. 9, the valve lifter body 110 is provided with an outer lifter surface 180 which is cylindrically shaped. The outer lifter surface 180 encloses a plurality of cavities. As depicted in FIG. 9, the outer lifter surface 180 encloses a first lifter cavity 130 and a second lifter cavity 131. The first lifter cavity 130 includes a first inner lifter surface 140. The second lifter cavity 131 includes a second inner lifter surface 170.

FIG. 10 depicts a top view and provides greater detail of the first lifter cavity 130 of the preferred embodiment. As shown in FIG. 10, the first lifter cavity 130 is provided with a first lifter opening 132 shaped to accept a cylindrical insert. The first inner lifter surface 140 is configured to house a cylindrical insert 190, which, in the preferred embodiment of the present invention, functions as a roller. Those skilled in the art will appreciate that housing a cylindrical insert can be accomplished through a plurality of different configurations. The first inner lifter surface 140 of the preferred embodiment includes a plurality of flat surfaces and a plurality of walls. As depicted in FIG. 10, the inner lifter surface 140 includes two opposing lifter walls referred to herein as a fourth wall 143 and a third wall 144. A first wall 141 is adjacent to a curved lifter surface 148. The curved lifter surface 148 is adjacent to a second wall 142. The two lifter walls 143, 144 are located on opposing sides of the curved lifter surface 148.

Figure 19:
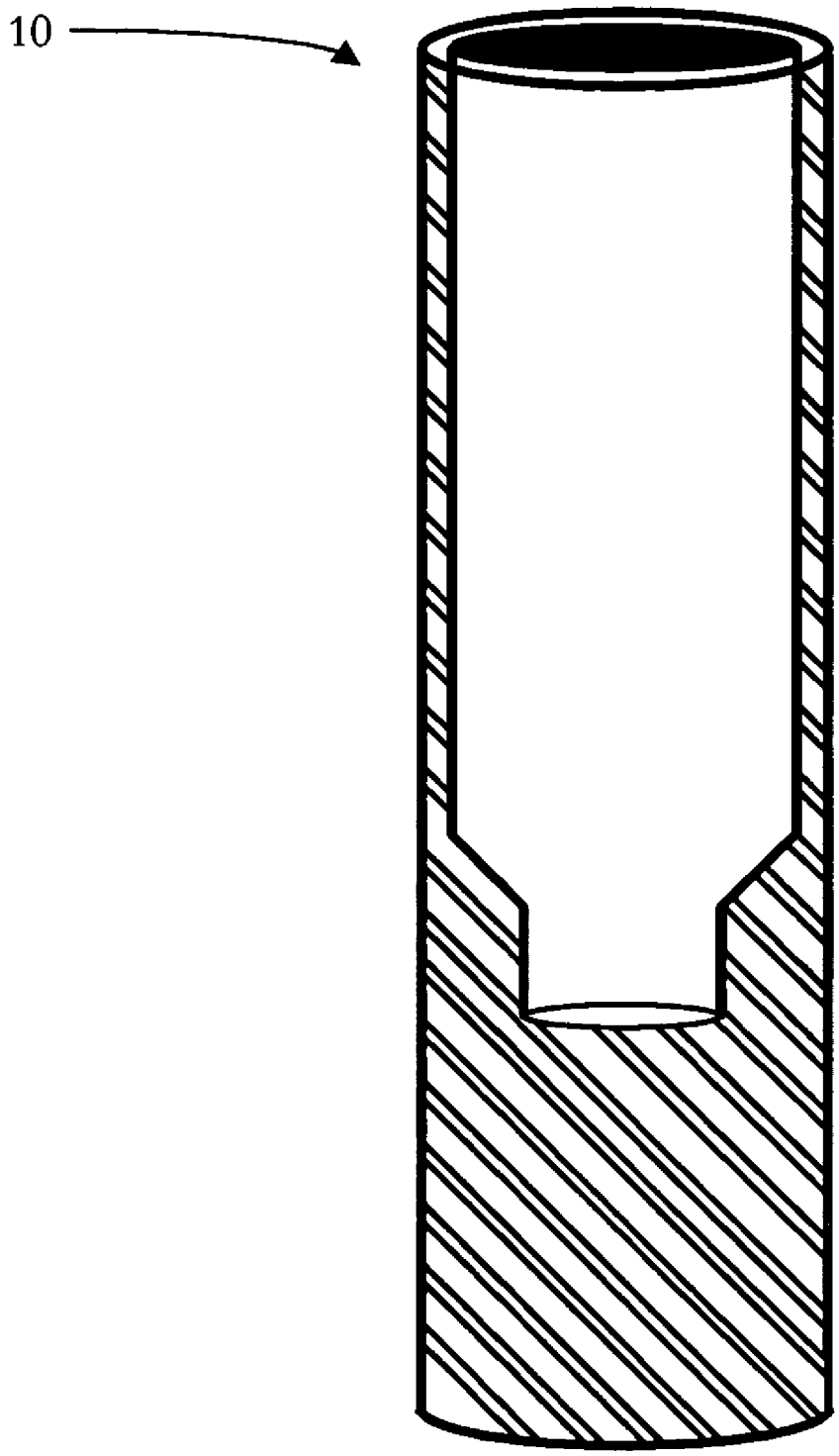
FIG. 19 depicts an adjusting body.

Referring to FIG. 9, the valve lifter body 110 of the present invention is provided with a second lifter cavity 131 which includes a second lifter opening 133 which is in a circular shape. The second lifter cavity 131 is provided with a second inner lifter surface 170. The second inner lifter surface 170 of the preferred embodiment is cylindrically shaped. Alternatively, the second inner lifter surface 170 is configured to house an adjusting body, generally designated 10 on FIG. 19. However, those skilled in the art will appreciate that the second inner lifter surface 170 can be conically or frustoconically shaped without departing from the spirit of the present invention.

The present invention is fabricated through a plurality of processes. According to one aspect of the present invention, the valve lifter body 110 is machined. According to another aspect of the present invention, the valve lifter body 110 is forged. According to yet another aspect of the present invention, the valve lifter body 110 is fabricated through casting. The valve lifter body 110 of the preferred embodiment of the present invention is forged. As used herein, the term "forge," "forging," or "forged" is intended to encompass what is known in the art as "cold forming," "cold heading," "deep drawing," and "hot forging."

The valve lifter body 110 is preferably forged with use of a National® 750 parts former machine. Those skilled in the art will appreciate that other part formers, such as, for example, a Waterbury machine can be used. Those skilled in the art will further appreciate that other forging methods can be used as well.

The process of forging the valve lifter body 110 preferably begins with a metal wire or metal rod which is drawn to size. The ends of the wire or rod are squared off by a punch. After being drawn to size, the wire or rod is run through a series of dies or extrusions. The second lifter cavity 131 is extruded through use of a punch and an extruding pin. After the second lifter cavity 131 has been extruded, the first lifter cavity 130 is forged. The first lifter cavity 130 is extruded through use of an extruding punch and a forming pin.

Alternatively, the valve lifter body 110 is fabricated through machining. As used herein, machining means the use of a chucking machine, a drilling machine, a grinding machine, or a broaching machine. Machining is accomplished by first feeding the valve lifter body 110 into a chucking machine, such as an ACME-Gridley automatic chucking machine. Those skilled in the art will appreciate that other machines and other manufacturers of automatic chucking machines can be used.

To machine the second lifter cavity 131, the end containing the second lifter opening 133 is faced so that it is substantially flat. The second lifter cavity 131 is bored. Alternatively, the second lifter cavity 131 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second lifter cavity 131 is ground using an internal diameter grinding machine, such as a Heald grinding machine. Those skilled in the art will appreciate that the second lifter cavity 131 can be ground using other grinding machines.

Those skilled in the art will appreciate that the other features of the present invention may be fabricated through machining. For example, the first lifter cavity 130 can be machined. To machine the first lifter cavity 130, the end containing the first lifter opening 132 is faced so that it is substantially flat. The first lifter cavity 130 is drilled and then the first lifter opening 132 is broached using a broaching machine.

Figure 11:
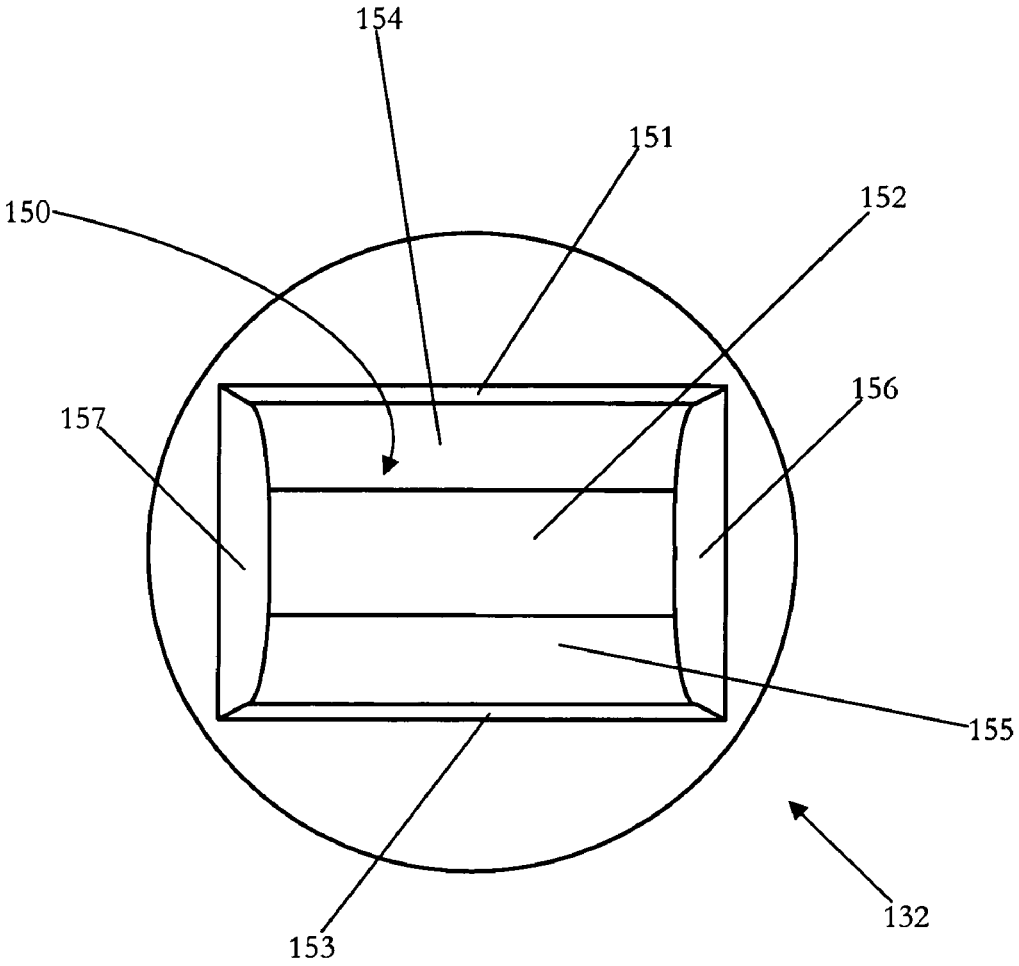
FIG. 11 depicts the top view of another preferred embodiment of a valve lifter body.

In an alternative embodiment of the present invention depicted in FIG. 11, the first lifter cavity 130 is provided with a first lifter opening 132 shaped to accept a cylindrical insert and a first inner lifter surface 150. The first inner lifter surface 150 includes a flat surface, a plurality of curved surfaces, and a plurality of walls, referred to herein as a first wall 151, a second wall 153, a third wall 156, and a fourth wall 157. As depicted in FIG. 11, the first wall 151 is adjacent to a first curved lifter surface 154. The first curved lifter surface 154 is adjacent to a lifter surface 152. The lifter surface 152 is adjacent to a second curved lifter surface 155. The second curved lifter surface 155 is adjacent to the second wall 153.

Figure 12:
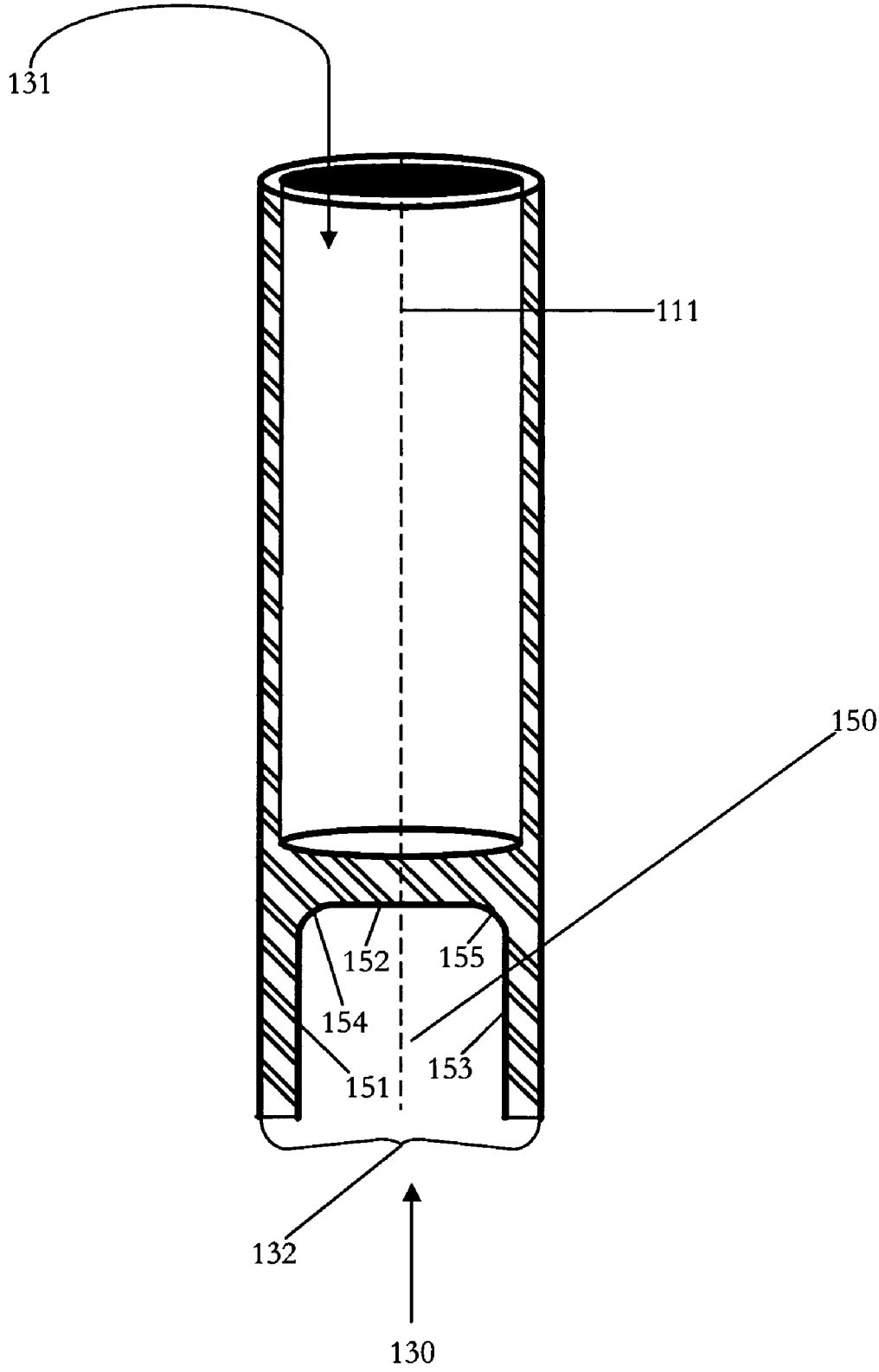
FIG. 12 depicts a second embodiment of a valve lifter body.

As depicted in FIG. 11, the third wall 156 and the fourth wall 157 are located on opposing sides of the second wall 153. FIG. 12 depicts a cross-sectional view of the valve lifter body 110 with the first lifter cavity 130 shown in FIG. 11. As shown in FIG. 12, the lifter surface 152 is, relative to the first and second curved lifter surfaces 154, 155, preferably generally flat in shape and oriented to be orthogonal to the valve lifter axis 111 of the valve lifter body 110.

Figure 13:
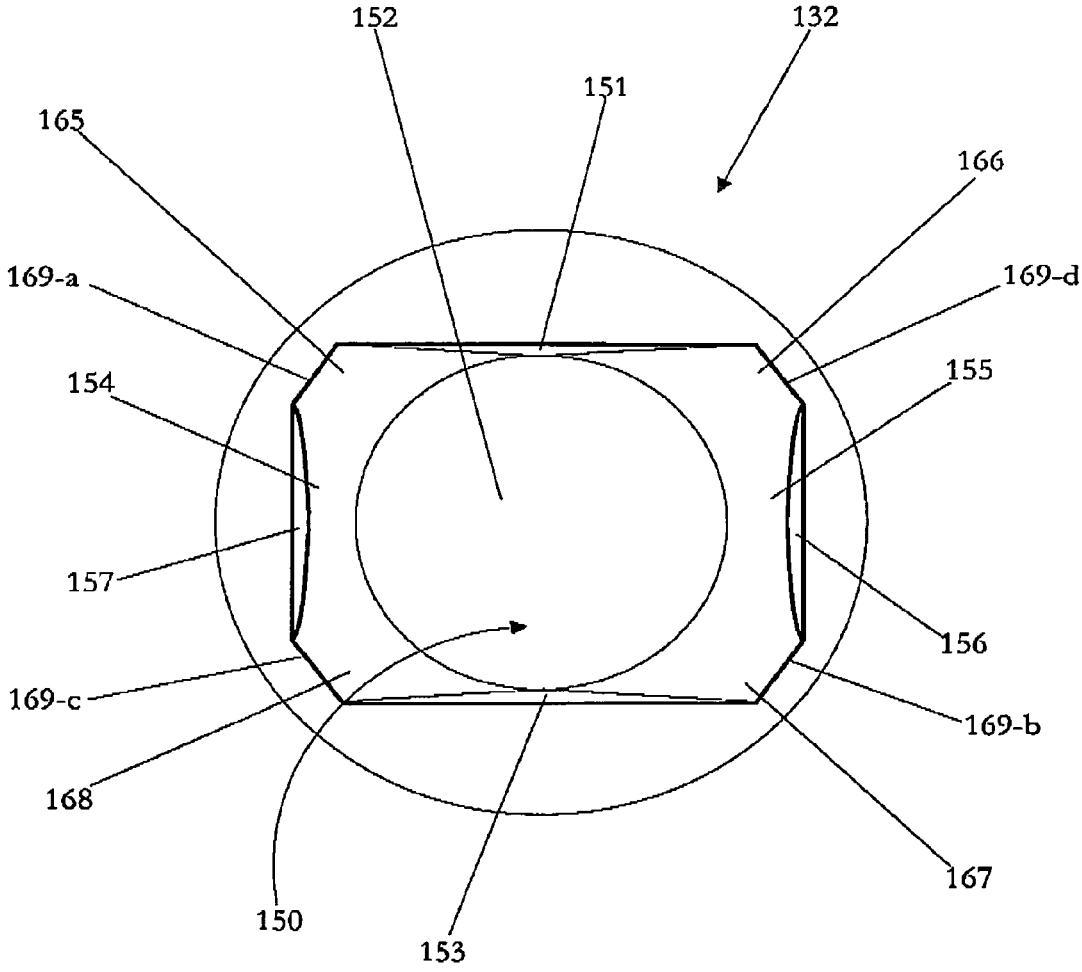
FIG. 13 depicts the top view of another preferred embodiment of a valve lifter body.
Figure 14:
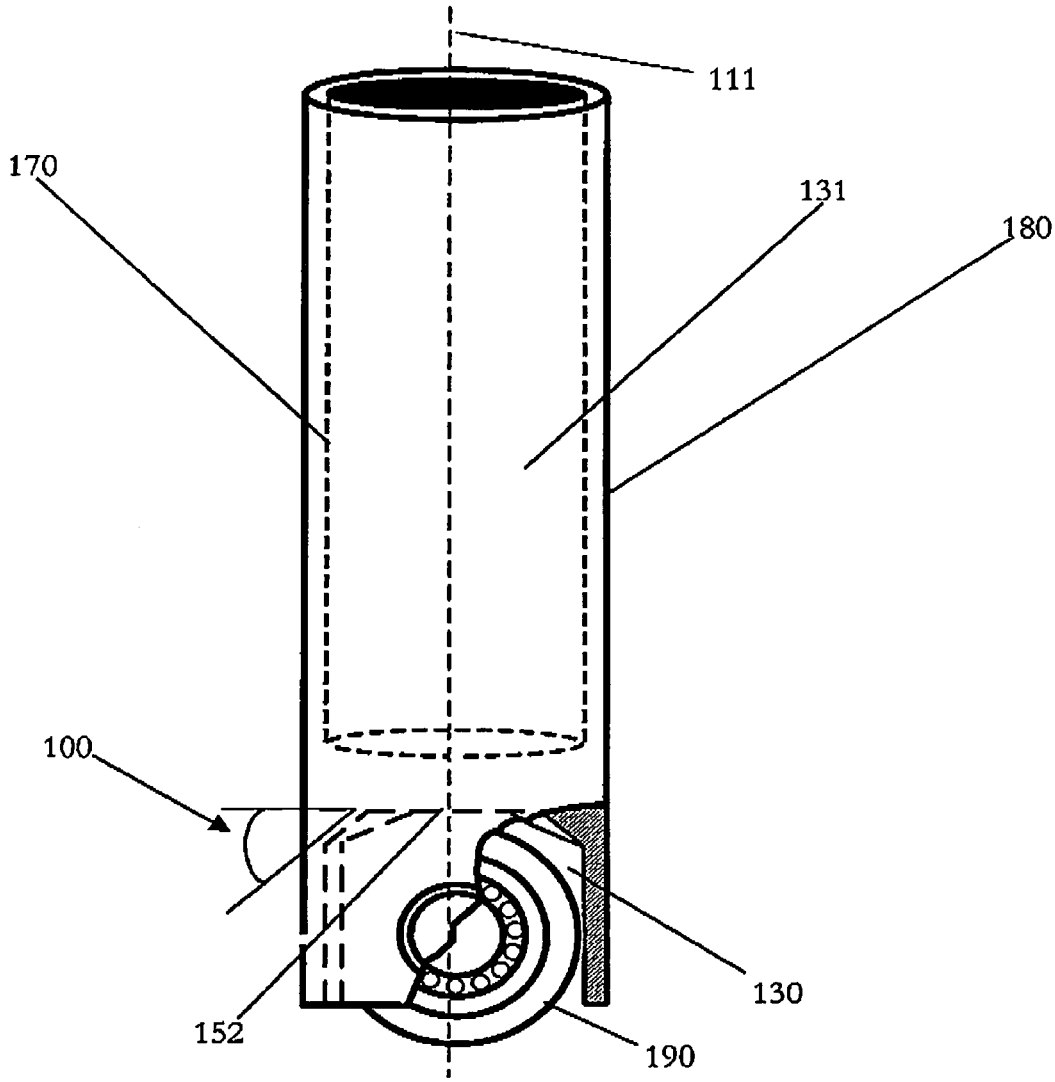
FIG. 14 depicts a third embodiment of a valve lifter body.

In another alternative embodiment of the present invention, as depicted in FIG. 13 and 49, the first lifter cavity 130 is provided with a first lifter opening 132 shaped to accept a cylindrical insert and a first inner lifter surface 150. The first inner lifter surface 150 includes a plurality of walls referred to herein as a first wall 151, a second wall 153, a third wall 156, and a fourth wall 157. The first inner lifter surface 150 also includes a plurality of angled walls referred to herein as a first angled wall 169*a*, a second angled wall 169*b*, a third angled wall 169*c*, and a fourth angled wall 169*d*. Referring to FIG. 13, the first wall 151 is adjacent to a lifter surface 152 that is circular in shape and oriented to be orthogonal to the valve lifter axis 111 of the valve lifter body 110. In FIG. 13, the first wall 151 is adjacent to a first angled lifter surface 165, and a second angled lifter surface 166. The first angled wall 169*a* is shown extending axially into the valve lifter body 110 from the first lifter opening 132 and terminating at the first angled lifter surface 165. The first angled lifter surface 165 is adjacent to a lifter surface 152 and a first curved lifter surface 154. As depicted in FIG. 14 the first angled lifter surface 165 is configured to be at an angle 100 relative to a plane that is orthogonal to the valve lifter axis 111 of the valve lifter body 110 (such as the plane of the annular surface 44 of the adjusting body 10). Advantageously, the angle 100 measures between twenty-five and about ninety degrees.

The second angled lifter surface 166 is adjacent to the lifter surface 152. The fourth angled wall 169*d* is shown extending axially into the valve lifter body 110 from the first lifter opening 132 and terminating at the second angled lifter surface 166. As shown in FIG. 14, the second angled lifter surface 166 is configured to be at an angle 100 relative to a plane that is orthogonal to the axis of the valve lifter body 110, preferably between twenty-five and about ninety degrees. The second angled lifter surface 166 is adjacent to a second curved lifter surface 155. The second curved lifter surface 155 is adjacent to a third angled lifter surface 167 and a third wall 156. The third angled lifter surface 167 is adjacent to the lifter surface 152 and a second wall 153. The second angled wall 169*b* is shown extending axially into the valve lifter body 110 from the first lifter opening 132 and terminating at the third angled lifter surface 167. As depicted in FIG. 14, the third angled lifter surface 167 is configured to be at an angle 100 relative to a plane that is orthogonal to the valve lifter axis 111 of the valve lifter body 110 (such as the plane of the annular surface 44 of the adjusting body 10). Advantageously, the angle 100 measures between twenty-five and about ninety degrees.

The second wall 153 is adjacent to a fourth angled lifter surface 168. The fourth angled lifter surface 168 is adjacent to the first curved lifter surface 154 and a fourth wall 157. The third angled wall 169*c* is shown extending axially into the valve lifter body 110 from the first lifter opening 132 and terminating at the fourth angled lifter surface 168. As depicted in FIG. 14, the fourth angled lifter surface 168 is configured to be at an angle 100 relative to a plane that is orthogonal to the valve lifter axis 111 of the valve lifter body 110 (such as the plane of the annular surface 44 of the adjusting body 10). Advantageously, the angle 100 measures between twenty-five and about ninety degrees. FIG. 14 depicts a cross-sectional view of an embodiment with the first lifter cavity 130 of FIG. 13.

Figure 15:
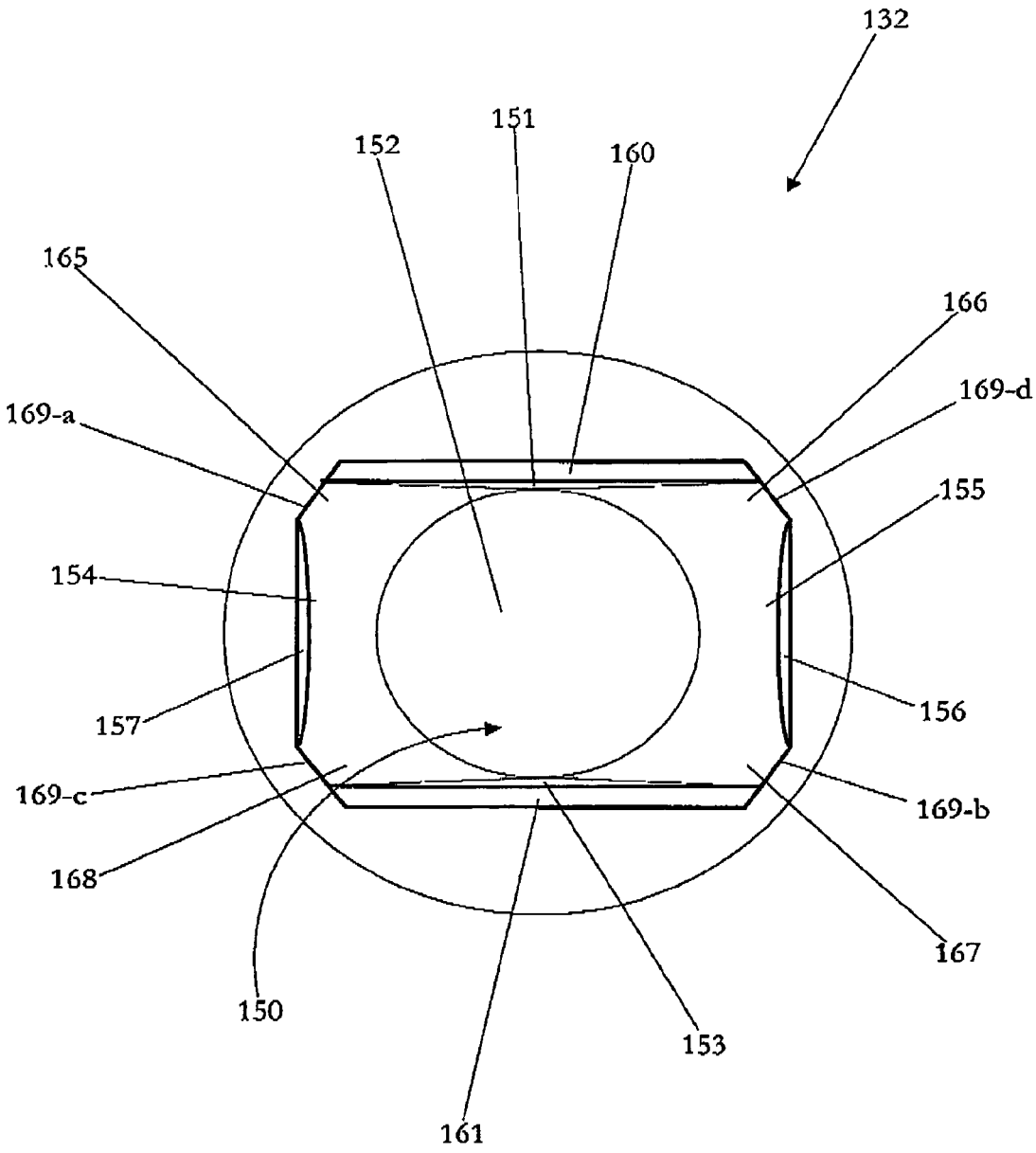
FIG. 15 depicts the top view of another preferred embodiment of a valve lifter body.

Shown in FIG. 15 is an alternative embodiment of the first lifter cavity 130 depicted in FIG. 13. In the embodiment depicted in FIG. 15, the first lifter cavity 130 is provided with a chamfered lifter opening 132 and a first inner lifter surface 150. The chamfered lifter opening 132 functions so that a cylindrical insert can be introduced to the valve lifter body 110 with greater ease. The chamfered lifter opening 132 accomplishes this function through lifter chamfers 160, 161 of the embodiment shown in FIG. 15 are flat surfaces at an angle relative to the first and second walls 151, 153 so that a cylindrical insert 190 can be introduced through the first lifter opening 132 with greater ease. Those skilled in the art will appreciate that the lifter chamfers 160, 161 can be fabricated in a number of different configurations; so long as the resulting configuration renders introduction of a cylindrical insert 190 through the first lifter opening 132 with greater ease, it is a "chamfered lifter opening" within the spirit and scope of the present invention.

The lifter chamfers 160, 161 are preferably fabricated through forging via an extruding punch pin. Alternatively, the lifter chamfers 160, 161 are machined by being ground before heat-treating. Those skilled in the art will appreciate that other methods of fabrication can be employed within the scope of the present invention.

Figure 16:
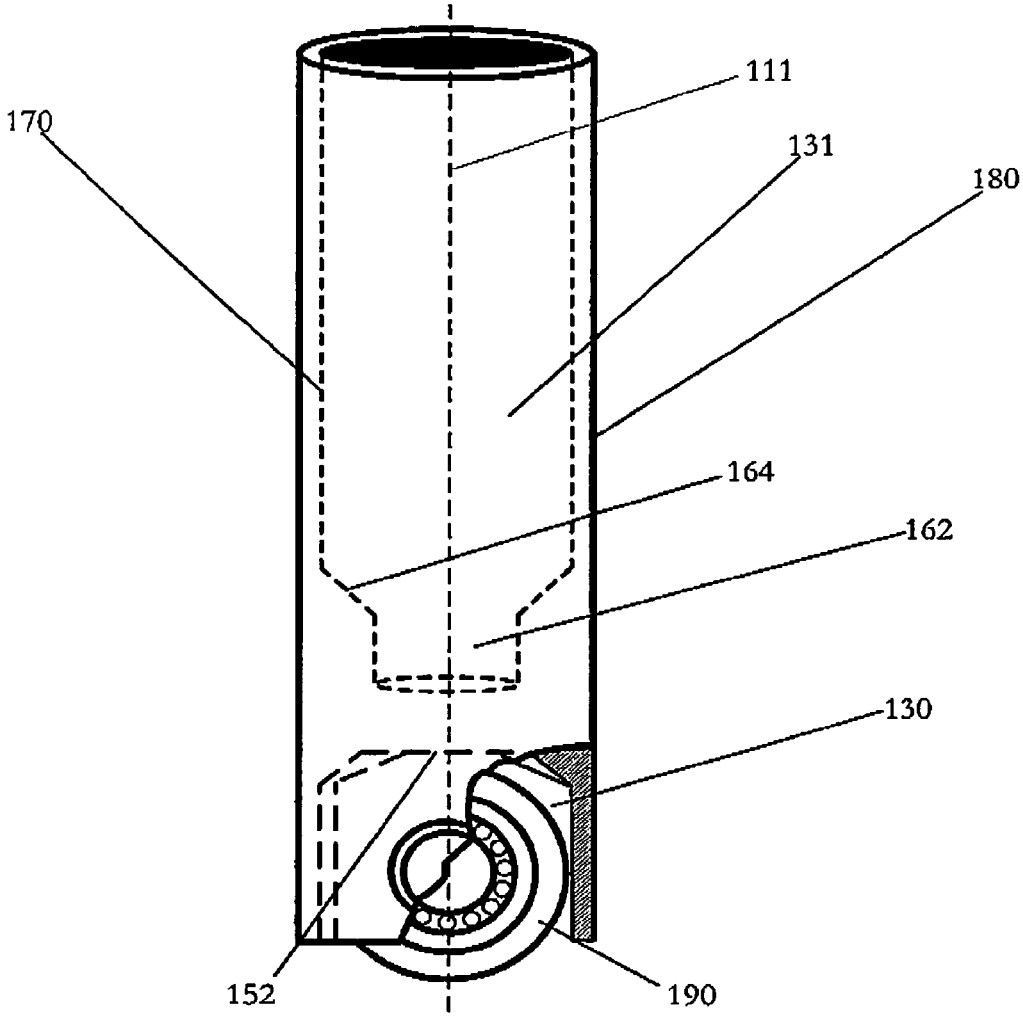
FIG. 16 depicts a fourth embodiment of a valve lifter body.

FIG. 16 discloses yet another alternative embodiment of the present invention. As depicted in FIG. 16, the valve lifter body 110 is provided with a second lifter cavity 131 which includes a plurality of cylindrical and conical surfaces. The second lifter cavity 131 depicted in FIG. 16 includes a second inner lifter surface 170. The second inner lifter surface 170 of the preferred embodiment is cylindrically shaped, concentric relative to the cylindrically shaped outer surface 180. The second inner lifter surface 170 is provided with a lifter well 162. The lifter well 162 is shaped to accommodate a spring (not shown). In the embodiment depicted in FIG. 16, the lifter well 162 is cylindrically shaped at a diameter that is smaller than the diameter of the second inner lifter surface 170. The cylindrical shape of the lifter well 162 is preferably concentric relative to the outer lifter surface 180. The lifter well 162 is preferably forged through use of an extruding die pin.

Alternatively, the lifter well 162 is machined by boring the lifter well 162 in a chucking machine. Alternatively, the lifter well 162 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the lifter well 162 is ground using an internal diameter grinding machine, such as a Heald grinding machine. Those skilled in the art will appreciate that the lifter well 162 can be ground using other grinding machines.

Adjacent to the lifter well 162, the embodiment depicted in FIG. 16 is provided with a conically-shaped lead lifter surface 164 which can be fabricated through forging or machining. However, those skilled in the art will appreciate that the present invention can be fabricated without the lead lifter surface 164.

Figure 17:
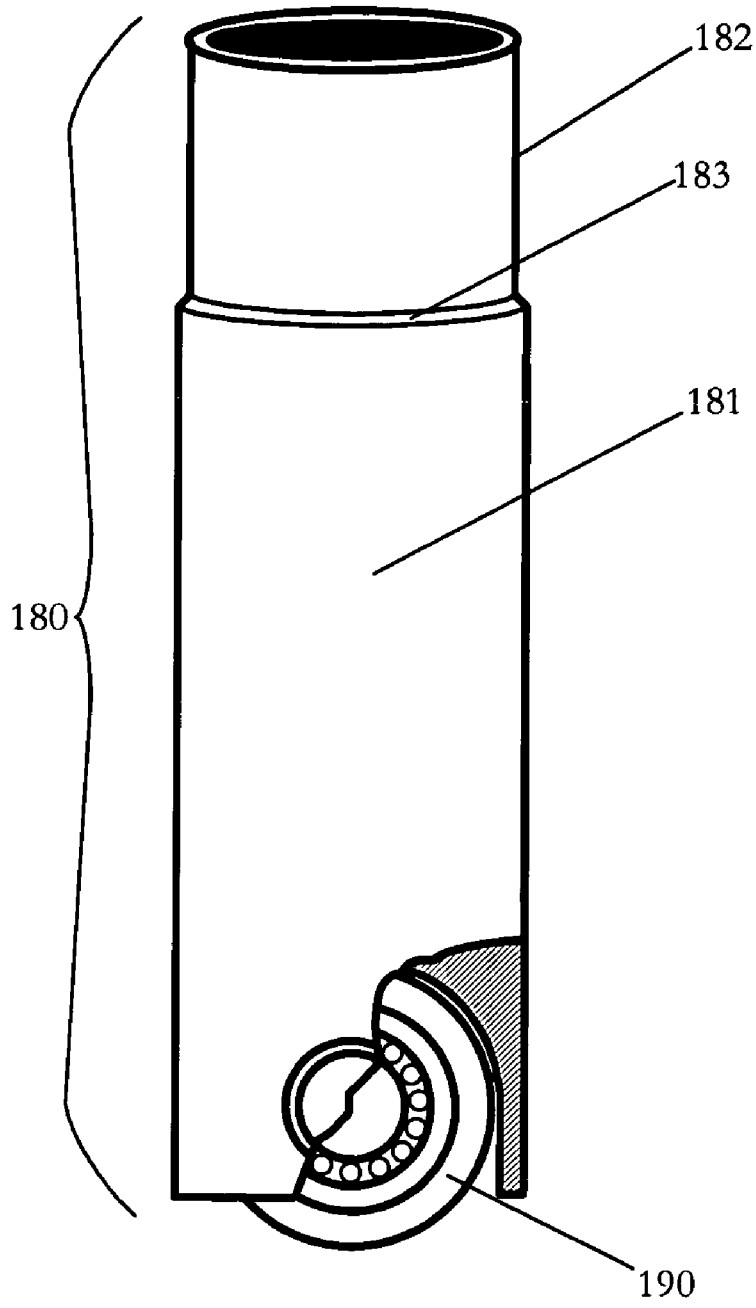
FIG. 17 depicts a fourth embodiment of a valve lifter body.

Depicted in FIG. 17 is another alternative embodiment of the present invention. As shown in FIG. 17, the valve lifter body 110 is provided with an outer lifter surface 180. The outer lifter surface 180 includes a plurality of surfaces. In the embodiment depicted in FIG. 17, the outer lifter surface 180 includes a cylindrical lifter surface 181, an undercut lifter surface 182, and a conical lifter surface 183. As depicted in FIG. 17, the undercut lifter surface 182 extends from one end of the valve lifter body 110 and is cylindrically shaped. The diameter of the undercut lifter surface 182 is smaller than the diameter of the cylindrical lifter surface 181.

The undercut lifter surface 182 is preferably forged through use of an extruding die. Alternatively, the undercut lifter surface 182 is fabricated through machining. Machining the undercut lifter surface 182 is accomplished through use of an infeed centerless grinding machine, such as a Cincinnati grinder. The surface is first heat-treated and then the undercut lifter surface 182 is ground via a grinding wheel. Those skilled in the art will appreciate that additional surfaces can be ground into the outer lifter surface 180 with minor alterations to the grinding wheel.

As depicted in FIG. 17, the conical lifter surface 183 is located between the cylindrical lifter surface 181 and the undercut lifter surface 182. The conical lifter surface 183 is preferably forged through use of an extruding die. Alternatively, the conical lifter surface 183 is fabricated through machining. Those with skill in the art will appreciate that the outer lifter surface 180 can be fabricated without the conical lifter surface 183 so that the cylindrical lifter surface 181 and the undercut lifter surface 182 abut one another.

Figure 18:
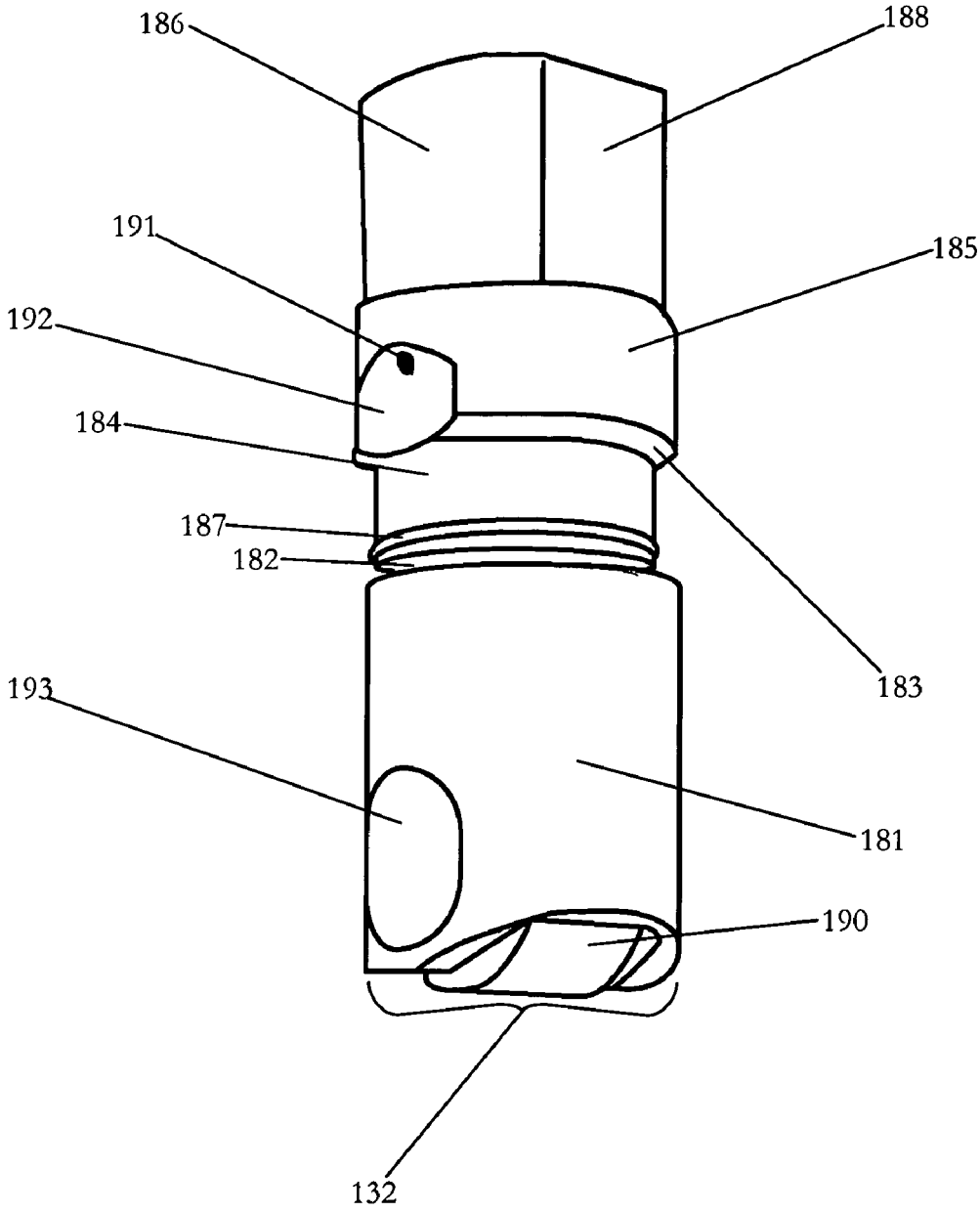
FIG. 18 depicts a fifth embodiment of a valve lifter body.

FIG. 18 depicts another embodiment valve lifter body 110 of the present invention. In the embodiment depicted in FIG. 18, the outer lifter surface 180 includes a plurality of outer surfaces. The outer lifter surface 180 is provided with a first cylindrical lifter surface 181. The first cylindrical lifter surface 181 contains a first lifter depression 193. Adjacent to the first cylindrical lifter surface 181 is a second cylindrical lifter surface 182. The second cylindrical lifter surface 182 has a radius which is smaller than the radius of the first cylindrical lifter surface 181. The second cylindrical lifter surface 182 is adjacent to a third cylindrical lifter surface 184. The third cylindrical lifter surface 184 has a radius which is greater than the radius of the second cylindrical lifter surface 182. The third cylindrical lifter surface 184 contains a lifter ridge 187. Adjacent to the third cylindrical lifter surface 184 is a conical lifter surface 183. The conical lifter surface 183 is adjacent to a fourth cylindrical lifter surface 185. The fourth cylindrical lifter surface 185 and the conical lifter surface 183 contain a second lifter depression 192. The second lifter depression 192 defines a lifter hole 191. Adjacent to the fourth cylindrical lifter surface 185 is a flat outer lifter surface 188. The flat outer lifter surface 188 is adjacent to a fifth cylindrical lifter surface 186.

Those skilled in the art will appreciate that the features of the valve lifter body 110 may be fabricated through a combination of machining, forging, and other methods of fabrication. By way of example and not limitation, the first lifter cavity 130 can be machined while the second lifter cavity 131 is forged. Conversely, the second lifter cavity 131 can be machined while the first lifter cavity 130 is forged.

Figure 20:
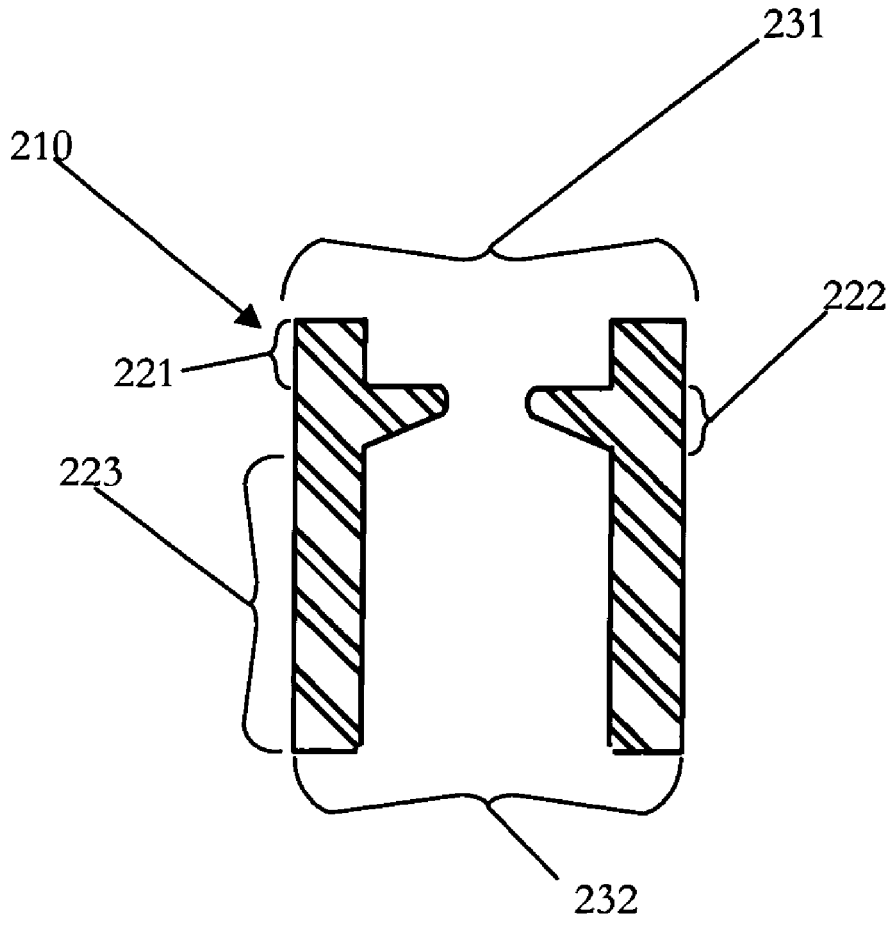
FIG. 20 depicts a preferred embodiment of a leakdown plunger.
Figure 21:
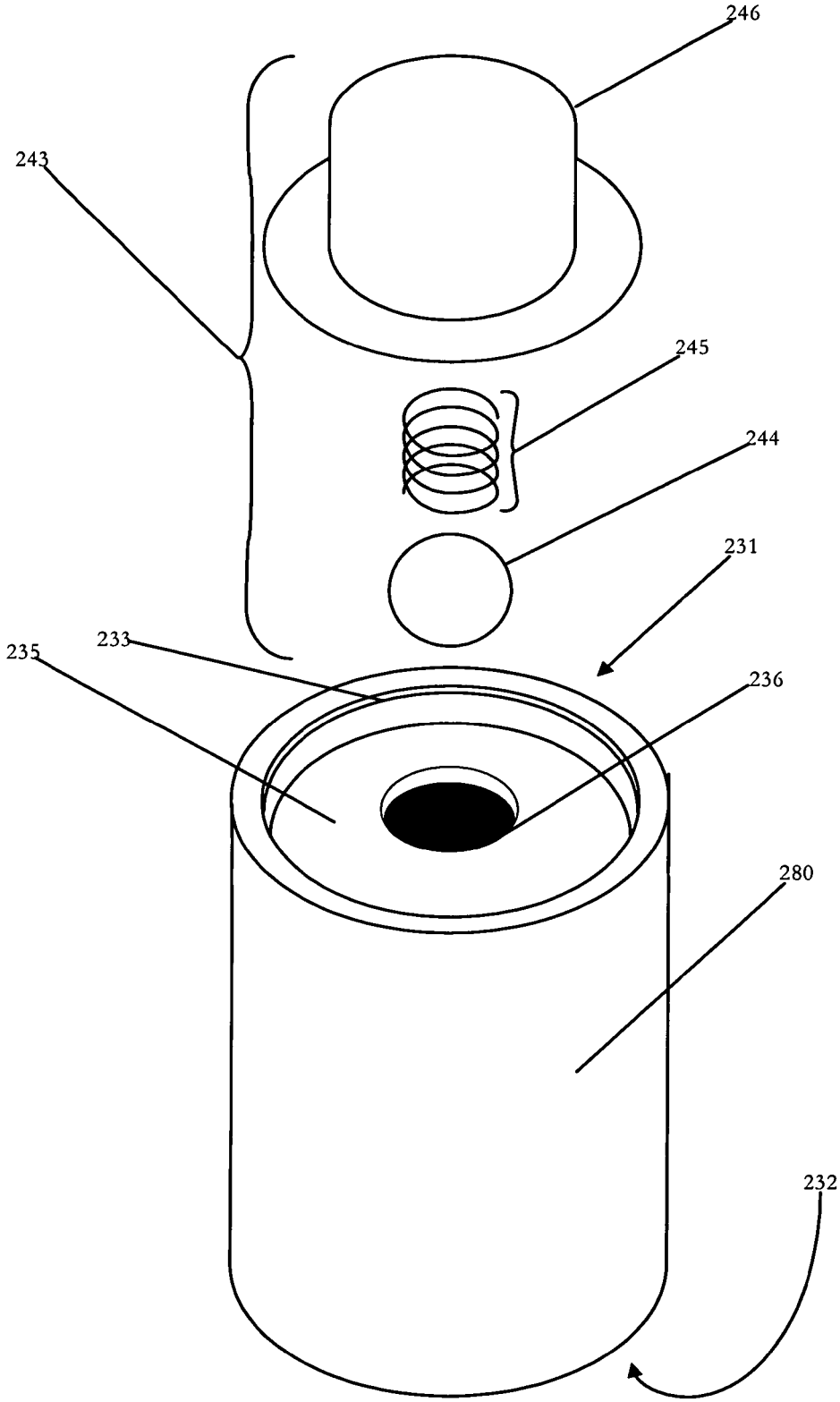
FIG. 21 depicts a preferred embodiment of a leakdown plunger.
Figure 22:
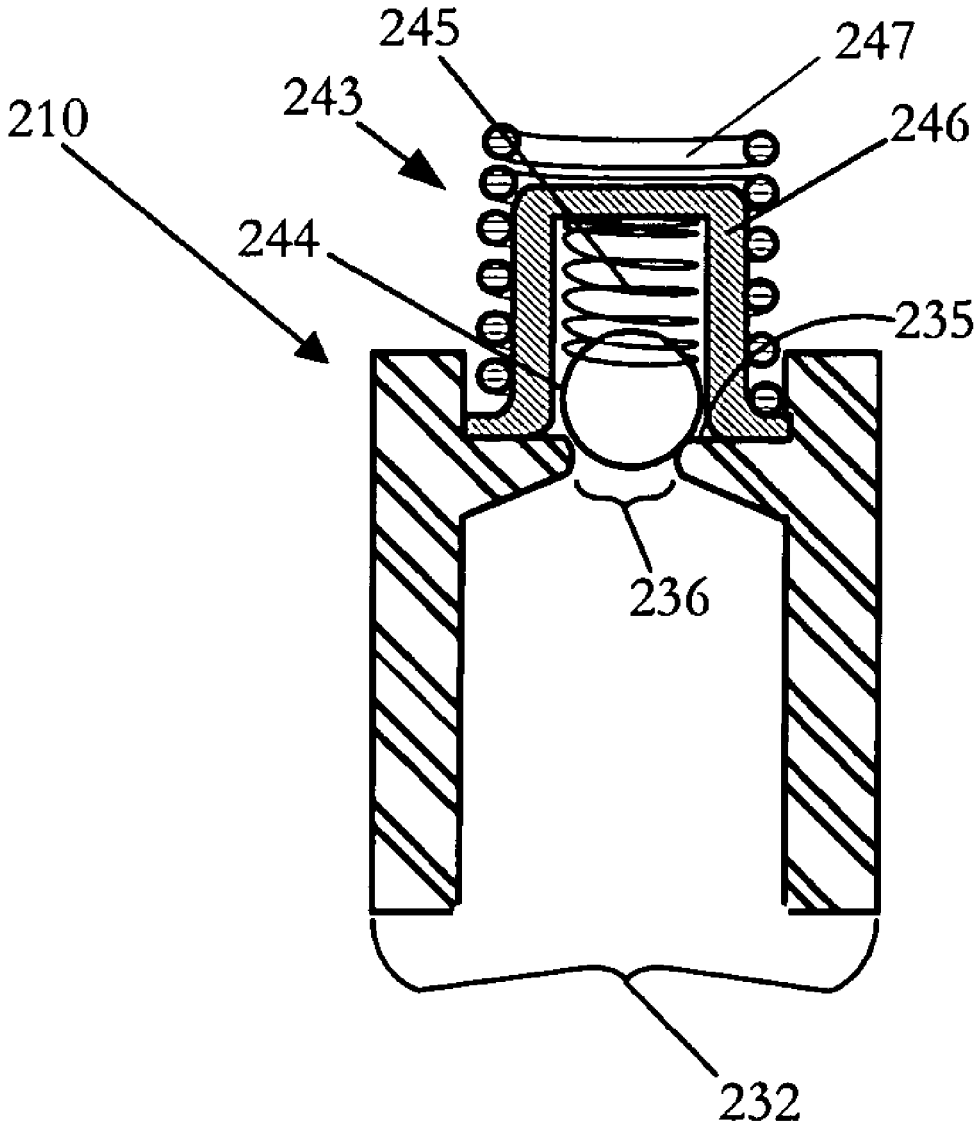
FIG. 22 depicts a cross-sectional view of a preferred embodiment of a leakdown plunger.

Turning now to FIG. 7, a plurality of inserts are shown within the adjusting body 10. As depicted therein, a leakdown plunger 210 is preferably located within the adjusting body 10. FIGS. 20, 21, 22 show a leakdown plunger 210 of the preferred embodiment. The leakdown plunger 210 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the leakdown plunger 210 is composed of pearlitic material. According to still another aspect of the present invention, the leakdown plunger 210 is composed of austenitic material. According to another aspect of the present invention, the metal is a ferritic material.

The leakdown plunger 210 is composed of a plurality of plunger elements. According to one aspect of the present invention, the plunger element is cylindrical in shape. According to another aspect of the present invention, the plunger element is conical in shape. According to yet another aspect of the present invention, the plunger element is hollow.

FIG. 20 depicts a cross-sectional view of the leakdown plunger 210 composed of a plurality of plunger elements. FIG. 20 shows the leakdown plunger, generally designated 210. The leakdown plunger 210 functions to accept a liquid, such as a lubricant and is provided with a first plunger opening 231 and a second plunger opening 232. The first plunger opening 231 functions to accommodate an insert.

The leakdown plunger 210 of the preferred embodiment is fabricated from a single piece of metal wire or rod and is described herein as a plurality of plunger elements. The leakdown plunger 210 includes a first hollow plunger element 221, a second hollow plunger element 223, and an insert-accommodating plunger element 222. As depicted in FIG. 20, the first hollow plunger element 221 is located adjacent to the insert-accommodating plunger element 222. The insert-accommodating plunger element 222 is located adjacent to the second hollow plunger element 223.

The leakdown plunger 210 is provided with a plurality of outer surfaces and inner surfaces. FIG. 21 depicts the first plunger opening 231 of an alternative embodiment. The first plunger opening 231 of the embodiment depicted in FIG. 21 is advantageously provided with a chamfered plunger surface 233, however a chamfered plunger surface 233 is not necessary. When used herein in relation to a surface, the term "chamfered" shall mean a surface that is rounded or angled.

The first plunger opening 231 depicted in FIG. 21 is configured to accommodate an insert. The first plunger opening 231 is shown in FIG. 21 accommodating a valve insert 243. In the embodiment depicted in FIG. 21, the valve insert 243 is shown in an exploded view and includes a generally spherically shaped valve insert member 244, an insert spring 245, and a cap 246. Those skilled in the art will appreciate that valves other than the valve insert 243 shown herein can be used without departing from the scope and spirit of the present invention.

As shown in FIG. 21, the first plunger opening 231 is provided with an annular plunger surface 235 defining a plunger hole 236. The plunger hole 236 is shaped to accommodate an insert. In the embodiment depicted in FIG. 21, the plunger hole 236 is shaped to accommodate the spherical valve insert member 244. The spherical valve insert member 244 is configured to operate with the insert spring 245 and the cap 246. The cap 246 is shaped to at least partially cover the spherical valve insert member 244 and the insert spring 245. The cap 246 is preferably fabricated through stamping. However, the cap 246 may be forged or machined without departing from the scope or spirit of the present invention.

FIG. 22 shows a cross-sectional view of the leakdown plunger 210 depicted in FIG. 21 in a semi-assembled state. In FIG. 22, the valve insert 243 is shown in a semi-assembled state. As depicted in FIG. 22, a cross-sectional view of a cap spring 247 is shown around the cap 246. Those skilled in the art will appreciate that the cap spring 247 and the cap 246 are configured to be inserted into the well of another body. According to one aspect of the present invention, the cap spring 247 and the cap 246 are configured to be inserted into the well of a lash adjuster body. In the preferred embodiment, the cap spring 247 and cap 246 are configured to be inserted into the lash adjuster well 50 of the lash adjuster 10.

The cap 246 is configured to at least partially depress the insert spring 245. The insert spring 245 exerts a force on the spherical valve insert member 244. In FIG. 22, the annular plunger surface 235 is shown with the spherical valve insert member 244 partially located within the plunger hole 236.

Figure 30:
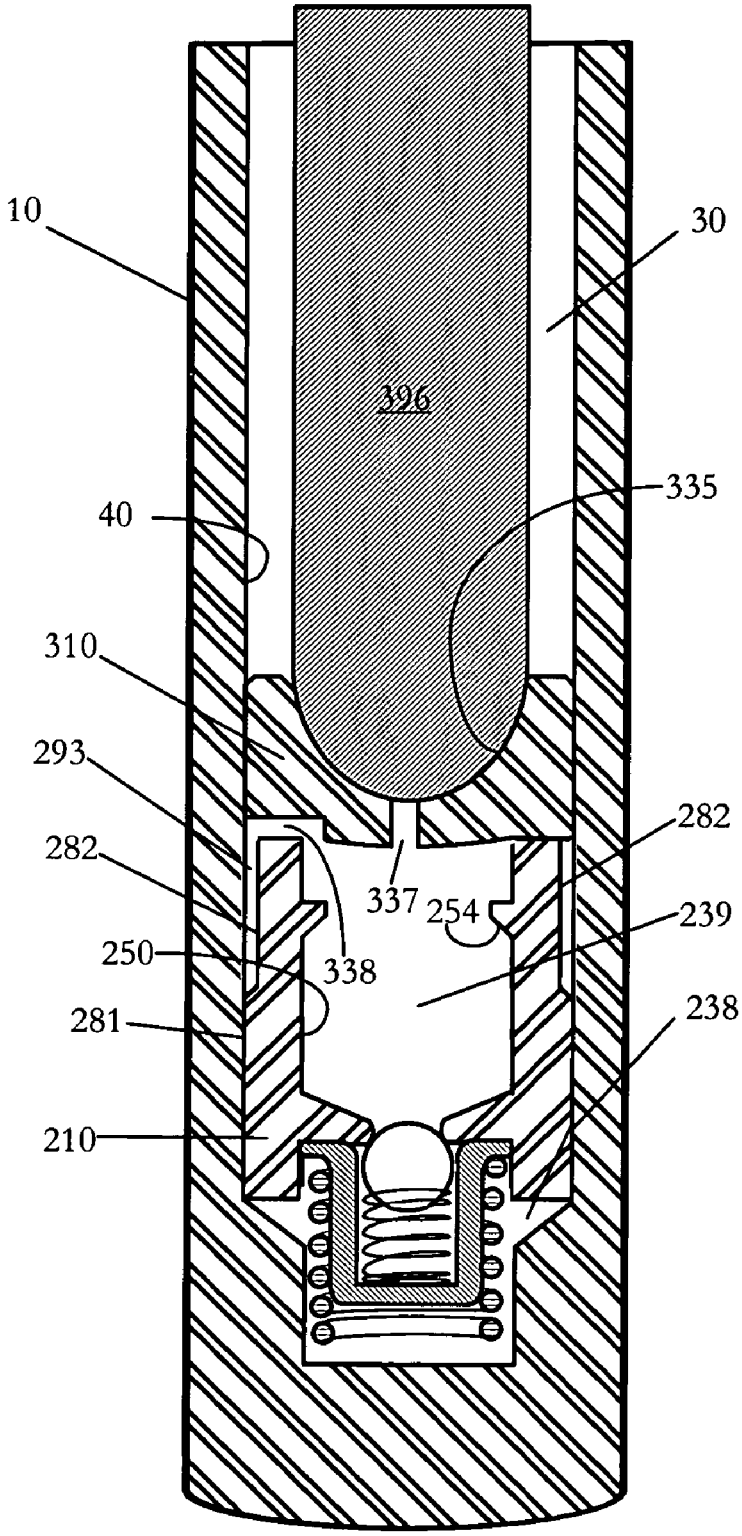
FIG. 30 depicts a sixth embodiment of a leakdown plunger.

Referring now to FIG. 21, leakdown plunger 210 is provided with an outer plunger surface 280. The outer plunger surface 280 is preferably shaped so that the body can be inserted into a lash adjuster body. In the preferred embodiment, the outer plunger surface 280 is shaped so that the leakdown plunger 210 can be inserted into the adjusting body 10. Depicted in FIG. 30 is an adjusting body 10 having an inner surface 40 defining a cavity 30. An embodiment of the leakdown plunger 210 is depicted in FIG. 30 within the cavity 30 of the adjusting body 10. As shown in FIG. 30, the leakdown plunger 210 is preferably provided with an outer plunger surface 280 that is cylindrically shaped.

Figure 23:
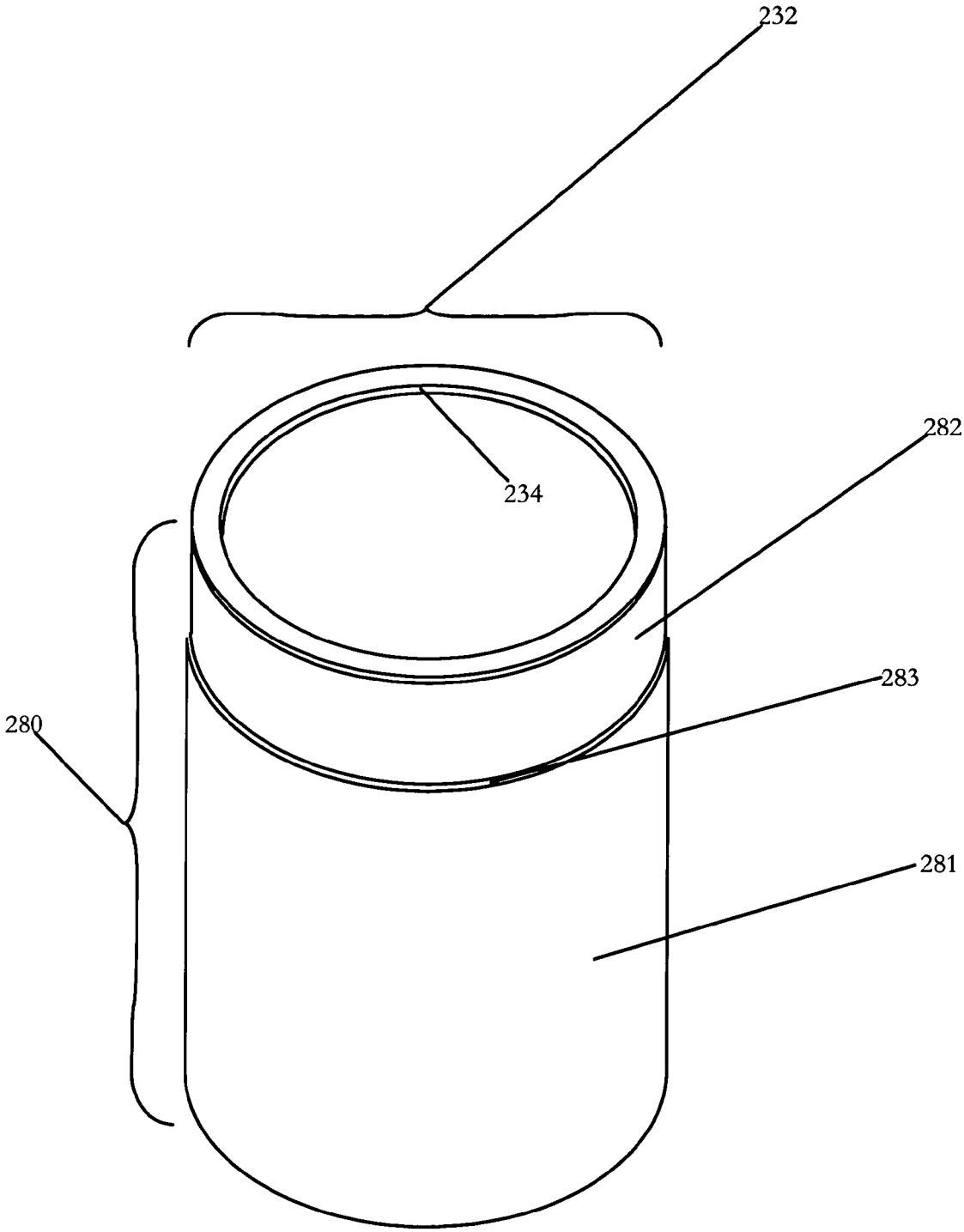
FIG. 23 depicts a perspective view of another preferred embodiment of a leakdown plunger.

FIG. 23 depicts a leakdown plunger 210 of an alternative embodiment. FIG. 23 depicts the second plunger opening 232 in greater detail. The second plunger opening 232 is shown with a chamfered plunger surface 234. However, those with skill in the art will appreciate that the second plunger opening 232 may be fabricated without the chamfered plunger surface 234.

In FIG. 23 the leakdown plunger 210 is provided with a plurality of outer surfaces. As shown therein, the embodiment is provided with an outer plunger surface 280. The outer plunger surface 280 includes a plurality of surfaces. FIG. 23 depicts a cylindrical plunger surface 281, an undercut plunger surface 282, and a conical plunger surface 283. As depicted in FIG. 23, the undercut plunger surface 282 extends from one end of the leakdown plunger 210 and is cylindrically shaped. The diameter of the undercut plunger surface 282 is smaller than the diameter of the cylindrical plunger surface 281.

The undercut plunger surface 282 is preferably forged through use of an extruding die. Alternatively, the undercut plunger surface 282 is fabricated through machining. Machining the undercut plunger surface 282 is accomplished through use of an infeed centerless grinding machine, such as a Cincinnati grinder. The surface is first heat-treated and then the undercut plunger surface 282 is ground via a grinding wheel. Those skilled in the art will appreciate that additional surfaces can be ground into the outer plunger surface 280 with minor alterations to the grinding wheel.

Referring again to FIG. 23, the conical plunger surface 283 is located between the cylindrical plunger surface 281 and the undercut plunger surface 282. Those with skill in the art will appreciate that the outer plunger surface 280 can be fabricated without the conical plunger surface 283 so that the cylindrical plunger surface 281 and the undercut plunger surface 282 abut one another.

Figure 25:
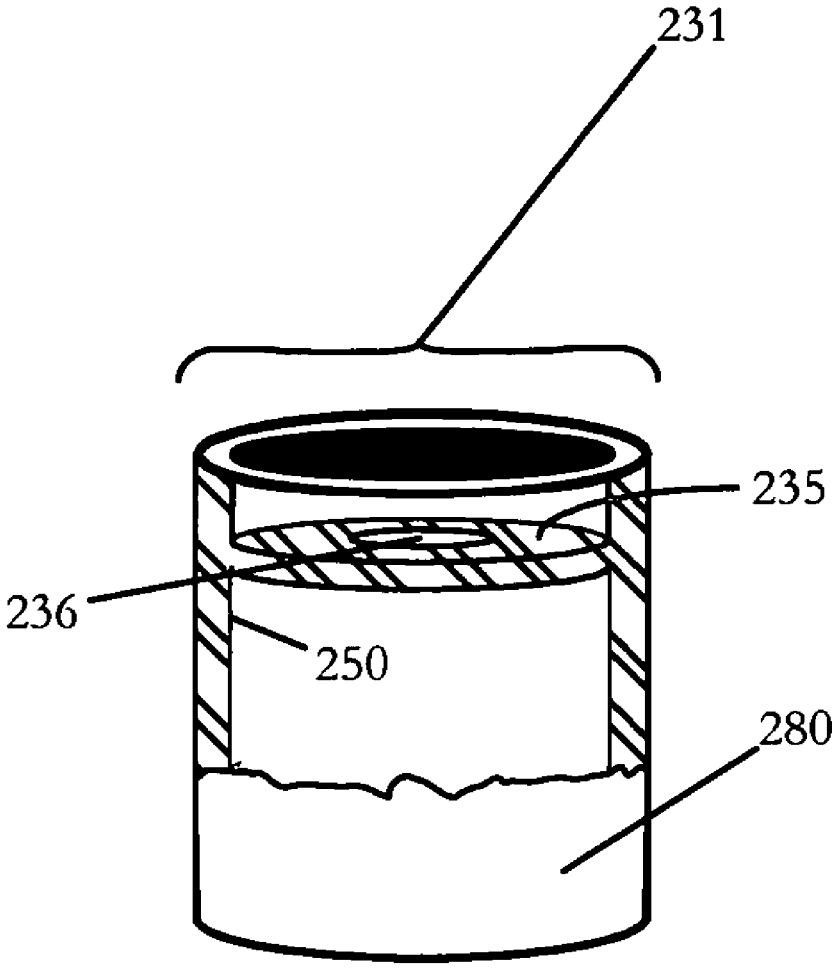
FIG. 25 depicts a third embodiment of a leakdown plunger.

FIG. 25 depicts an embodiment of the leakdown plunger 210 with a section of the outer plunger surface 280 broken away. The embodiment depicted in FIG. 25 is provided with a first plunger opening 231. As shown in FIG. 25, the outer plunger surface 280 encloses an inner plunger surface 250. The inner plunger surface 250 includes an annular plunger surface 235 that defines a plunger hole 236.

Figure 26:
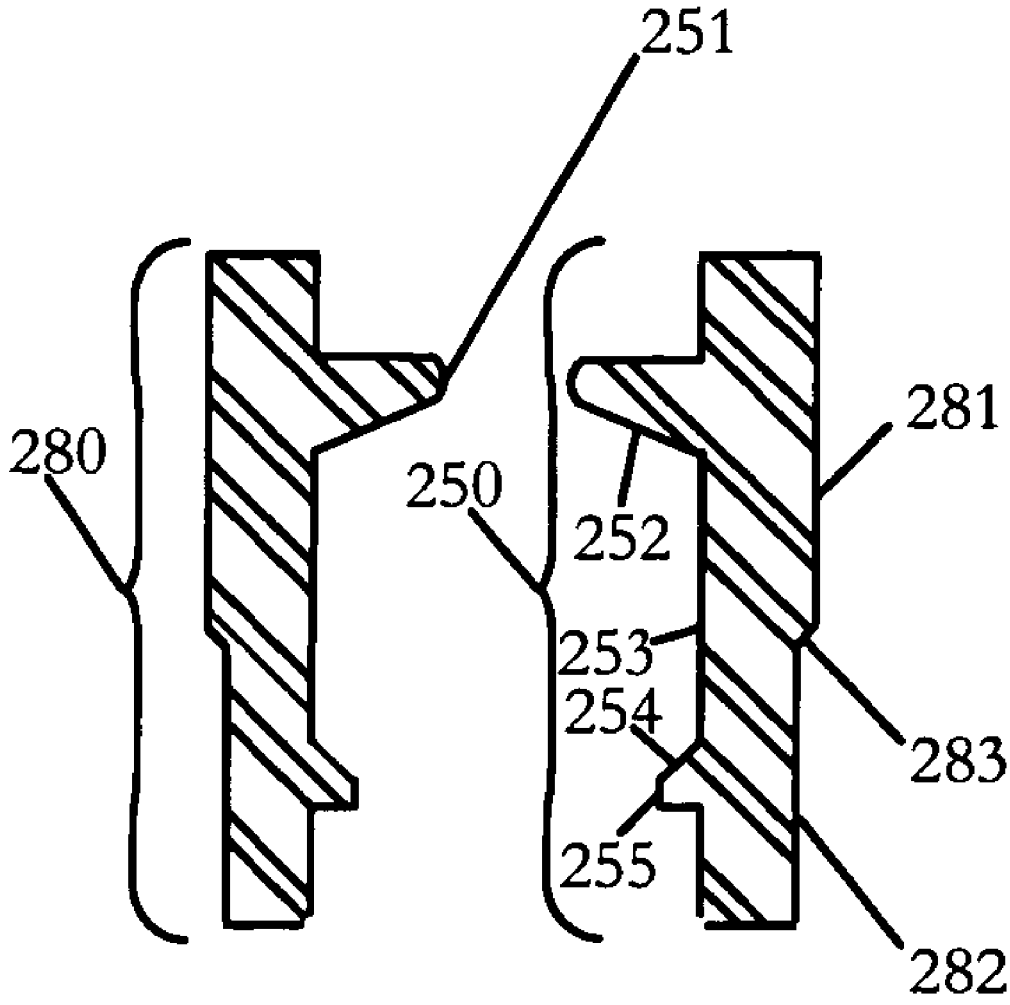
FIG. 26 depicts a fourth embodiment of a leakdown plunger.

FIG. 26 depicts a cross-sectional view of a leakdown plunger of an alternative embodiment. The leakdown plunger 210 shown in FIG. 26 is provided with an outer plunger surface 280 that includes a plurality of cylindrical and conical surfaces. In the embodiment depicted in FIG. 26, the outer plunger surface 280 includes an outer cylindrical plunger surface 281, an undercut plunger surface 282, and an outer conical plunger surface 283. As depicted in FIG. 26, the undercut plunger surface 282 extends from one end of the leakdown plunger 210 and is cylindrically shaped. The diameter of the undercut plunger surface 282 is smaller than, and preferably concentric relative to, the diameter of the outer cylindrical plunger surface 281. The outer conical plunger surface 283 is located between the outer cylindrical plunger surface 281 and the undercut plunger surface 282. Those with skill in the art will appreciate that the outer plunger surface 280 can be fabricated without the conical plunger surface 283 so that the outer cylindrical plunger surface 281 and the undercut plunger surface 282 abut one another.

Figure 27:
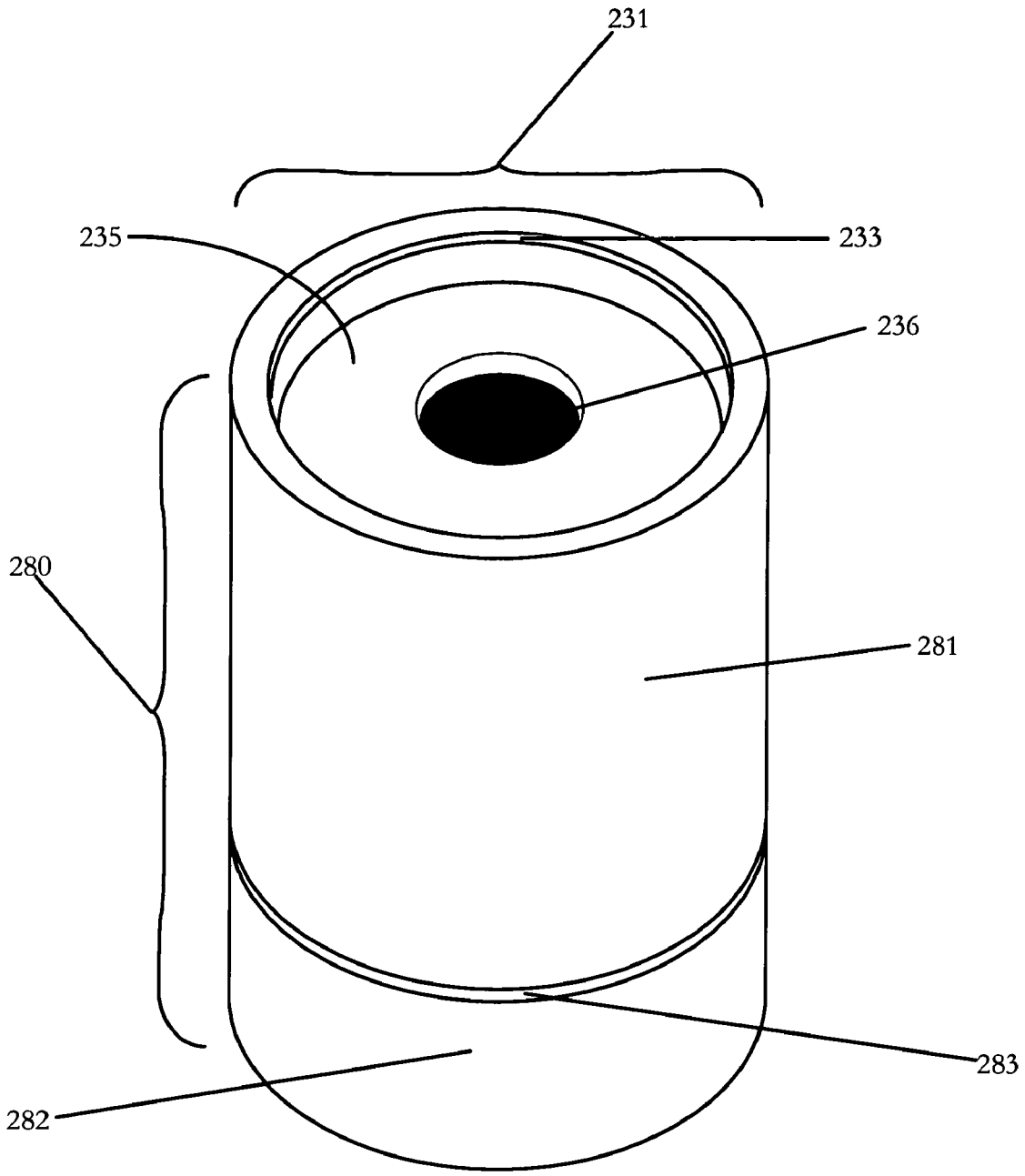
FIG. 27 depicts a fifth embodiment of a leakdown plunger.

FIG. 27 depicts in greater detail in the first plunger opening 231 of the embodiment depicted in FIG. 26. The first plunger opening 231 is configured to accommodate an insert and is preferably provided with a first chamfered plunger surface 233. Those skilled in the art, however, will appreciate that the first chamfered plunger surface 233 is not necessary. As further shown in FIG. 27, the first plunger opening 231 is provided with a first annular plunger surface 235 defining a plunger hole 236.

The embodiment depicted in FIG. 27 is provided with an outer plunger surface 280 that includes a plurality of surfaces. The outer plunger surface 280 includes a cylindrical plunger surface 281, an undercut plunger surface 282, and a conical plunger surface 283. As depicted in FIG. 27, the undercut plunger surface 282 extends from one end of the leakdown plunger 210 and is cylindrically shaped. The diameter of the under cut plunger surface 282 is smaller than the diameter of the cylindrical plunger surface 281. The conical plunger surface 283 is located between the cylindrical plunger surface 281 and the undercut plunger surface 282. However, those with skill in the art will appreciate that the outer plunger surface 280 can be fabricated without the conical plunger surface 283 so that the cylindrical plunger surface 281 and the undercut plunger surface 282 abut one another. Alternatively, the cylindrical plunger surface 281 may abut the undercut plunger surface 282 so that the conical plunger surface 283 is an annular surface.

Figure 28:
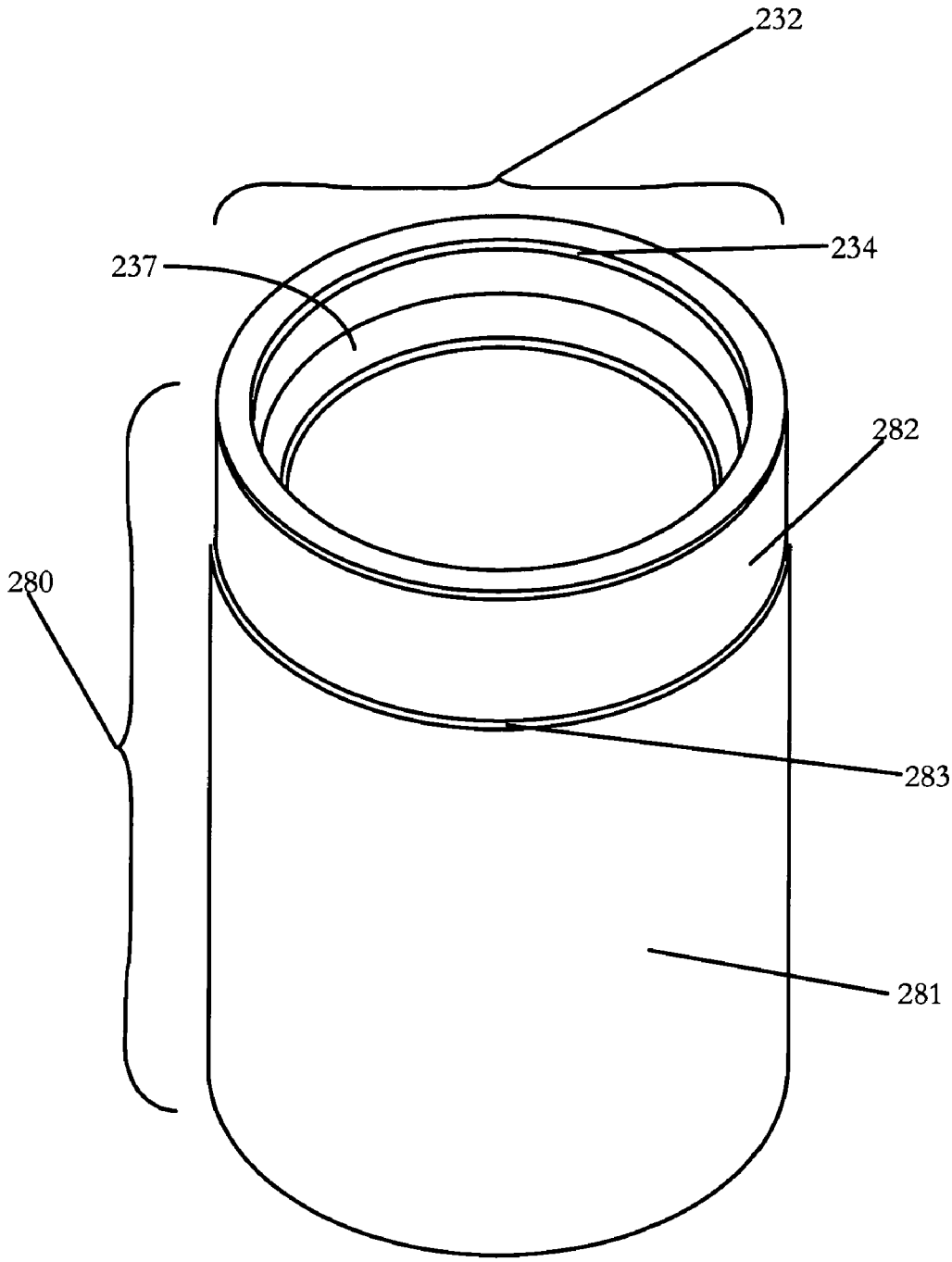
FIG. 28 depicts a perspective view of another preferred embodiment of a leakdown plunger.

FIG. 28 depicts the second plunger opening 232 of the embodiment depicted in FIG. 26. The second plunger opening 232 is shown with a second chamfered plunger surface 234. However, those with skill in the art will appreciate that the second plunger opening 232 may be fabricated without the second chamfered plunger surface 234. The second plunger opening 232 is provided with a second annular plunger surface 237.

Figure 29:
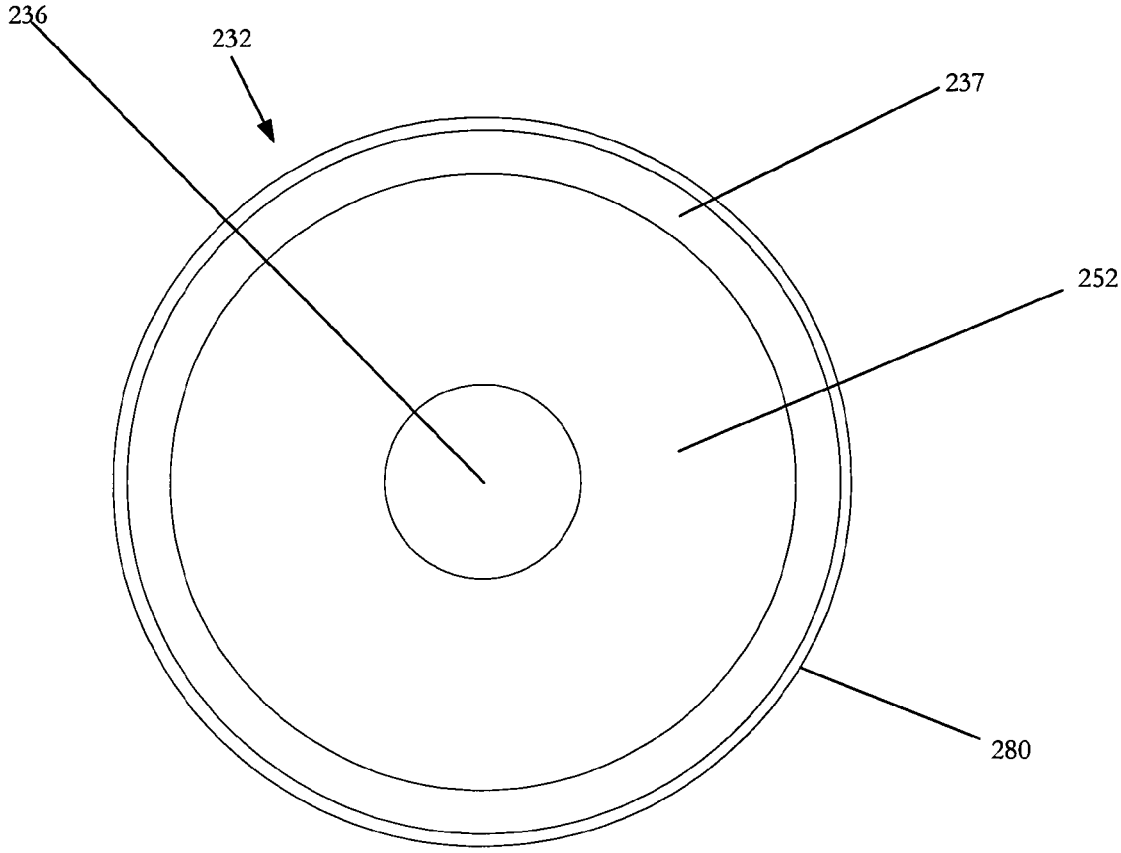
FIG. 29 depicts the top view of another preferred embodiment of a leakdown plunger.

FIG. 29 depicts a top view of the second plunger opening 232 of the embodiment depicted in FIG. 26. In FIG. 29, the second annular plunger surface 237 is shown in relation to the first inner conical plunger surface 252 and the plunger hole 236. As shown in FIG. 29, the plunger hole 236 is concentric relative to the outer plunger surface 280 and the annulus formed by the second annular plunger surface 237.

Figure 24:
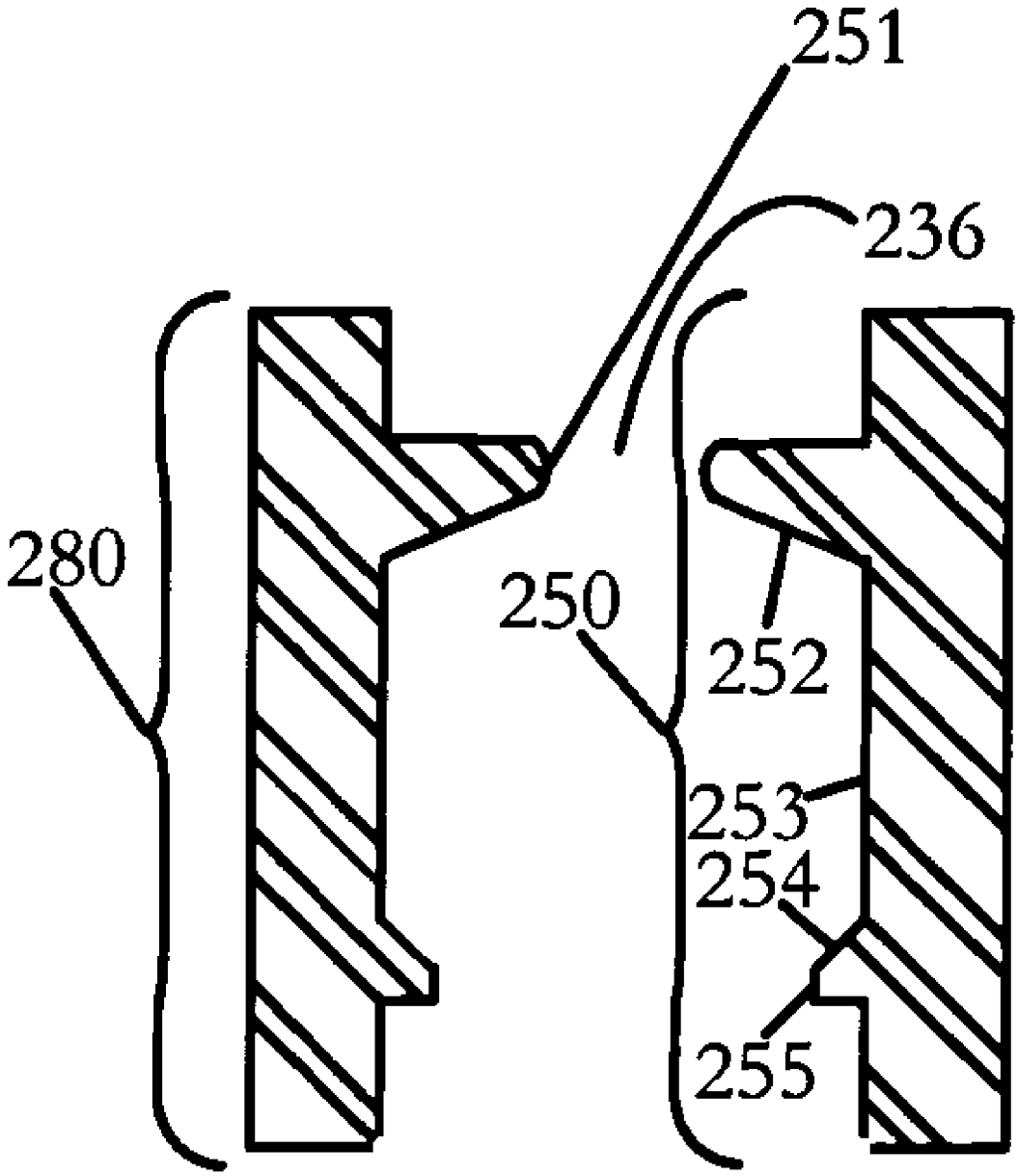
FIG. 24 depicts a second embodiment of a leakdown plunger.

Referring now to FIG. 24, the outer plunger surface 280 encloses an inner plunger surface 250. The inner plunger surface 250 includes a plurality of surfaces. In the alternative embodiment depicted in FIG. 24, the inner plunger surface 250 includes a rounded plunger surface 251 that defines a plunger hole 236. Those skilled in the art will appreciate that the rounded plunger surface 251 need not be rounded, but may be flat. The inner plunger surface 250 includes a first inner conical plunger surface 252 and a second inner conical plunger surface 254, a first inner cylindrical plunger surface 253, and a second inner cylindrical plunger surface 255. The first inner conical plunger surface 252 is located adjacent to the rounded plunger surface 251. Adjacent to the first inner conical plunger surface 252 is the first inner cylindrical plunger surface 253. The first inner cylindrical plunger surface 253 is adjacent to the second inner conical plunger surface 254. The second inner conical plunger surface 254 is adjacent to the second inner cylindrical plunger surface 255.

FIG. 30 depicts an embodiment of the leakdown plunger 210 within another body cooperating with a plurality of inserts. The undercut plunger surface 282 preferably cooperates with another body, such as a lash adjuster body, to form a leakdown path 293. FIG. 30 depicts an embodiment of the leakdown plunger 210 within a adjusting body 10; however, those skilled in the art will appreciate that the present invention may be inserted within other bodies, such as roller followers or a roller lifter body, such as the valve lifter body 110.

As shown in FIG. 30, in the preferred embodiment, the undercut plunger surface 282 is configured to cooperate with the inner surface 40 of a adjusting body 10. The undercut plunger surface 282 and the inner surface 40 of the adjusting body 10 cooperate to define a leakdown path 293 for a liquid such as a lubricant.

The embodiment depicted in FIG. 30 is further provided with a cylindrical plunger surface 281. The cylindrical plunger surface 281 cooperates with the inner surface 40 of the adjusting body 10 to provide a first chamber 238. Those skilled in the art will appreciate that the first chamber 238 functions as a high pressure chamber for a liquid, such as a lubricant.

The second plunger opening 232 is configured to cooperate with a socket, such as that disclosed in Applicants' "Metering Socket," application Ser. No. 10/316,262, filed on Oct. 28, 2002. In the preferred embodiment, the second plunger opening 232 is configured to cooperate with the socket 310. The socket 310 is configured to cooperate with a push rod 396. As shown in FIG. 30, the socket 310 is provided with a push rod cooperating surface 335. The push rod cooperating surface 335 is configured to function with a push rod 396. Those skilled in the art will appreciate that the push rod 396 cooperates with the rocker arm (not shown) of an internal combustion engine (not shown).

The socket 310 cooperates with the leakdown plunger 210 to define at least in part a second chamber 239 within the inner plunger surface 250. Those skilled in the art will appreciate that the second chamber 239 may advantageously function as a reservoir for a lubricant. The inner plunger surface 250 of the leakdown plunger 210 functions to increase the quantity of retained fluid in the second chamber 239 through the damming action of the second inner conical plunger surface 254.

The socket 310 is provided with a plurality of passages that function to fluidly communicate with the cavity 30 of the adjusting body 10. In the embodiment depicted in FIG. 30, the socket 310 is provided with a socket passage 337 and a plunger reservoir passage 338. The plunger reservoir passage 338 functions to fluidly connect the second chamber 239 with the cavity 30 of the adjusting body 10. As shown in FIG. 30, the socket passage 337 functions to fluidly connect the socket 310 and the cavity 30 of the adjusting body 10.

FIGS. 31 to 35 illustrate the presently preferred method of fabricating a leakdown plunger. FIGS. 31 to 35 depict what is known in the art as "slug progressions" that show the fabrication of the leakdown plunger 210 of the present invention from a rod or wire to a finished or near-finished body. In the slug progressions shown herein, pins are shown on the punch side; however, those skilled in the art will appreciate that the pins can be switched to the die side without departing from the scope of the present invention.

The leakdown plunger 210 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 31:
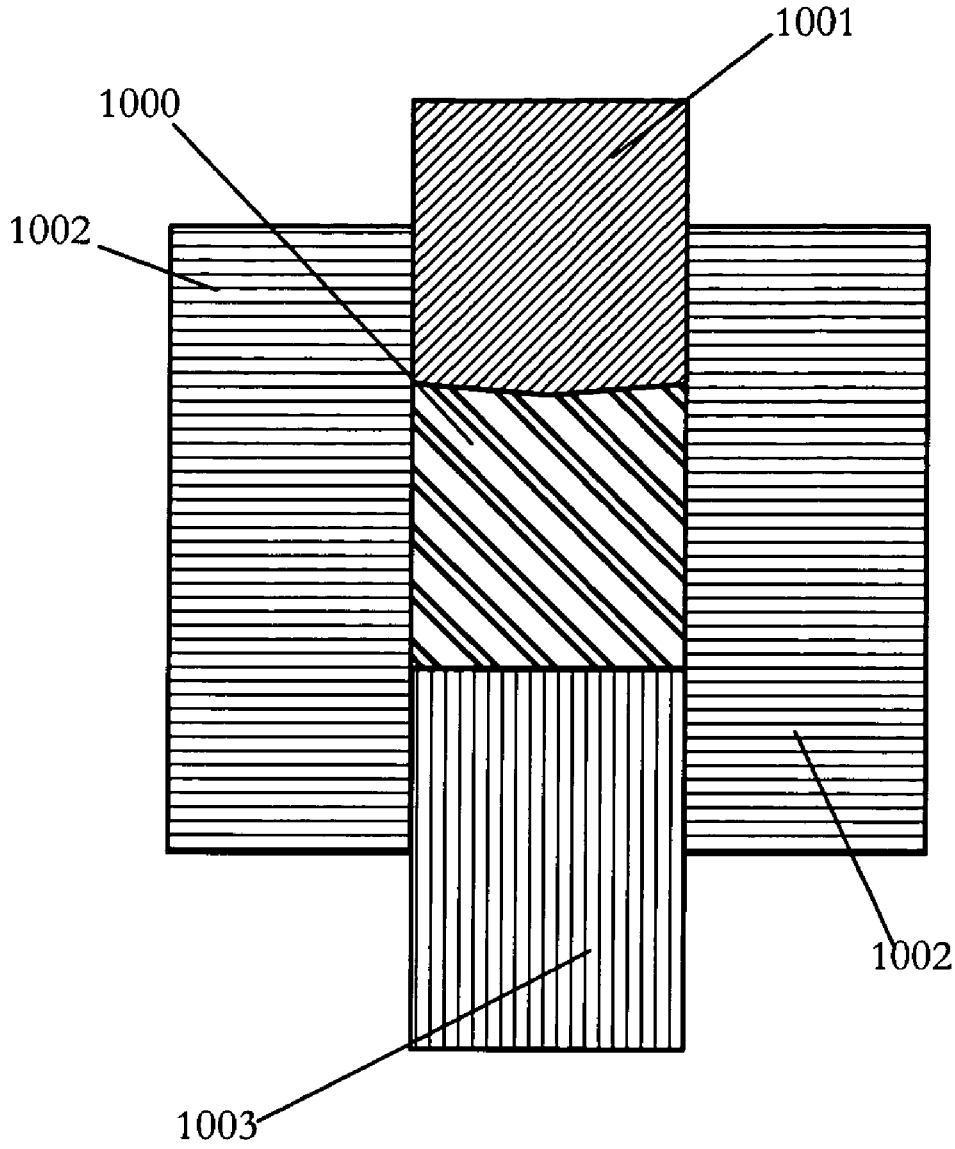
FIGS. 31–35 depict a preferred method of fabricating a leakdown plunger.

The process of forging the leakdown plunger 210 an embodiment of the present invention begins with a metal wire or metal rod 1000 which is drawn to size. The ends of the wire or rod are squared off. As shown in FIG. 31, this is accomplished through the use of a first punch 1001, a first die 1002, and a first knock out pin 1003.

Figure 32:
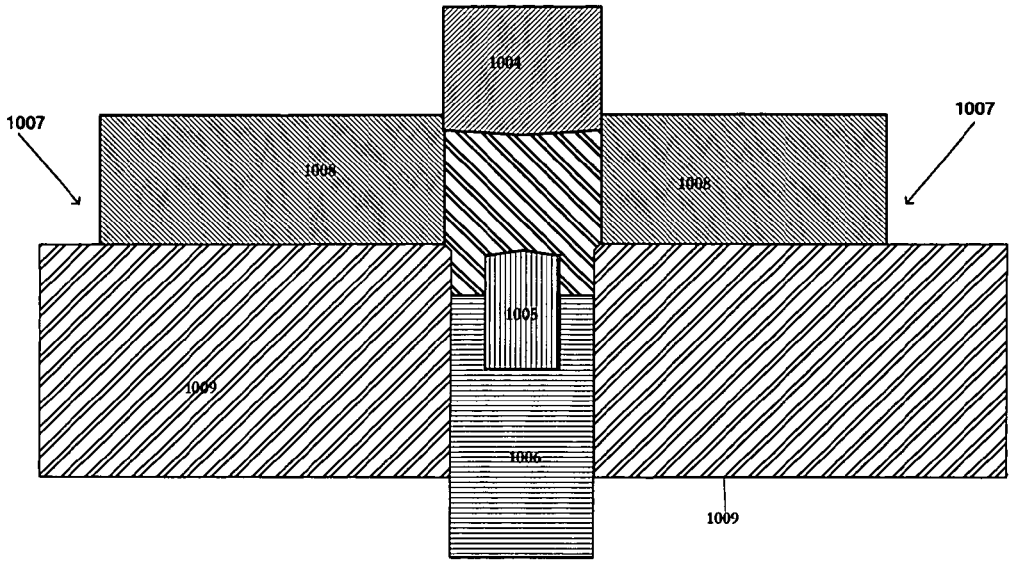

After being drawn to size, the wire or rod 1000 is run through a series of dies or extrusions. As depicted in FIG. 32, the fabrication of the second plunger opening 232 and the outer plunger surface 280 is preferably commenced through use of a second punch 1004, a second knock out pin 1005, a first sleeve 1006, and a second die 1007. The second plunger opening 232 is fabricated through use of the second knock out pin 1005 and the first sleeve 1006. The second die 1007 is used to fabricate the outer plunger surface 280. As shown in FIG. 32, the second die 1007 is composed of a second die top 1008 and a second die rear 1009. In the preferred forging process, the second die rear 1009 is used to form the undercut plunger surface 282 and the conical plunger surface 283.

Figure 33:
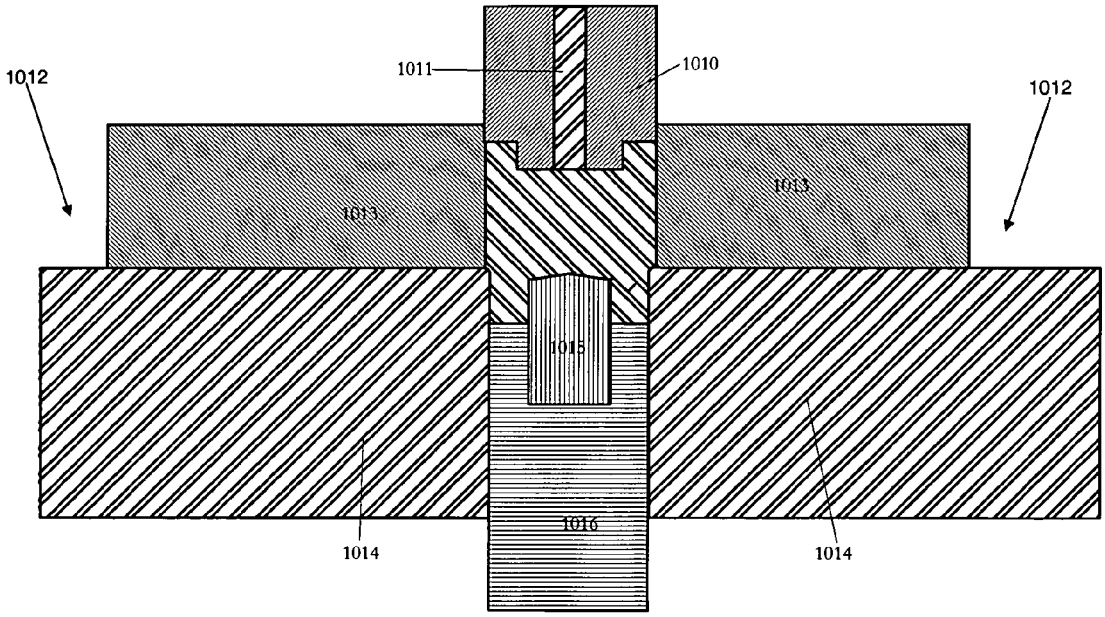

As depicted in FIG. 33, the first plunger opening 231 is fabricated through use of a third 1010. Within the third punch 1010 is a first pin 1011. The third punch 1010 and the first pin 1011 are used to fabricate at least a portion of the annular plunger surface 235. As shown in FIG. 33, it is desirable to preserve the integrity of the outer plunger surface 280 through use of a third die 1012. The third die 1012 is composed of a third die top 1013 and a third die rear 1014. Those skilled in the art will appreciate the desirability of using a third knock out pin 1015 and a second sleeve 1016 to preserve the forging of the second opening.

Figure 34:
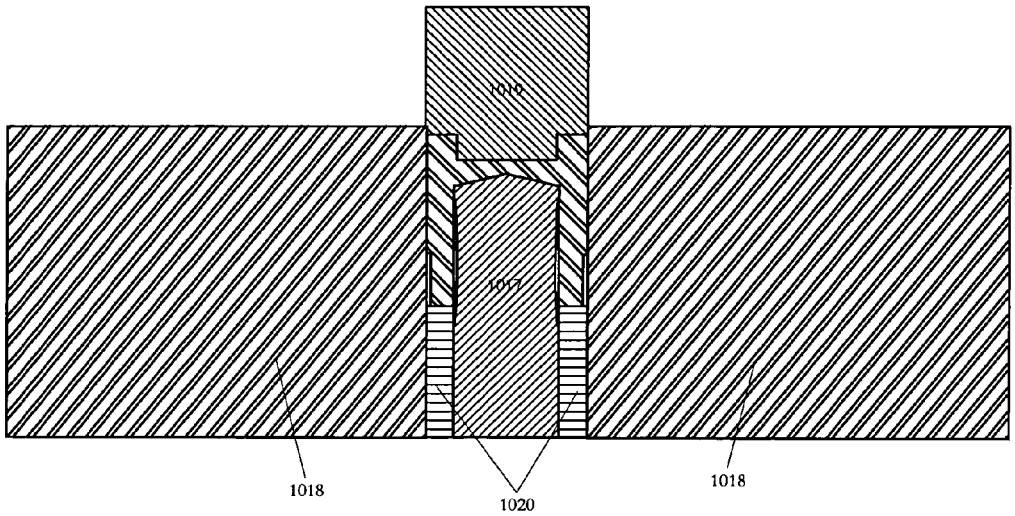

FIG. 34 depicts the forging of the inner plunger surface 250. As depicted, the inner plunger surface 250 is forged through use of a punch extrusion pin 1017. Those skilled in the art will appreciate that it is advantageous to preserve the integrity of the first plunger opening 231 and the outer plunger surface 280. This function is accomplished through use of a fourth die 1018 and a fourth knock out pin 1019. A punch stripper sleeve 1020 is used to remove the punch extrusion pin 1017 from the inner plunger surface 250.

Figure 35:
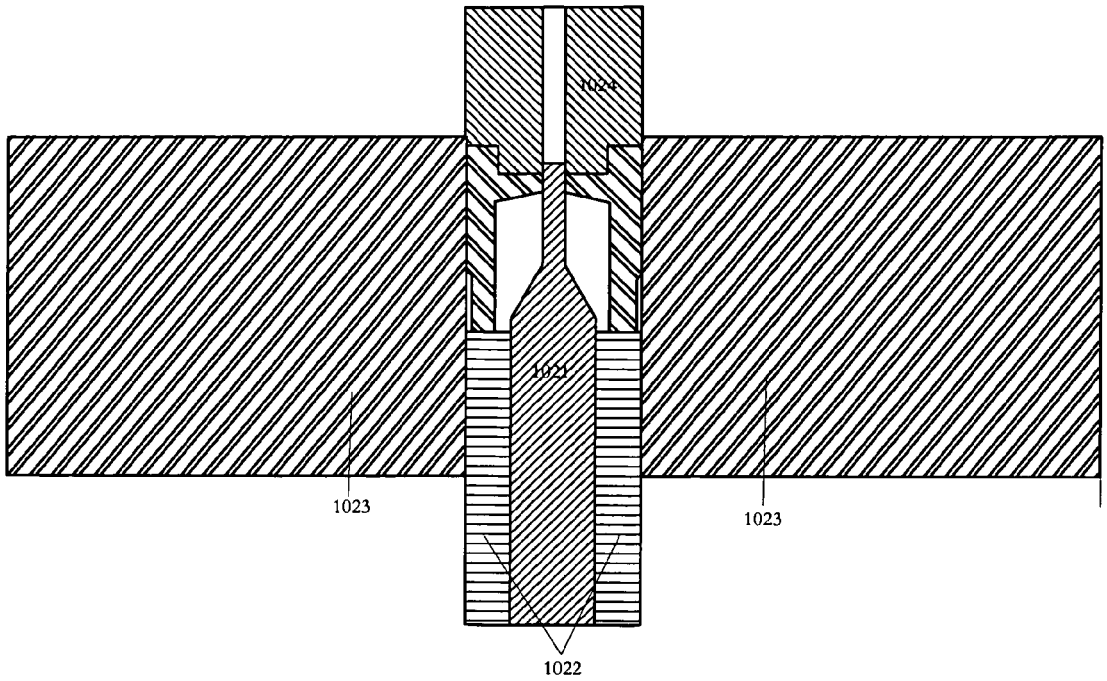

As shown in FIG. 35, the plunger hole 236 is fabricated through use of a piercing punch 1021 and a stripper sleeve 1022. To assure that other forging operations are not affected during the fabrication of the plunger hole 236, a fifth die 1023 is used around the outer plunger surface 280 and a tool insert 1024 is used at the first plunger opening 231.

Figure 36:
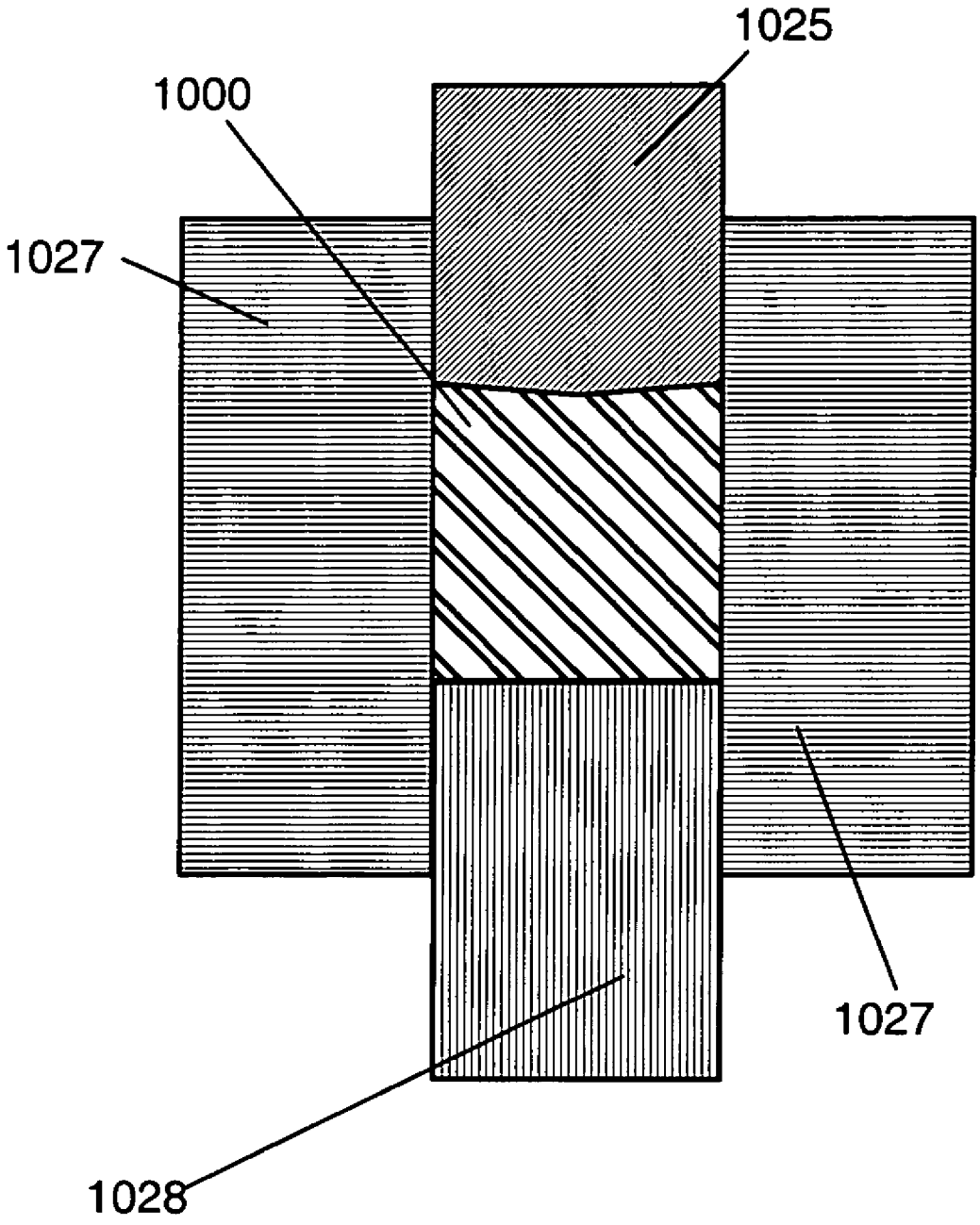
FIGS. 36–40 depict an alternative method of fabricating a leakdown plunger.

FIGS. 36 to 40 illustrate an alternative method of fabricating a leakdown plunger. FIG. 36 depicts a metal wire or metal rod 1000 drawn to size. The ends of the wire or rod 1000 are squared off through the use of a first punch 1025, a first die 1027, and a first knock out pin 1028.

Figure 37:
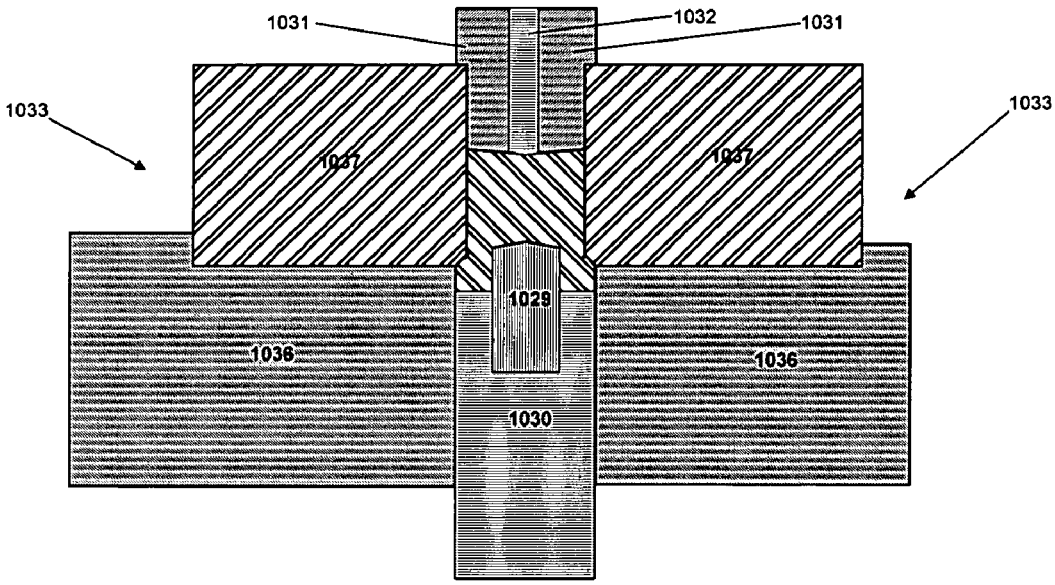

As depicted in FIG. 37, the fabrication of the first plunger opening 231, the second plunger opening 232, and the outer plunger surface 280 is preferably commenced through use of a punch pin 1029, a first punch stripper sleeve 1030, second knock out pin 1031, a stripper pin 1032, and a second die 1033. The first plunger opening 231 is fabricated through use of the second knock out pin 1031. The stripper pin 1032 is used to remove the second knock out pin 1031 from the first plunger opening 231.

The second plunger opening 232 is fabricated, at least in part, through the use of the punch pin 1029. A first punch stripper sleeve 1034 is used to remove the punch pin 1029 from the second plunger opening 232. The outer plunger surface 280 is fabricated, at least in part, through the use of a second die 1033. The second die 1033 is composed of a second die top 1036 and a second die rear 1037.

Figure 38:
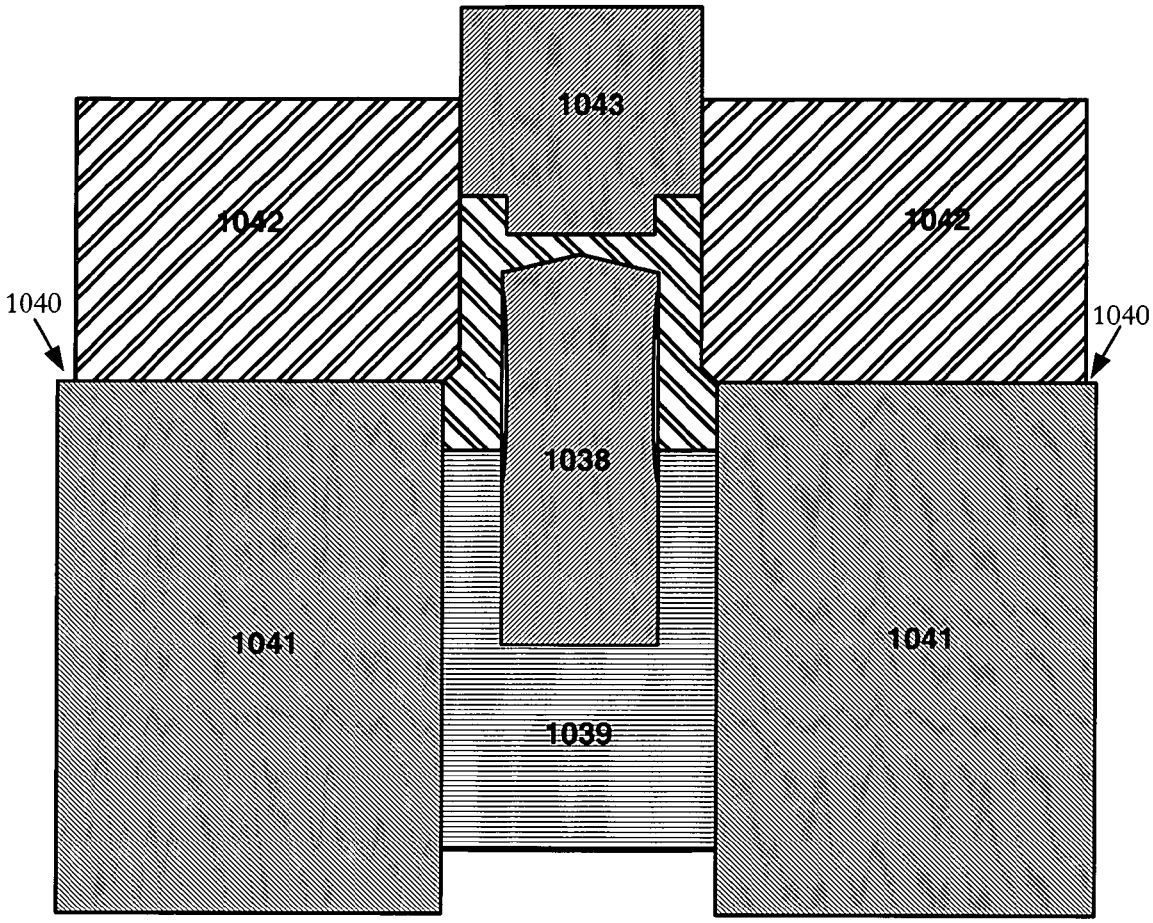

FIG. 38 depicts the forging of the inner plunger surface 250. As depicted, the inner plunger surface 250 is forged through the use of an extrusion punch 1038. A second punch stripper sleeve 1039 is used to remove the extrusion punch 1038 from the inner plunger surface 250.

Those skilled in the art will appreciate that it is advantageous to preserve the previous forging of the first plunger opening 231 and the outer plunger surface 280. A third knock out pin 1043 is used to preserve the previous forging operations on the first plunger opening 231. A third die 1040 is used to preserve the previous forging operations on the outer plunger surface 280. As depicted in FIG. 38, the third die 1040 is composed of a third die top 1041 and a third die rear 1042.

Figure 39:
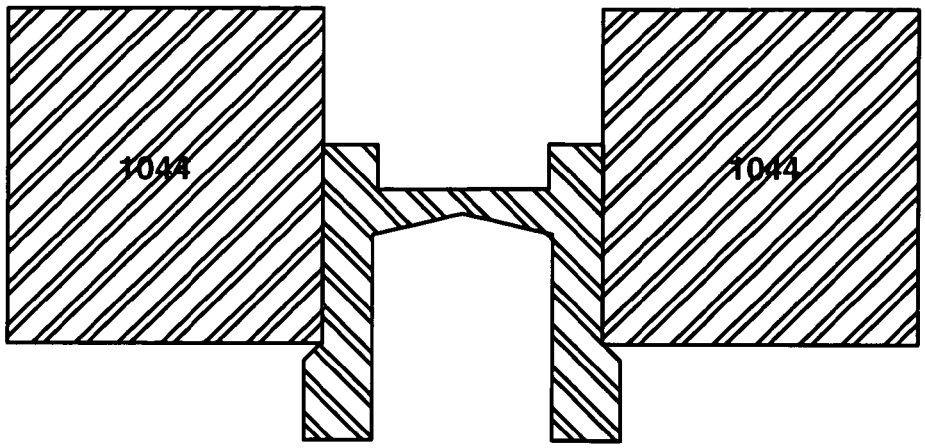

As depicted in FIG. 39, a sizing die 1044 is used in fabricating the second inner conical plunger surface 254 and the second inner cylindrical plunger surface 255. The sizing die 1044 is run along the outer plunger surface 280 from the first plunger opening 231 to the second plunger opening 232. This operation results in metal flowing through to the inner plunger surface 250.

Figure 40:
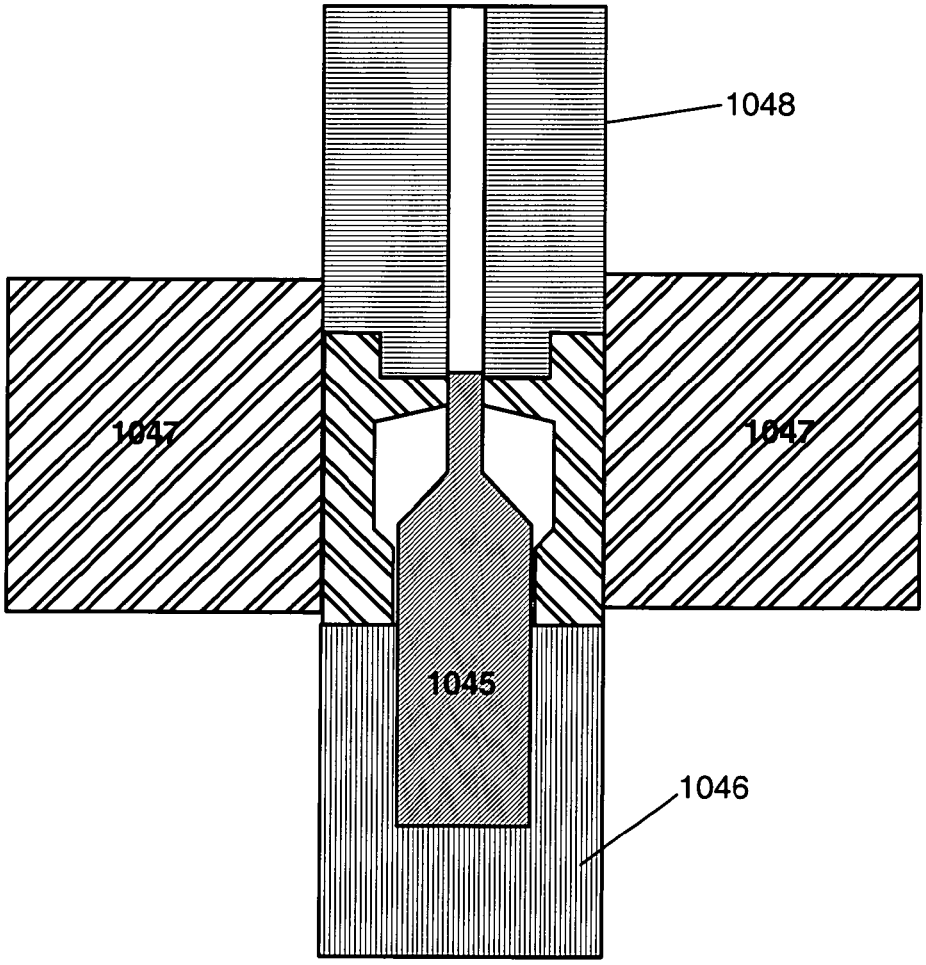

As shown in FIG. 40, the plunger hole 236 is fabricated through use of a piercing punch 1045 and a stripper sleeve 1046. The stripper sleeve 1046 is used in removing the piercing punch 1045 from the plunger hole 236. To assure that other forging operations are not affected during the fabrication of the plunger hole 236, a fourth die 1047 is used around the outer plunger surface 280 and a tool insert 1048 is used at the first plunger opening 231.

Figure 41:
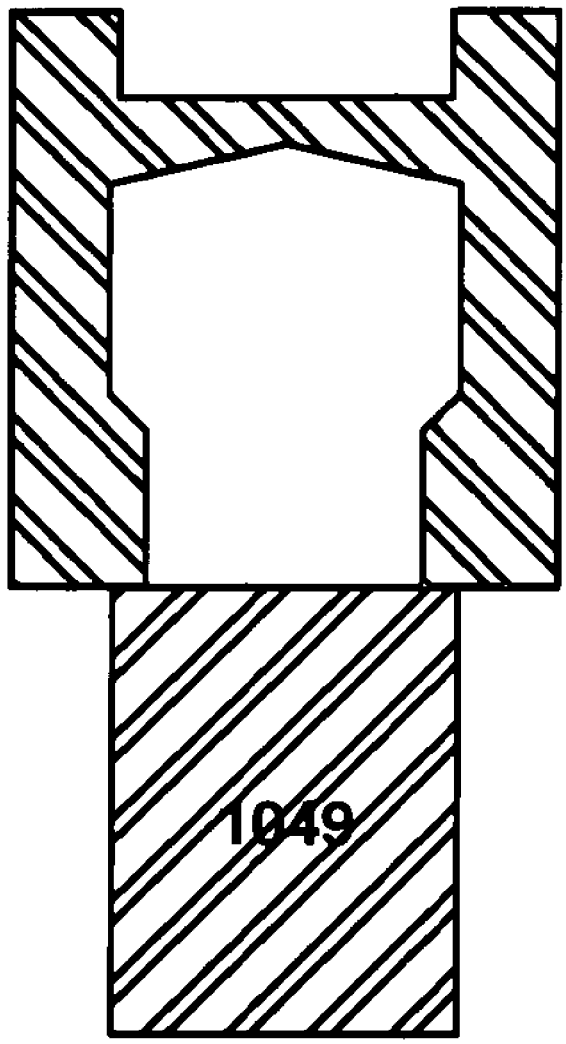
FIG. 41 depicts a step in an alternative method of fabricating a leakdown plunger.

Those skilled in the art will appreciate that further desirable finishing may be accomplished through machining. For example, an undercut plunger surface 282 may be fabricated and the second plunger opening 232 may be enlarged through machining. Alternatively, as depicted in FIG. 41, a shave punch 1049 may be inserted into the second plunger opening 232 and plow back excess material.

Figure 42:
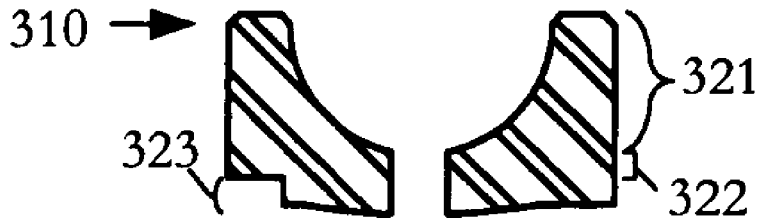
FIG. 42 depicts a preferred embodiment of a socket.
Figure 43:
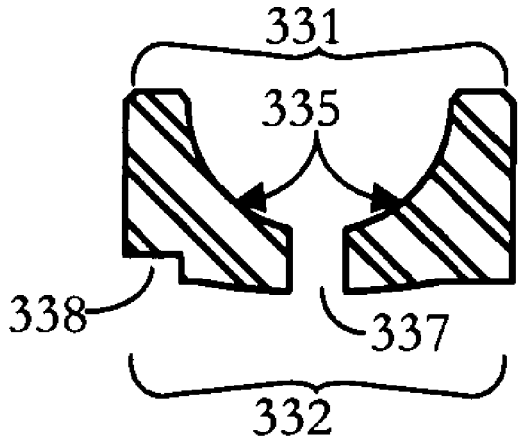
FIG. 43 depicts a preferred embodiment of a socket.
Figure 44:
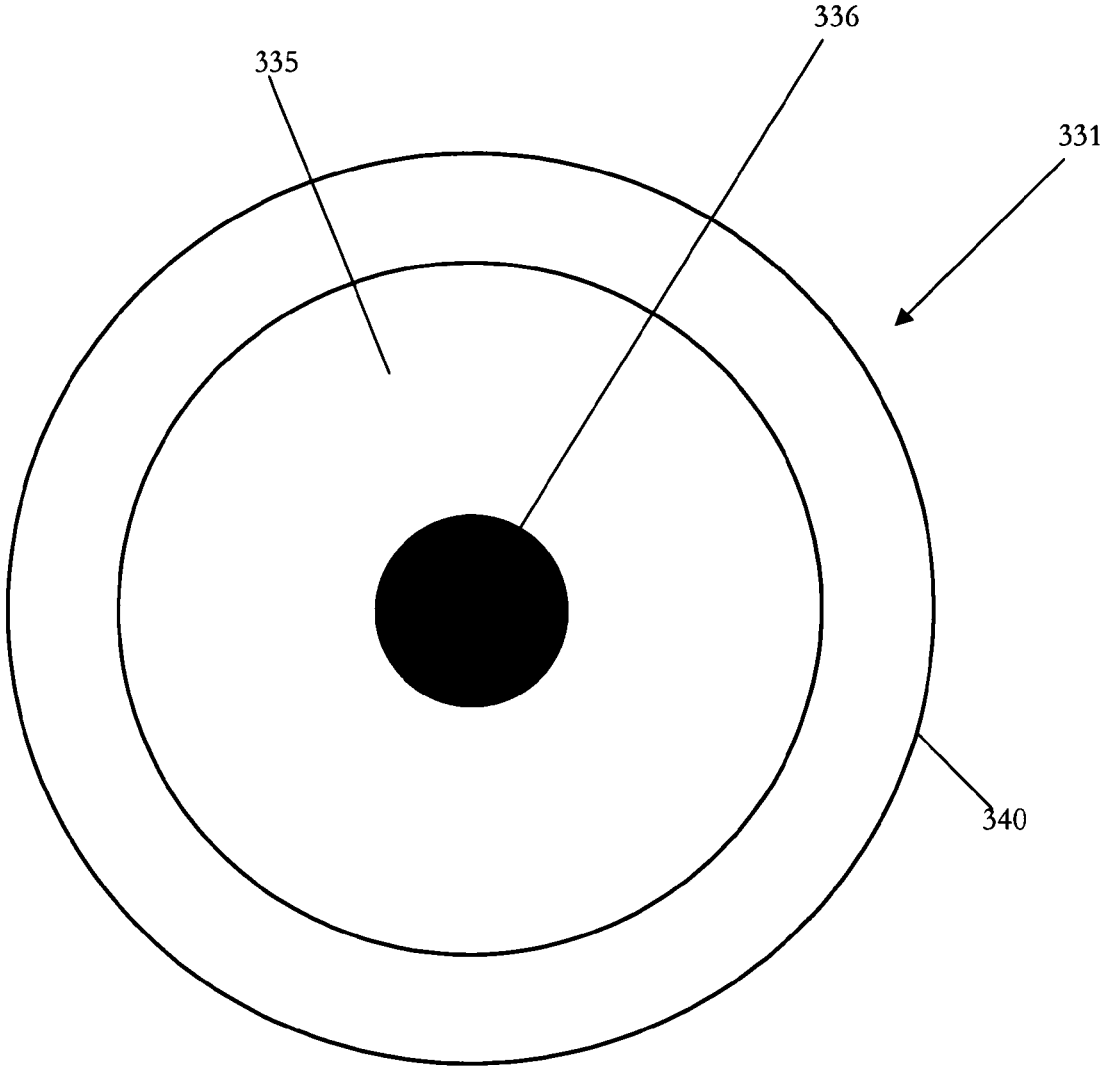
FIG. 44 depicts the top view of a surface of a socket.

Turning now to FIG. 7, a plurality of inserts are shown within the adjusting body 10. As depicted therein, a socket 310 is preferably located within the adjusting body 10. FIGS. 42, 43, and 44 show a socket 310 of the preferred embodiment. The socket 310 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the socket 310 is composed of pearlitic material. According to still another aspect of the present invention, the socket 310 is composed of austenitic material. According to another aspect of the present invention, the metal is a ferritic material.

The socket 310 is composed of a plurality of socket elements. According to one aspect of the present invention, the socket element is cylindrical in shape. According to another aspect of the present invention, the socket element is conical in shape. According to yet another aspect of the present invention, the socket element is solid. According to still another aspect of the present invention, the socket element is hollow.

FIG. 42 depicts a cross-sectional view of the socket 310 composed of a plurality of socket elements. FIG. 42 shows the socket, generally designated 310. The socket 310 functions to accept a liquid, such as a lubricant and is provided with a plurality of surfaces and passages. Referring now to FIG. 44, the first socket surface 331 functions to accommodate an insert, such as, for example, a push rod 396.

The socket 310 of the preferred embodiment is fabricated from a single piece of metal wire or rod and is described herein as a plurality of socket elements. As shown in FIG. 42, the socket 310 includes a first hollow socket element 321, a second hollow socket element 322, and a third hollow socket element 323. As depicted in FIG. 42, the first hollow socket element 321 is located adjacent to the second socket element 322. The second hollow socket element 322 is located adjacent to the third hollow socket element 323.

The first hollow socket element 321 functions to accept an insert, such as a push rod. The third hollow socket element 323 functions to conduct fluid. The second hollow socket element 322 functions to fluidly link the first hollow socket element 321 with the third hollow socket element 323.

Referring now to FIG. 43, the socket 310 is provided with a plurality of outer surfaces and inner surfaces. FIG. 43 depicts a cross sectional view of the socket 310 of the preferred embodiment of the present invention. As shown in FIG. 43, in the preferred embodiment of the present invention the socket 310 is provided with a first socket surface 331. The first socket surface 331 is configured to accommodate an insert. The preferred embodiment is also provided with a second socket surface 332. The second socket surface 332 is configured to cooperate with an engine workpiece.

FIG. 44 depicts a top view of the first socket surface 331. As shown in FIG. 44, the first socket surface 331 is provided with a push rod cooperating surface 335 defining a first socket hole 336. Preferably, the push rod cooperating surface 335 is concentric relative to the outer socket surface 340; however, such concentricity is not necessary.

In the embodiment depicted in FIG. 44, the first socket hole 336 fluidly links the first socket surface 331 with a socket passage 337 (shown in FIG. 43). The socket passage 337 is shaped to conduct fluid, preferably a lubricant. In the embodiment depicted in FIG. 43, the socket passage 337 is cylindrically shaped; however, those skilled in the art will appreciate that the socket passage 337 may assume any shape so long as it is able to conduct fluid.

Figure 45:
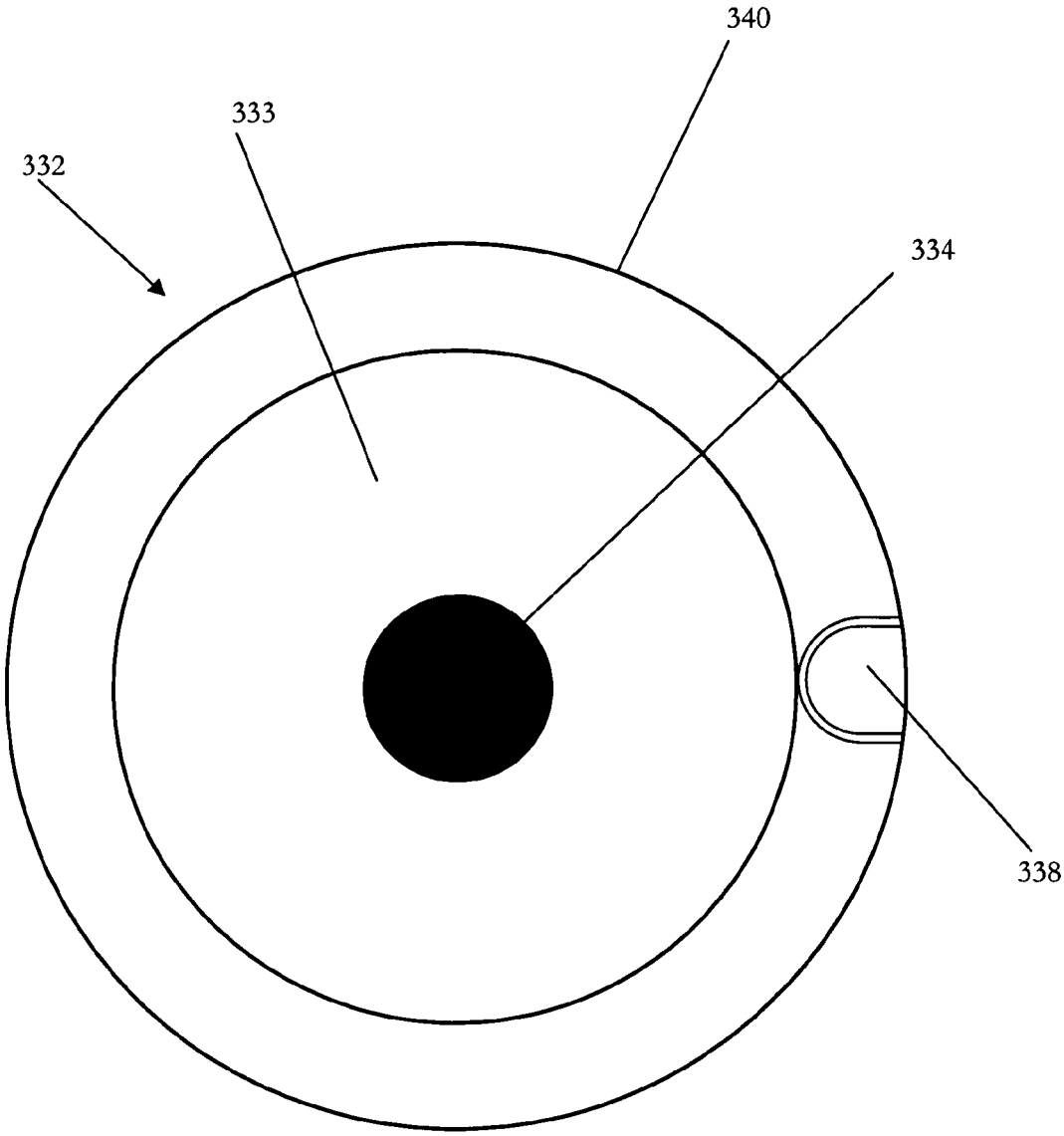
FIG. 45 depicts the top view of another surface of a socket.

FIG. 45 depicts a top view of the second socket surface 332. The second socket surface is provided with a plunger reservoir passage 338. The plunger reservoir passage 338 is configured to conduct fluid, preferably a lubricant. As depicted in FIG. 45, the plunger reservoir passage 338 of the preferred embodiment is generally cylindrical in shape;

however, those skilled in the art will appreciate that the plunger reservoir passage 338 may assume any shape so long as it conducts fluid.

The second socket surface 332 defines a second socket hole 334. The second socket hole 334 fluidly links the second socket surface 332 with socket passage 337. The second socket surface 332 is provided with a curved socket surface 333. The curved socket surface 333 is preferably concentric relative to the outer socket surface 340. However, those skilled in the art will appreciate that it is not necessary that the second socket surface 332 be provided with a curved socket surface 333 or that the curved socket surface 333 be concentric relative to the outer socket surface 340. The second socket surface 332 may be provided with any surface, and the curved socket surface 333 of the preferred embodiment may assume any shape so long as the second socket surface 332 cooperates with the opening of an engine workpiece.

Figure 46:
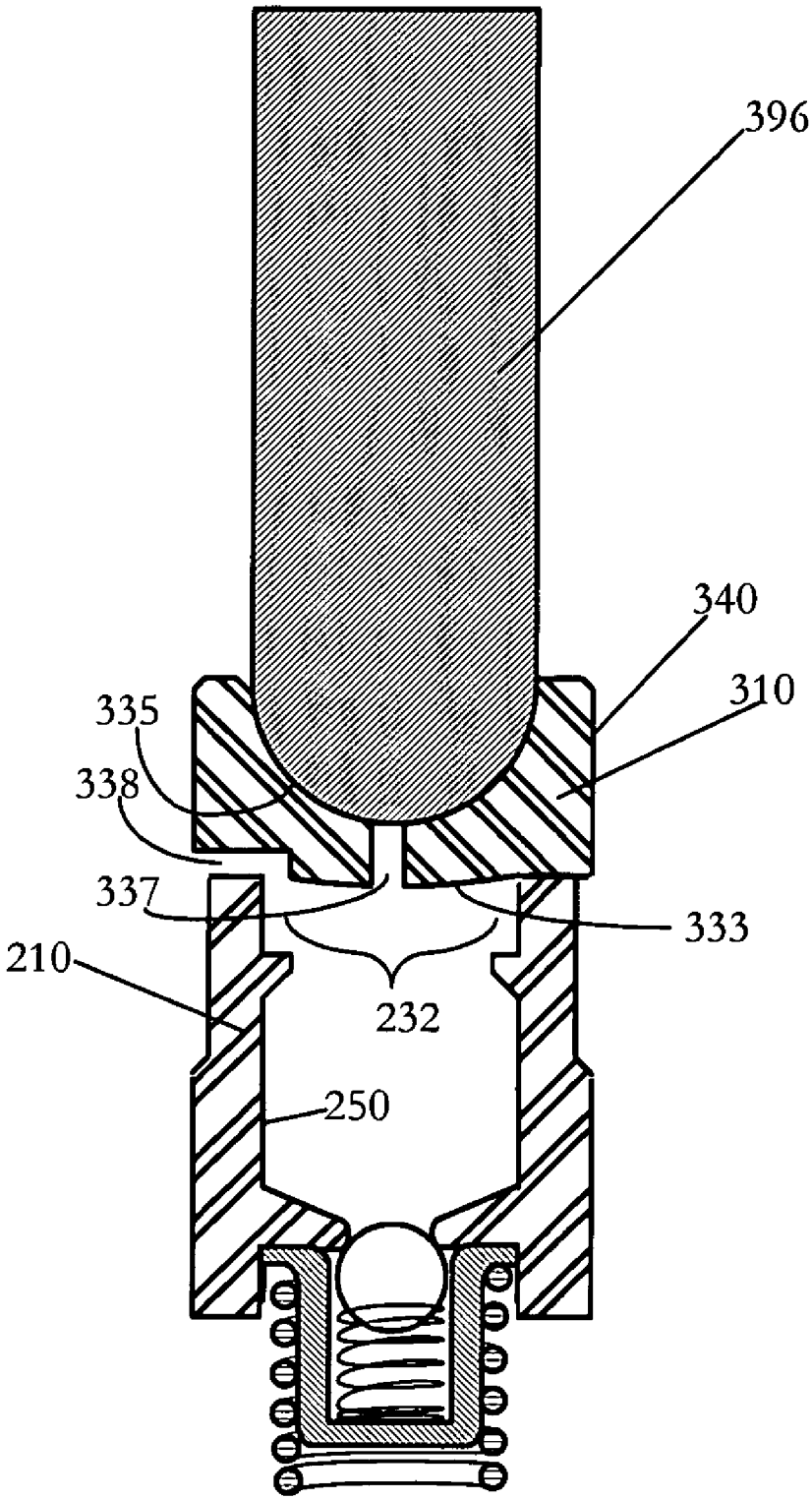
FIG. 46 depicts an embodiment of a socket accommodating an engine work piece.

Referring now to FIG. 46, the first socket surface 331 is depicted accommodating an insert. As shown in FIG. 46, that insert is a push rod 396. The second socket surface 332 is further depicted cooperating with an engine workpiece. Those skilled in the art will appreciate that the engine workpiece can be a leakdown plunger, such as that disclosed in Applicants' "Leakdown Plunger," application Ser. No. 10/274,519 filed on Oct. 18, 2002. As depicted in FIG. 46, in the preferred embodiment the engine workpiece is the leakdown plunger 210. Those skilled in the art will appreciate that push rods other than the push rod 396 shown herein can be used without departing from the scope and spirit of the present invention. Furthermore, those skilled in the art will appreciate that leakdown plungers other than leakdown plunger 210 and those disclosed in Applicants' "Leakdown Plunger," application Ser. No. 10/274,519 can be used without departing from the scope and spirit of the present invention.

As depicted in FIG. 46, the curved socket surface 333 preferably cooperates with the second plunger opening 232 of the leakdown plunger 210. According to one aspect of the present invention, the curved socket surface 333 preferably corresponds to the second plunger opening 232 of the leakdown plunger 210. According to another aspect of the present invention, the curved socket surface 333 preferably provides a closer fit between the second socket surface 332 of the socket 310 and second plunger opening 232 of the leakdown plunger 210.

In the socket 310 depicted in FIG. 46, a socket passage 337 is provided. The socket passage 337 preferably functions to lubricate the push rod cooperating surface 335. The embodiment depicted in FIG. 46 is also provided with a plunger reservoir passage 338. The plunger reservoir passage 338 is configured to conduct fluid, preferably a lubricant.

The plunger reservoir passage 338 performs a plurality of functions. According to one aspect of the present invention, the plunger reservoir passage 338 fluidly links the second plunger opening 232 of the leakdown plunger 210 and the outer socket surface 340 of the socket 310. According to another aspect of the present invention, the plunger reservoir passage 338 fluidly links the inner plunger surface 250 of the leakdown plunger 210 and the outer socket surface 340 of the socket 310.

Those skilled in the art will appreciate that the plunger reservoir passage 338 can be extended so that it joins socket passage 337 within the socket 310. However, it is not necessary that the socket passage 337 and plunger reservoir passage 338 be joined within the socket 310. As depicted in FIG. 46, the plunger reservoir passage 338 of an embodiment of the present invention is fluidly linked to socket passage 337. Those skilled in the art will appreciate that the outer socket surface 340 is fluidly linked to the first socket surface 331 in the embodiment depicted in FIG. 46.

Figure 47:
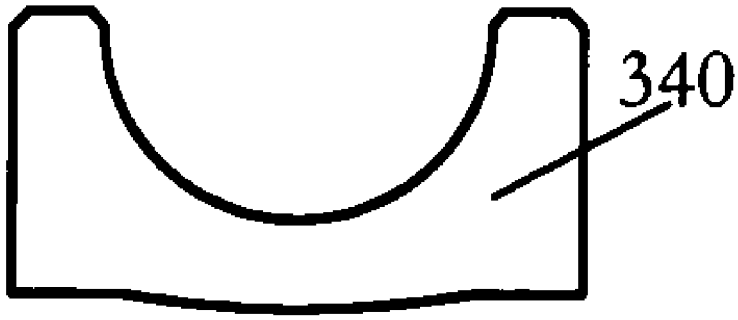
FIG. 47 depicts an outer surface of an embodiment of a socket.

As depicted in FIG. 47, socket 310 of the preferred embodiment is provided with an outer socket surface 340. The outer socket surface 340 is configured to cooperate with the inner surface of an engine workpiece. The outer socket surface 340 of the presently preferred embodiment is cylindrically shaped. However, those skilled in the art will appreciate that the outer socket surface 340 may assume any shape so long as it is configured to cooperate with the inner surface of an engine workpiece.

Figure 48:
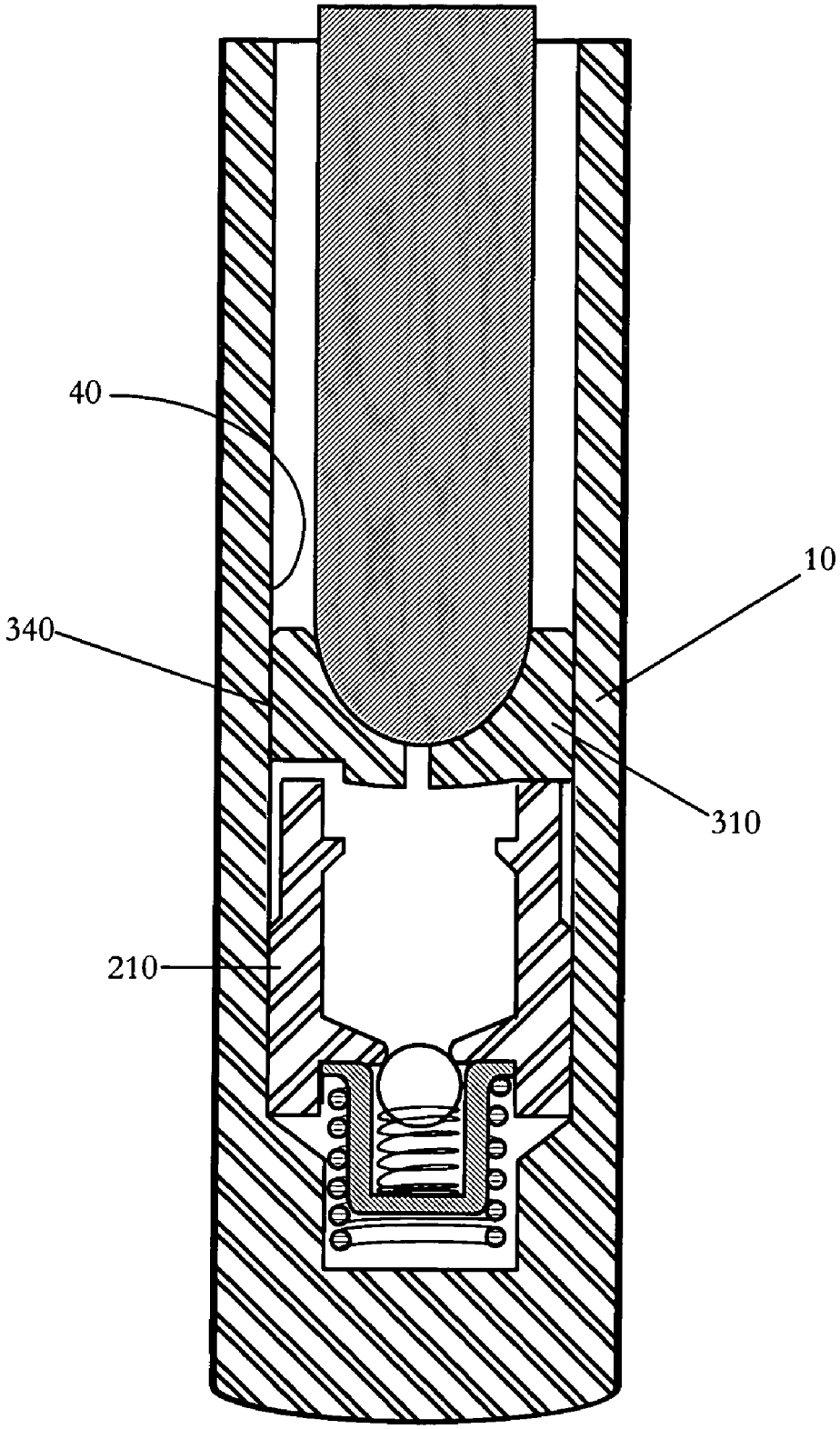
FIG. 48 depicts an embodiment of a socket cooperating with an engine work piece.

FIG. 48 depicts the outer socket surface 340 configured to cooperate with the inner surface of an engine workpiece. The outer socket surface 340 is configured to cooperate with a lash adjuster body. As shown in FIG. 48, the outer socket surface 340 is preferably configured to cooperate with the inner surface 40 of the lash adjuster 10.

The adjusting body 10, with the socket 310 of the present invention located therein, may be inserted into a roller follower body, such as that disclosed in Applicants' "Roller Follower Body," application Ser. No. 10/316,261 filed on Oct. 18, 2002. as shown in FIG. 49, in the preferred embodiment the adjusting body 10, with the socket 310 of the present invention located therein, is inserted into the valve lifter body 110.

Referring now to FIGS. 50 to 54, the presently preferred method of fabricating a socket 310 is disclosed. FIGS. 50 to 54 depict what is known in the art as a "slug progression" that shows the fabrication of the present invention from a rod or wire to a finished or near-finished socket body. In the slug progression shown herein, pins are shown on the punch side; however, those skilled in the art will appreciate that the pins can be switched to the die side without departing from the scope of the present invention.

The socket 310 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 50:
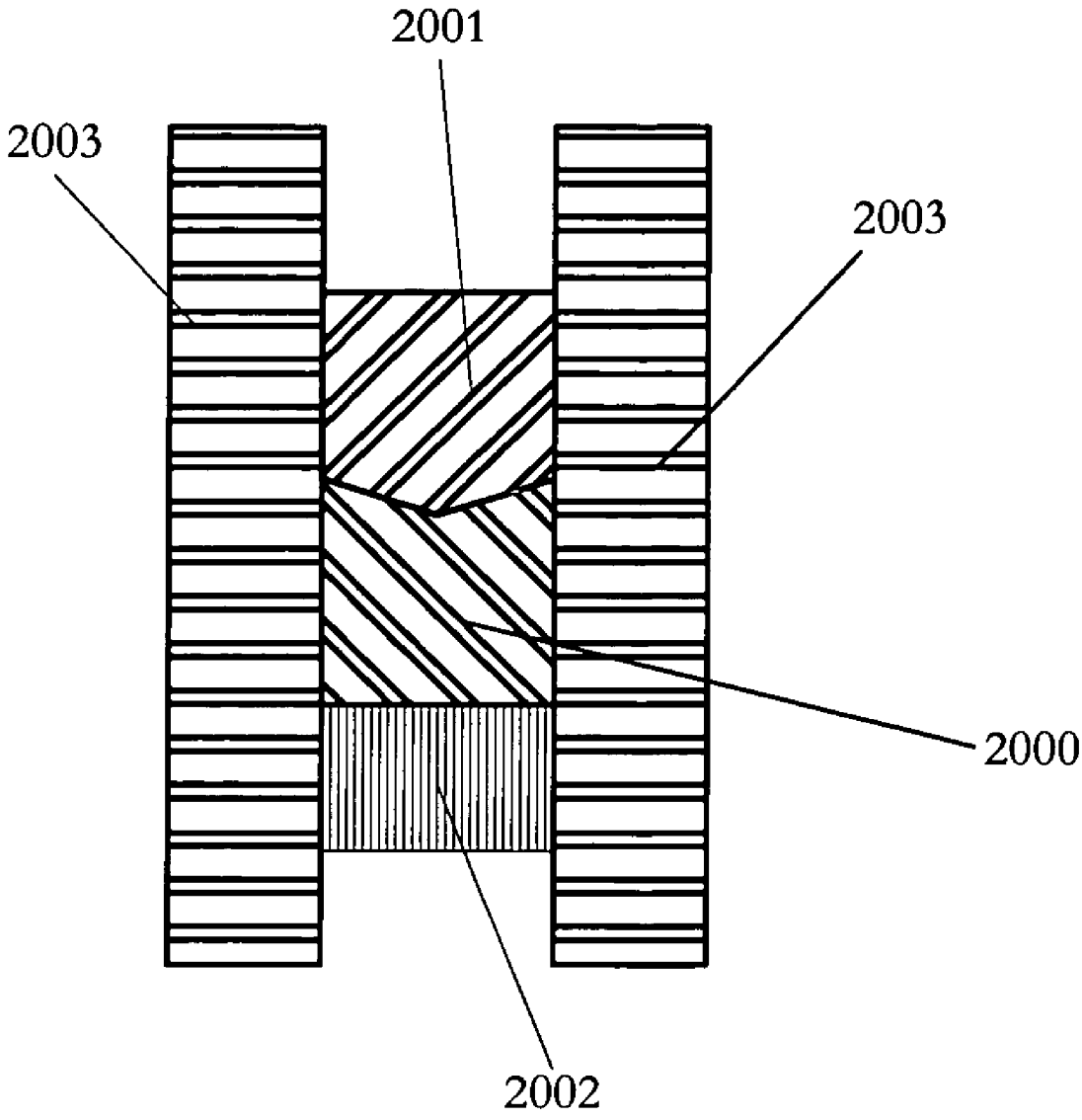
FIGS. 50–54 depict a preferred method of fabricating a socket.

The process of forging an embodiment of the present invention begins with a metal wire or metal rod 2000 which is drawn to size. The ends of the wire or rod are squared off. As shown in FIG. 50, this is accomplished through the use of a first punch 2001, a first die 2002, and a first knock out pin 2003.

Figure 51:
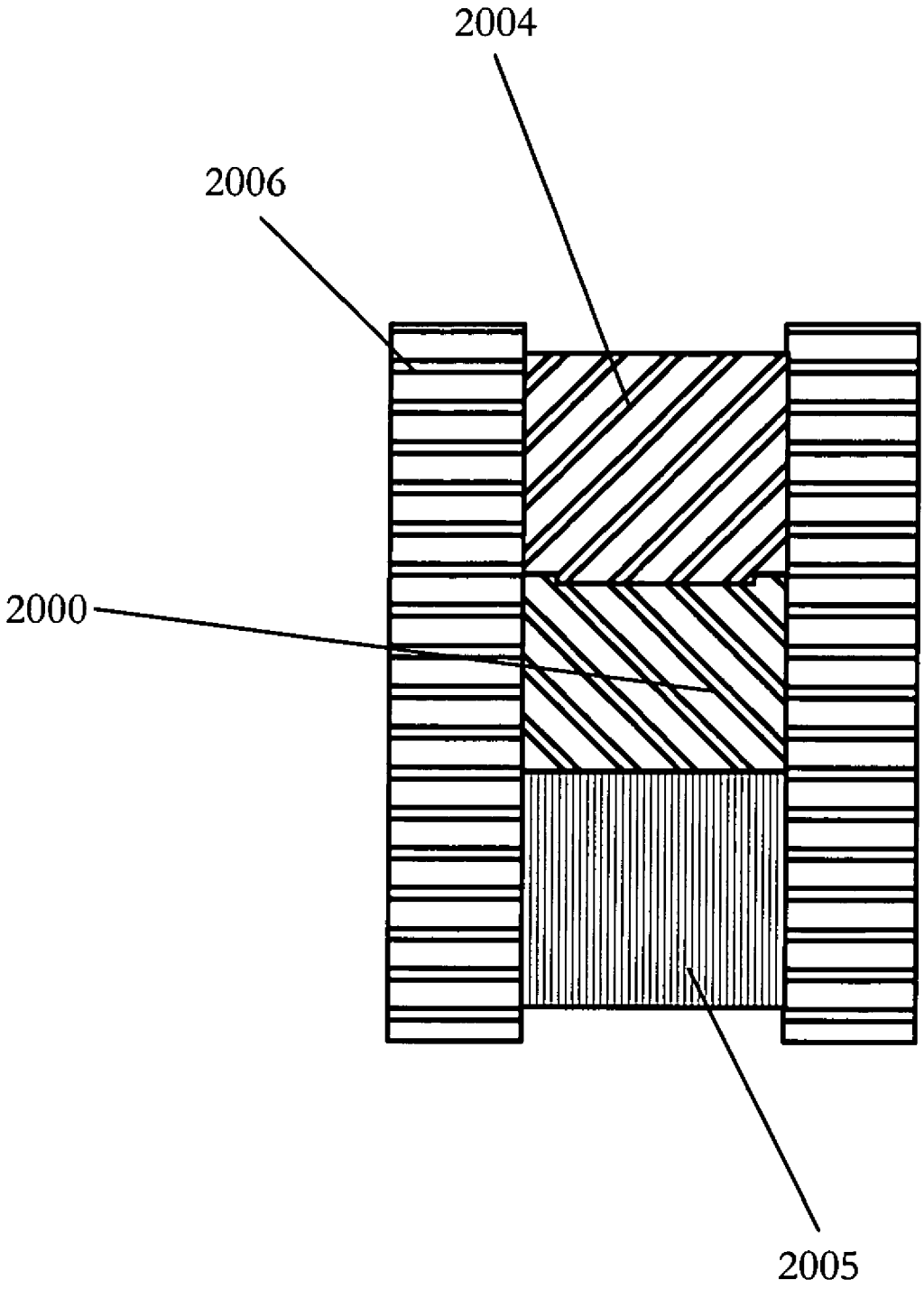

After being drawn to size, the wire or rod 2000 is run through a series of dies or extrusions. As depicted in FIG. 51, the fabrication of the first socket surface 331, the outer socket surface, and the third surface is preferably commenced through use of a second punch 2004, a second knock out pin 2005, and a second die 2006. The second punch 2004 is used to commence fabrication of the first socket surface 331. The second die 2006 is used against the outer socket surface 340. The second knock out pin 2005 is used to commence fabrication of the second socket surface 332.

Figure 52:
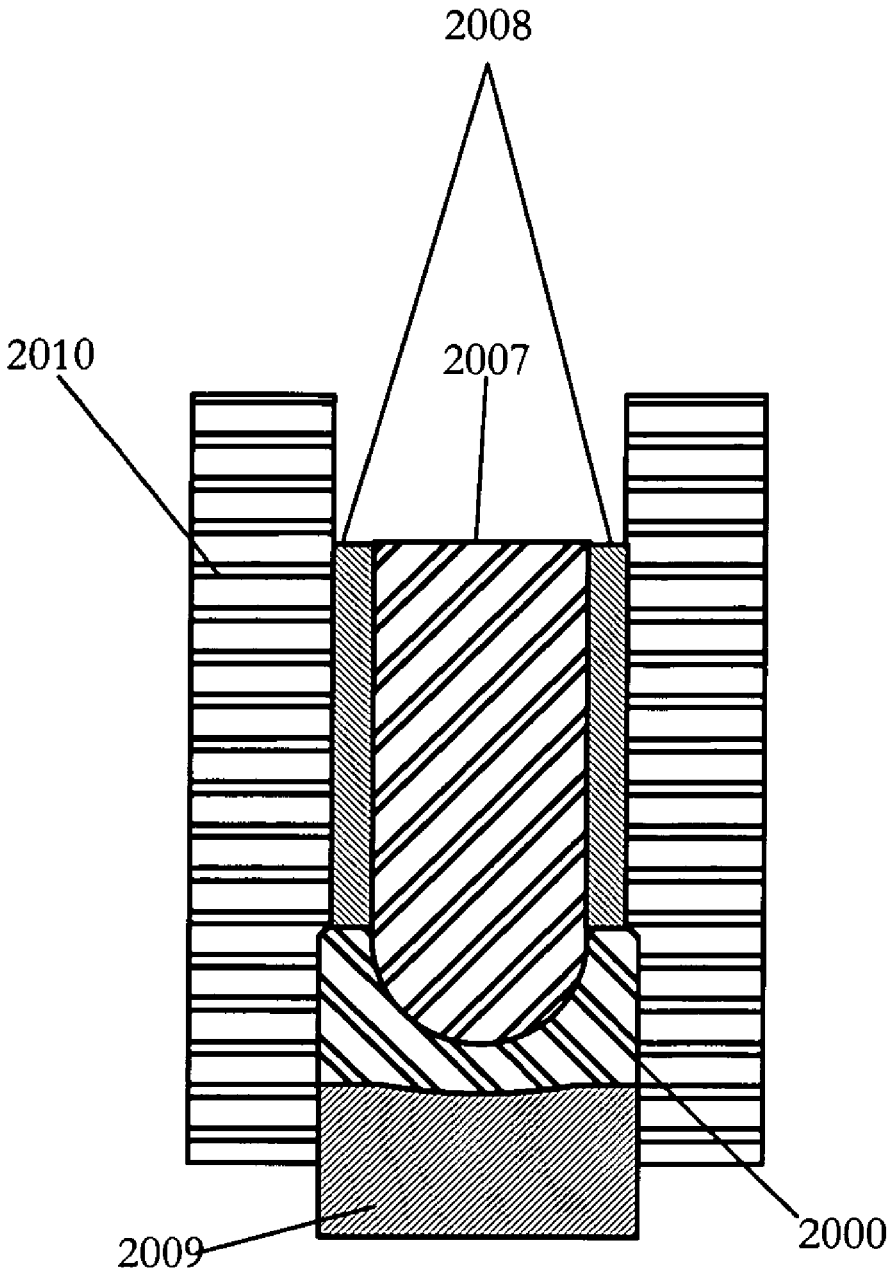

FIG. 52 depicts the fabrication of the first socket surface 331, the second socket surface 332, and the outer socket surface 340 through use of a third punch 2007, a first stripper sleeve 2008, a third knock out pin 2009, and a third die 2010. The first socket surface 331 is fabricated using the third punch 2007. The first stripper sleeve 2008 is used to remove the third punch 2007 from the first socket surface 331. The second socket surface 332 is fabricated through use of the third knock out pin 2009, and the outer socket surface 340 is fabricated through use of the third die 2010.

Figure 53:
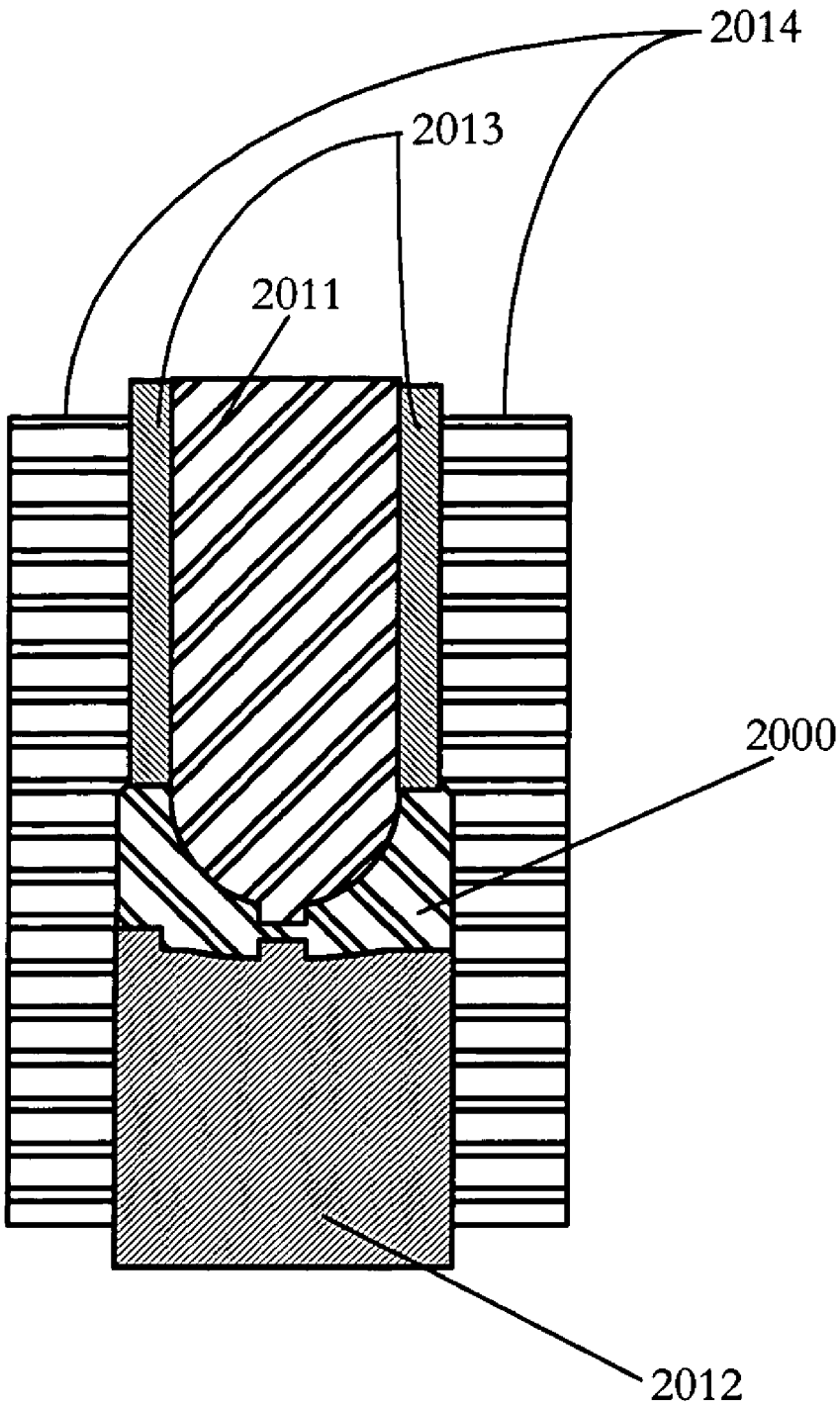

As depicted in FIG. 53, the fabrication of the socket passage 337 and plunger reservoir passage 338 is commenced through use of a punch pin 2011 and a fourth knock out pin 2012. A second stripper sleeve 2013 is used to remove the punch pin 2011 from the first socket surface 331. The fourth knock out pin 2012 is used to fabricate the plunger reservoir passage 338. A fourth die 2014 is used to prevent change to the outer socket surface 340 during the fabrication of the socket passage 337 and plunger reservoir passage 338.

Figure 54:
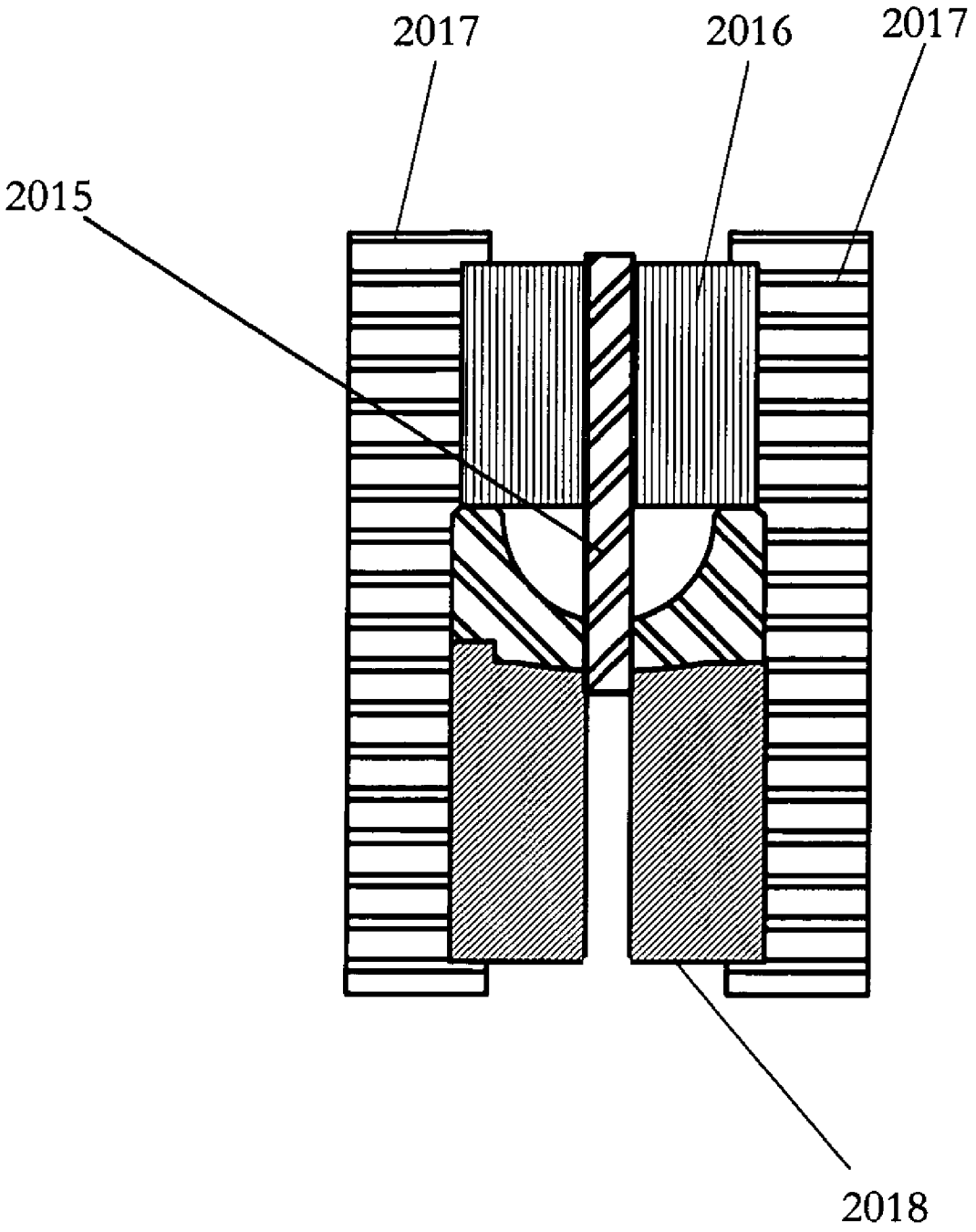

Referring now to FIG. 54, fabrication of socket passage 337 is completed through use of pin 2015. A third stripper sleeve 2016 is used to remove the pin 2015 from the first socket surface 331. A fifth die 2017 is used to prevent change to the outer socket surface 340 during the fabrication of socket passage 337. A tool insert 2018 is used to prevent change to the second socket surface 332 and the plunger reservoir passage 338 during the fabrication of socket passage 337.

Those skilled in the art will appreciate that further desirable finishing may be accomplished through machining. For example, socket passage 337 and plunger reservoir passage 338 may be enlarged and other socket passages may be drilled. However, such machining is not necessary.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A process for manufacturing a valve lifter body, comprising the steps of:

a) providing a forgeable material;

b) cold forming a first lifter cavity into the forgeable material so that:

i) the first lifter cavity extends axially into the forgeable material from a first lifter opening that is shaped to accept a roller;

ii) the first lifter cavity includes a first inner lifter surface provided with a first wall, a second wall, a third wall, a fourth wall, a first curved lifter surface, a second curved lifter surface, and a lifter surface;

iii) the first wall faces the second wall;

iv) the second wall faces the first wall;

v) the third wall extends axially into the valve lifter body from the first lifter opening, faces the fourth wall, and terminates at least in part at the second curved lifter surface;

vi) the fourth extends axially into the valve lifter body from the first lifter opening, faces the third wall, and terminates at least in part at the first curved lifter surface;

vii) the first curved lifter surface extends from the fourth wall and terminates, at least in part, at the lifter surface;

viii) the second curved lifter surface extends from the third wall and terminates, at least in part, at the lifter surface;

ix) the lifter surface is, relative to the curved lifter surfaces, generally flat and oriented to be generally orthogonal to a valve lifter axis;

c) cold forming a second lifter cavity into the forgeable material so that:

i) the second lifter cavity extends axially into the valve lifter body from a second lifter opening;

ii) the second lifter cavity includes a second inner lifter surface; and d) machining the second inner lifter surface to provide at least a portion of a lifter well.

2. The process for manufacturing a valve lifter body according to claim 1 further comprising the step of cold forming a socket body.

3. The process for manufacturing a valve lifter body according to claim 1 further comprising the step of cold forming a leakdown plunger.

4. The process for manufacturing a valve lifter body according to claim 1 further comprising the steps of:

a) providing the valve lifter body with a first end;

b) providing the valve lifter body with a second end;

c) cold forming an outer lifter surface onto the forgeable material; and d) cold forming an undercut lifter surface into the outer lifter surface so that the undercut lifter surface extends from the second end of the valve lifter body.

5. The process for manufacturing a valve lifter body according to claim 1 further comprising the steps of:

a) providing the valve lifter body with a first end;

b) providing the valve lifter body with a second end;

c) cold forming an outer lifter surface onto the forgeable material;

d) machining a first cylindrical lifter surface into the outer lifter surface so that the first cylindrical lifter surface is provided with a first radius; and e) machining a second cylindrical lifter surface into the outer lifter surface so that the second cylindrical lifter surface extends from the second end of the valve lifter body and is provided with a second radius.

6. The process for manufacturing a valve lifter body according to claim 1 further comprising the steps of:

a) cold forming the forgeable material to provide an outer surface, a first end, and a second end; and b) cold forming the second end to provide a generally cylindrical surface having a reduced diameter relative to the outer surface.

7. The process for manufacturing a valve lifter body according to claim 1 wherein the step of cold forming the second lifter cavity into the forgeable material provides the lifter well and a lead surface.

8. The process for manufacturing a valve lifter body according to claim 1 wherein the step of cold forming the first lifter cavity into the forgeable material further includes providing the lifter surface with a generally circular shape.

9. The process for manufacturing a valve lifter body according to claim 1 wherein the step of cold forming the first lifter cavity into the forgeable material further includes providing the lifter surface with a generally rectangular shape.

10. The process for manufacturing a valve lifter body according to claim 1 wherein the step of machining the second inner surface further includes providing a lead surface that extends radially from the lifter well and terminates, at least in part, at the second inner surface of the second lifter cavity.

11. The process for manufacturing a valve lifter body according to claim 1 wherein the step of cold forming the second lifter cavity into the forgeable material further includes providing at least a portion of the lifter well and a lead surface that is frusto-conical in shape.

12. The process of claim 1 wherein the step of cold forming the first lifter cavity further includes:

a) providing a first angled wall, a second angled wall, a third angled wall, and a fourth angled wall that extend axially into the forgeable material from the first lifter opening;

b) providing a first angled lifter surface so that it is located adjacent to the first wall, the fourth wall, and the first angled wall;

c) providing a second angled lifter surface so that it is located adjacent to the first wall, third wall, and the fourth angled wall;

d) providing a third angled lifter surface so that it is located adjacent to the second wall, the third wall, and the second angled wall;

e) providing a fourth angled lifter surface so that it is located adjacent to the second wall, the fourth wall, and the third angled wall;

f) cold forming the first angled wall so that it terminates, at least in part, at the first angled lifter surface;

g) cold forming the second angled wall so that it terminates, at least in part, at the third angled lifter surface;

h) cold forming the third angled wall so that it terminates, at least in part, at the fourth angled lifter surface;

i) cold forming the fourth angled wall so that it terminates, at least in part, at the second angled lifter surface; and j) cold forming at least one of the angled lifter surfaces so that it extends from at least one of the angled walls towards the valve lifter axis and is oriented to be at an angle relative to a plane that is orthogonal to the valve lifter axis, the angle measuring between twenty-five and about ninety degrees.

13. The process of claim 1 further comprising the steps of:

a) cold forming at least in part a lash adjuster body;

b) cold forming at least in part a socket body; and c) cold forming at least in part a leakdown plunger.

14. The process of claim 12 further comprising the steps of:

a) cold forming at least in part a lash adjuster body;

b) cold forming at least in part a socket body;

c) cold forming at least in part a leakdown plunger;

d) machining at least a portion of the lash adjuster body so that the lash adjuster body telescopes within the valve lifter body; and e) machining at least a portion of the leakdown plunger.

15. A process for manufacturing a valve lifter body, comprising the steps of:

a) providing a forgeable material;

b) cold forming a first lifter cavity into the forgeable material so that:

i) the first lifter cavity extends axially into the forgeable material from a first lifter opening that is shaped to accept a roller;

ii) the first lifter cavity includes a first inner lifter surface provided with a first wall, a second wall, a third wall, a fourth wall, a first curved lifter surface, a second curved lifter surface, and a lifter surface;

iii) the first wall faces the second wall;

iv) the second wall faces the first wall;

v) the third wall extends axially into the valve lifter body from the first lifter opening, faces the fourth wall, and terminates at least in part at the second curved lifter surface;

vi) the fourth extends axially into the valve lifter body from the first lifter opening, faces the third wall, and terminates at least in part at the first curved lifter surface;

vii) the first curved lifter surface extends from the fourth wall and is located adjacent to the lifter surface;

viii) the second curved lifter surface extends from the third wall and is located adjacent to the lifter surface;

ix) the lifter surface is, relative to the curved lifter surfaces, generally flat and oriented to be generally orthogonal to a valve lifter axis;

c) cold forming a second lifter cavity into the forgeable material so that:

i) the second lifter cavity extends axially into the valve lifter body from a second lifter opening;

ii) the second lifter cavity includes a second inner lifter surface; and d) machining the second inner lifter surface to provide a plurality of cylindrical surfaces.

16. The process of claim 15 further comprising the step of cold forming, at least in part, a socket body.

17. The process of claim 15 further comprising the step of cold forming, at least in part, a leakdown plunger.

18. The process of claim 15 further comprising the steps of:

a) cold forming, at least in part, a socket body; and b) cold forming, at least in part, a leakdown plunger.

19. The process of claim 15 further comprising the steps of:

a) cold forming the forgeable material to provide, at least in part, a first end wherein the first lifter opening is located and a second end wherein the second lifter opening is located; and b) cold forming the forgeable material to include an undercut surface that extends from the second end.

20. The process of claim 15 wherein the step of cold forming the second lifter cavity into the forgeable material includes providing, at least in part, a lifter well.

21. The process of claim 15 further comprising the steps of:

a) providing the forgeable material with an outer lifter surface; and b) machining the outer lifter surface, at least in part, to provide a first cylindrical surface and a second cylindrical surface wherein the first cylindrical surface is provided with a first radius and the second cylindrical surface is provided with a second radius that is smaller than the first radius.

22. The process of claim 15 further comprising the steps of:

a) providing the forgeable material with an outer lifter surface; and b) cold forming the forgeable material to provide, at least in part, a cylindrical surface with a reduced diameter located on the outer surface.

23. The process of claim 15 wherein the step of machining the second inner lifter surface further includes providing, at least in part, a lifter well that is generally cylindrical in shape with a diameter that is smaller than a diameter of the second inner lifter surface.

24. A process for manufacturing a valve lifter body that includes a valve lifter axis, comprising the steps of:

a) providing a forgeable material;

b) cold forming a first lifter cavity into the forgeable material so that:

i) a first end is provided wherein the first end includes a first lifter opening shaped to accept a roller;

ii) the first lifter cavity includes a first inner lifter surface provided with a first wall, a second wall, a third wall, a fourth wall, a first curved lifter surface, a second curved lifter surface, and a lifter surface;

iii) the walls extend axially into the forgeable material from the first lifter opening and are positioned so that:

1) the first wall faces the second wall;

2) the second wall faces the first wall;

3) the third wall extends axially into the valve lifter body from the first lifter opening, faces the fourth wall, and is located adjacent to the second curved lifter surface;

4) the fourth wall extends axially into the valve lifter body from the first lifter opening, faces the third wall and is located adjacent to the first curved lifter surface;

iv) the first curved lifter surface extends from the fourth wall and is located adjacent to the lifter surface;

v) the second curved lifter surface extends from the third wall and is located adjacent to the lifter surface;

vi) the lifter surface is, relative to the curved lifter surfaces, generally flat and oriented to be generally orthogonal to a valve lifter axis;

c) cold forming a second lifter cavity into the forgeable material so that:

i) a second end is provided wherein the second end includes a second lifter opening that is generally cylindrical in shape;

ii) the second lifter cavity extends axially into the valve lifter body from the second lifter opening;

iii) the second lifter cavity includes a second inner lifter surface;

d) heat-treating the valve lifter body; and e) machining the second inner lifter surface to provide a plurality of cylindrical surfaces.

25. The process of claim 24 further comprising the step of cold forming, at least in part, a socket body.

26. The process of claim 24 further comprising the step of cold forming, at least in part, a leakdown plunger.

27. The process of claim 24 further comprising the steps of:

a) cold forming, at least in part, a socket body; and b) cold forming, at least in part, a leakdown plunger.

28. The process of claim 24 further comprising the step of cold forming the forgeable material to include an undercut surface that extends from the second end.

29. The process of claim 24 wherein the step of cold forming the second lifter cavity into the forgeable material includes providing, at least in part, a lifter well.

30. The process of claim 24 further comprising the steps of:

a) providing the forgeable material with an outer lifter surface; and b) machining the outer lifter surface, at least in part, to provide a first cylindrical surface and a second cylindrical surface wherein the first cylindrical surface is provided with a first radius and the second cylindrical surface is provided with a second radius that is smaller than the first radius.

31. The process of claim 24 further comprising the steps of:

a) providing the forgeable material with an outer lifter surface; and b) cold forming the forgeable material to provide, at least in part, a cylindrical surface with a reduced diameter located on the outer surface.

32. The process of claim 24 wherein the step of machining the second inner lifter surface further includes providing, at least in part, a lifter well that is generally cylindrical in shape with a diameter that is smaller than a diameter of the second inner lifter surface.

33. A process for manufacturing a valve lifter body that includes a valve lifter axis, a first lifter cavity with a first inner lifter surface extending from a first lifter opening located at a first end, and a second lifter cavity with a second inner lifter surface extending from a second lifter opening located at a second end, wherein the first inner lifter surface includes a first wall, a second wall, a third wall, a fourth wall, a first angled wall, a second angled wall, a third angled wall, fourth angled wall, a first angled lifter surface, a second angled lifter surface, a third angled lifter surface, and a fourth angled lifter surface, the process for manufacturing the valve lifter body comprising the steps of:

a) providing a forgeable material;

b) cold forming the walls, the angled walls, and the angled lifter surfaces so that:

i) the walls extend axially into the forgeable material from the first lifter opening and are positioned so that the first wall faces the second wall and the third wall faces the fourth wall;

ii) the first angled lifter surface is located adjacent to the first wall and the fourth wall;

iii) the second angled lifter surface is located adjacent to the first wall and the third wall;

iv) the third angled lifter surface is located adjacent to the second wall and the third wall;

v) the fourth angled lifter surface is located adjacent to the second wall and the fourth wall;

vi) the first angled wall extends axially into the forgeable material from the first lifter opening and terminates, at least in part, at the first angled lifter surface;

vii) the second angled wall extends axially into the valve lifter body from the first lifter opening and terminates, at least in part, at the third angled lifter surface;

viii) the third angled wall extends axially into the valve lifter body from the first lifter opening and terminates, at least in part, at the fourth angled lifter surface;

ix) the fourth angled wall extends axially into the valve lifter body from the first lifter opening and terminates, at least in part, at the second angled lifter surface;

c) cold forming the second lifter cavity into the forgeable material so that the second lifter cavity extends axially into the forgeable material from the second lifter opening and includes a second inner lifter surface that is generally cylindrical in shape;

d) heat treating the valve lifter body; and e) machining the second inner lifter surface of the second lifter cavity to provide a plurality of generally cylindrical surfaces.

34. The process of claim 33 wherein the step of cold forming the walls, the angled walls, and the angled lifter surfaces further includes orienting at least one of the angled lifter surfaces to be at an angle relative to a plane that is orthogonal to the valve lifter axis, the angle measuring between twenty-five and about ninety degrees.

35. The process of claim 33 wherein the step of cold forming the walls, the angled walls, and the angled lifter surfaces further includes orienting the fourth angled lifter surface to extend from the third angled wall at an angle relative to a plane that is orthogonal to the valve lifter axis measuring between 45 degrees and 65 degrees.

36. The process of claim 33 further comprising the steps of:

a) providing a combustion engine;

b) cold forming, at least in part, a lash adjuster body;

c) locating the lash adjuster body within the valve lifter body so that the lash adjuster body telescopes within the valve lifter body; and d) locating the valve lifter body within the combustion engine where it functions, at least in part, to operate a valve.

37. The process of claim 33 wherein the step of cold forming the walls, the angled walls, and the angled lifter surfaces further includes orienting at least one of the angled lifter surfaces to extend from at least one of the angled walls at an angle relative to a plane that is orthogonal to the valve lifter axis measuring between 25 degrees and 75 degrees.

38. The process of claim 33 wherein the step of cold forming the walls, the angled walls, and the angled lifter surfaces further includes orienting at least one of the angled to be at an angle relative to a plane that is orthogonal to the valve lifter axis.

39. The process of claim 33 wherein the step of cold forming the walls, the angled walls, and the angled lifter surfaces further includes providing a first curved lifter surface and a second curved lifter surface so that:

a) the fourth wall extends axially into the forgeable material from the first lifter opening and terminates, at least in part, at the first curved lifter surface; and b) the third wall extends axially into the forgeable material from the first lifter opening and terminates, at least in part, at the second curved lifter surface.

40. The process of claim 33 wherein the step of cold forming the walls, the angled walls, and the angled lifter surfaces further includes providing a first curved lifter surface and a second curved lifter surface so that:

a) the fourth wall extends axially into the valve lifter body from the first lifter opening and terminates, at least in part, at the first curved lifter surface;

b) the third wall extends axially into the valve lifter body from the first lifter opening and terminates, at least in part, at the second curved lifter surface;

c) the first angled lifter surface is located adjacent to the first wall, the fourth wall, the first angled wall, and the first curved lifter surfaces;

d) the second angled lifter surface is located adjacent to the first wall, third wall, the fourth angled wall, and the second curved lifter surface;

e) the third angled lifter surface is located adjacent to the second wall, the third wall, the second angled wall, and the second curved lifter surface; and f) the fourth angled lifter surface is located adjacent to the second wall, the fourth wall, the third angled wall, and the first curved lifter surface.

41. The process of claim 33 wherein the step of cold forming the walls, the angled walls, and the angled lifter surfaces further includes:

a) providing the first angled lifter surface so that it is located adjacent to the first wall, the fourth wall, and the first angled wall;

b) providing the second angled lifter surface so that it is located adjacent to the first wall, third wall, and the fourth angled wall;

c) providing the third angled lifter surface so that it is located adjacent to the second wall, the third wall, and the second angled wall;

d) providing the fourth angled lifter surface so that it is located adjacent to the second wall, the fourth wall, and the third angled wall;

e) providing at least one of the angled lifter surfaces so that it extends from at least one of the angled walls towards the valve lifter axis; and f) orienting at least one of the angled lifter surfaces to be at an angle relative to a plane that is orthogonal to the valve lifter axis, the angle measuring between twenty-five and about ninety degrees.

42. The process of claim 33 further comprising the steps of:

a) cold forming at least in part a lash adjuster body;

b) cold forming at least in part a socket body; and c) cold forming at least in part a leakdown plunger.

43. The process of claim 42 further comprising the steps of:

a) machining at least a portion of the lash adjuster body so that the lash adjuster body telescopes within the valve lifter body; and b) machining at least a portion of the leakdown plunger.

44. A process for manufacturing a valve lifter body that includes a valve lifter axis, comprising the steps of:

a) providing a forgeable material;

b) cold forming a first lifter cavity into the forgeable material so that i) the forgeable material is provided with a first lifter opening that is shaped to accept a roller;

ii) the first lifter cavity extends axially into the forgeable material from the first lifter opening and includes a first inner lifter surface that is provided with a first wall, a second wall, a third wall, a fourth wall, a first angled wall, a second angled wall, a third angled wall, fourth angled wall, a first curved lifter surface, a second curved lifter surface, and a lifter surface;

iii) the first wall and the second wall extend axially into the forgeable from the first lifter opening and are positioned so that the first wall faces the second wall;

iv) the third wall extends axially into the forgeable material from the first lifter opening and terminates, at least in part, at the second curved lifter surface;

v) the fourth wall extends axially into the forgeable material from the first lifter opening and terminates, at least in part, at the first curved lifter surface;

vi) the third wall and the fourth wall are positioned so that the third wall faces the fourth wall;

vii) the first angled wall extends axially into the forgeable material from the first lifter opening, faces the second angled wall, and is located between the fourth wall and the first wall;

viii) the second angled wall extends axially into the forgeable material from the first lifter opening, faces the first angled wall, and is located between the second wall and the third wall;

ix) the third angled wall extends axially into the forgeable material from the first lifter opening, faces the fourth angled wall, and is located between the second wall and the fourth forth wall;

x) the fourth angled wall extends axially into the forgeable material from the first lifter opening, faces the third angled wall, and is located between the first wall and the third wall;

xi) the first and second curved lifter surfaces are, at least in part, located adjacent to the lifter surface, which is, relative to the curved lifter surfaces, generally flat and oriented to be generally orthogonal to the valve lifter axis;

c) cold forming a second lifter cavity into the forgeable material so that i) the forgeable material is provided with a second lifter opening;

ii) the second lifter cavity extends axially into the forgeable material from the second lifter opening and includes a second inner lifter surface; and d) machining the second inner lifter surface to provide a plurality of cylindrical surfaces.

45. The process of claim 44 further comprising the step of cold forming, at least in part, a socket body.

46. The process of claim 44 further comprising the step of cold forming, at least in part, a leakdown plunger.

47. The process of claim 44 further comprising the steps of:

a) cold forming, at least in part, a socket body; and b) cold forming, at least in part, a leakdown plunger.

48. The process of claim 44 further comprising the steps of:

a) cold forming the forgeable material to provide, at least in part, a first end wherein the first lifter opening is located and a second end wherein the second lifter opening is located; and b) cold forming the forgeable material to include an undercut surface that extends from the second end.

49. The process of claim 44 wherein the step of cold forming the second lifter cavity includes providing, at least in part, a lifter well.

50. The process of claim 44 further comprising the steps of:

a) providing the forgeable material with an outer lifter surface; and b) machining the outer lifter surface, at least in part, to provide a first cylindrical surface and a second cylindrical surface wherein the first cylindrical surface is provided with a first radius and the second cylindrical surface is provided with a second radius that is smaller than the first radius.

51. The process of claim 44 further comprising the steps of:

a) providing the forgeable material with an outer lifter surface; and b) cold forming the forgeable material to provide, at least in part, a cylindrical surface with a reduced diameter located on the outer surface.

52. The process of claim 44 wherein the step of machining the second inner lifter surface further includes providing, at least in part, a lifter well that is generally cylindrical in shape with a diameter that is smaller than a diameter of the second inner lifter surface.

53. The process of claim 44 wherein the step of cold forming the first lifter cavity further includes providing the lifter surface with a generally circular shape.

54. The process of claim 44 wherein the step of cold forming the first lifter cavity further includes providing the lifter surface with a generally rectangular shape.

55. The process of claim 44 wherein the first lifter opening is a chamfered opening that has been fabricated, at least in part, through cold forming.

56. The process of claim 44 further comprising the steps of:

a) providing a combustion engine;

b) cold forming, at least in part, a lash adjuster body;

c) locating the lash adjuster body within the valve lifter body so that the lash adjuster body telescopes within the valve lifter body; and d) locating the valve lifter body within the combustion engine where it functions, at least in part, to operate a valve.

57. The process of claim 44 wherein the step of cold forming the first lifter cavity further includes:

a) providing a first angled lifter surface so that is located adjacent to the first wall, the fourth wall, and the first angled wall;

b) providing a second angled lifter surface so that it is located adjacent to the first wall, third wall, and the fourth angled wall;

c) providing a third angled lifter surface so that it is located adjacent to the second wall, the third wall, and the second angled wall;

d) providing a fourth angled lifter surface so that it is located adjacent to the second wall, the fourth wall, and the third angled wall;

e) providing at least one of the angled lifter surfaces so that it extends from at least one of the angled walls towards the valve lifter axis; and f) orienting at least one of the angled lifter surfaces to be at an angle relative to a plane that is orthogonal to the valve lifter axis, the angle measuring between twenty-five and about ninety degrees.

58. The process of claim 44 further comprising the steps of:

a) cold forming at least in part a lash adjuster body;

b) cold forming at least in part a socket body; and c) cold forming at least in part a leakdown plunger.

59. The process of claim 44 further comprising the steps of:

a) machining at least a portion of the lash adjuster body so that the lash adjuster body telescopes within the valve lifter body; and b) machining at least a portion of the leakdown plunger.

60. A process for manufacturing a valve lifter body that includes a valve lifter axis, a first lifter cavity with a first inner lifter surface extending from a first lifter opening located at a first end, and a second lifter cavity with a second inner lifter surface extending from a second lifter opening located at a second end, wherein the first inner lifter surface includes a first wall, a second wall, a third wall, a fourth wall, a first curved lifter surface, a second curved lifter surface, and a lifter surface, the process for manufacturing the valve lifter body comprising the steps of:

a) providing a forgeable material;

b) cold forming the walls, the curved lifter surfaces, and the lifter surface into the forgeable material so that:

i) the first wall faces the second wall;

ii) the second wall faces the first wall;

iii) the third wall extends axially into the forgeable material from the first lifter opening, faces the fourth wall, and terminates, at least in part, at the second curved surface;

iv) the fourth wall extends axially into the forgeable material from the first lifter opening, faces the third wall, and terminates, at least in part, at the first curved surface;

v) the first curved lifter surface extends from the fourth wall and terminates, at least in part, at the lifter surface;

vi) the second curved lifter surface extends from the third wall and terminates, at least in part, at the lifter surface;

vii) the lifter surface is, relative to the curved lifter surfaces, generally flat and oriented to be generally orthogonal to the valve lifter axis;

c) cold forming the second lifter cavity into the forgeable material so that the second lifter cavity extends axially into the forgeable material from the second lifter opening and includes a second inner lifter surface that is generally cylindrical in shape; and d) machining the second inner lifter surface of the second lifter cavity to provide a plurality of generally cylindrical surfaces.

61. The process of claim 60 further comprising the step of cold forming, at least in part, a socket body.

62. The process of claim 60 further comprising the step of cold forming, at least in part, a leakdown plunger.

63. The process of claim 60 further comprising the steps of:

a) cold forming, at least in part, a socket body; and b) cold forming, at least in part, a leakdown plunger.

64. The process of claim 60 further comprising the steps of cold forming the forgeable material to include an undercut surface that extends from the second end.

65. The process of claim 60 wherein the step of cold forming the second lifter cavity includes providing, at least in part, a lifter well.

66. The process of claim 60 further comprising the steps of:

a) providing the forgeable material with an outer lifter surface; and b) machining the outer lifter surface, at least in part, to provide a first cylindrical surface and a second cylindrical surface wherein the first cylindrical surface is provided with a first radius and the second cylindrical surface is provided with a second radius that is smaller than the first radius.

67. The process of claim 60 further comprising the steps of:

a) providing the forgeable material with an outer lifter surface; and b) cold forming the forgeable material to provide, at least in part, a cylindrical surface with a reduced diameter located on the outer surface.

68. The process of claim 60 wherein the step of machining the second inner lifter surface further includes providing, at least in part, a lifter well that is generally cylindrical in shape with a diameter that is smaller than a diameter of the second inner lifter surface.

69. The process of claim 60 wherein the step of cold forming the walls, the curved lifter surfaces, and the lifter surface further includes providing the lifter surface with a generally circular shape.

70. The process of claim 60 wherein the step of cold forming the walls, the curved lifter surfaces, and the lifter surface further includes providing the lifter surface with a generally rectangular shape.

71. The process of claim 60 wherein the first lifter opening is a chamfered opening that has been fabricated, at least in part, through cold forming.

72. A valve lifter body, comprising:

a) a forgeable material;

b) a first lifter cavity that has been cold formed into the forgeable material so that:

i) the first lifter cavity extends axially into the forgeable material from a first lifter opening that is shaped to accept a roller;

ii) the first lifter cavity includes a first inner lifter surface provided with a first wall, a second wall, a third wall, a fourth wall, a first curved lifter surface, a second curved lifter surface, and a lifter surface;

iii) the first wall faces the second wall;

iv) the second wall faces the first wall;

v) the third wall extends axially into the valve lifter body from the first lifter opening, faces the fourth wall, and terminates at least in part at the second curved lifter surface;

vi) the fourth extends axially into the valve lifter body from the first lifter opening, faces the third wall, and terminates at least in part at the first curved lifter surface;

vii) the first curved lifter surface extends from the fourth wall and terminates, at least in part, at the lifter surface;

viii) the second curved lifter surface extends from the third wall and terminates, at least in part, at the lifter surface;

ix) the lifter surface is, relative to the curved lifter surfaces, generally flat and oriented to be generally orthogonal to a valve lifter axis;

c) a second lifter cavity that has been cold formed into the forgeable material so that:

i) the second lifter cavity extends axially into the valve lifter body from a second lifter opening;

ii) the second lifter cavity includes a second inner lifter surface; and d) the second inner lifter surface has been machined, at least in part, to provide at least a portion of a lifter well.

73. The valve lifter body of claim 72 further comprising a socket body that has, at least in part, been fabricated through cold forming.

74. The valve lifter body according of claim 72 further comprising a leakdown plunger that has, at least in part, been fabricated through cold forming.

75. The valve lifter body of claim 72 further comprising:

a) a first end;

b) a second end;

c) an outer lifter surface that has, at least in part, been cold formed onto the forgeable material; and d) an undercut lifter surface that has, at least in part, been cold formed into the outer lifter surface so that the undercut lifter surface extends from the second end of the valve lifter body.

76. The valve lifter body of claim 72 further comprising:

a) a first end;

b) a second end;

c) an outer lifter surface that has, at least in part, been cold formed onto the forgeable material;

d) a first cylindrical lifter surface that has, at least in part, been machined into the outer lifter surface so that the first cylindrical lifter surface is provided with a first surface; and e) a second cylindrical lifter surface that has, at least in part, been machined into the outer lifter surface so that the second cylindrical lifter surface extends from the second end of the valve lifter body and is provided with a second radius.

77. The valve lifter body of claim 72 further comprising:

a) an outer surface, a first end, and a second end that have, at least in part, been cold formed into forgeable material; and b) a generally cylindrical surface having a reduced diameter relative to the outer surface that has, at least in part, been cold formed at the second end.

78. The valve lifter body of claim 72 wherein the second lifter cavity has, at least in part, been cold formed into the forgeable material to provide the lifter well and a lead surface.

79. The valve lifter body of claim 72 wherein the first lifter cavity has, at least in part, been cold formed into the forgeable material to provide the lifter surface with a generally circular shape.

80. The valve lifter body of claim 72 wherein the first lifter cavity has, at least in part, been cold formed into the forgeable material to provide the lifter surface with a generally rectangular shape.

81. The valve lifter body of claim 72 wherein the second inner surface has, at least in part, been machined to provide a lead surface that extends radially from the lifter well and terminates, at least in part, at the second inner surface of the second lifter cavity.

82. The valve lifter body of claim 72 wherein the second lifter cavity has, at least in part, been cold formed into the forgeable material to provide at least a portion of the lifter well and a lead surface that is frusto-conical in shape.

83. The valve lifter body of claim 72 wherein the first lifter cavity has, at least in part, been cold formed to include:

a) a first angled wall, a second angled wall, a third angled wall, and a fourth angled wall that extend axially into the forgeable material from the first lifter opening;
b) a first angled lifter surface that is located adjacent to the first wall, the fourth wall, and the first angled wall;
c) a second angled lifter surface that is located adjacent to the first wall, third wall, and the fourth angled wall;
d) a third angled lifter surface that is located adjacent to the second wall, the third wall, and the second angled wall;
e) a fourth angled lifter surface that is located adjacent to the second wall, the fourth wall, and the third angled wall;
f) the first angled wall terminates, at least in part, at the first angled lifter surface;
g) the second angled wall terminates, at least in part, at the third angled lifter surface;
h) the third angled wall terminates, at least in part, at the fourth angled lifter surface;
i) the fourth angled wall terminates, at least in part, at the second angled lifter surface; and
j) at least one of the angled lifter surfaces extends from at least one of the angled walls towards the valve lifter axis and is oriented to be at an angle relative to a plane that is orthogonal to the valve lifter axis, the angle measuring between twenty-five and about ninety degrees.

84. The valve lifter body of claim 72 further comprising:

a) a lash adjuster body that has, at least in part, been fabricated through cold forming;
b) a socket body that has, at least in part, been fabricated through cold forming; and
c) a leakdown plunger that has, at least in part, been fabricated through cold forming.

85. The valve lifter body of claim 83 further comprising:

a) a lash adjuster body that has, at least in part, been fabricated through cold forming;
b) a socket body that has, at least in part, been fabricated through cold forming;
c) a leakdown plunger that has, at least in part, been fabricated through cold forming; and
d) at least a portion of the lash adjuster body has been machined so that the lash adjuster body telescopes within the valve lifter body.

86. A valve lifter body, comprising:

a) a forgeable material;
b) a first lifter cavity that has, at least in part, been cold formed into the forgeable material so that:
   i) the first lifter cavity extends axially into the forgeable material from a first lifter opening that is shaped to accept a roller;
   ii) the first lifter cavity includes a first inner lifter surface provided with a first wall, a second wall, a third wall, a fourth wall, a first curved lifter surface, a second curved lifter surface, and a lifter surface;
   iii) the first wall faces the second wall;
   iv) the second wall faces the first wall;
   v) the third wall extends axially into the valve lifter body from the first lifter opening, faces the fourth wall, and terminates at least in part at the second curved lifter surface;
   vi) the fourth extends axially into the valve lifter body from the first lifter opening, faces the third wall, and terminates at least in part at the first curved lifter surface;
   vii) the first curved lifter surface extends from the fourth wall and is located adjacent to the lifter surface;
   viii) the second curved lifter surface extends from the third wall and is located adjacent to the lifter surface;
   ix) the lifter surface is, relative to the curved lifter surfaces, generally flat and oriented to be generally orthogonal to a valve lifter axis;
c) a second lifter cavity that has, at least in part, been cold formed into the forgeable material so that:
   i) the second lifter cavity extends axially into the valve lifter body from a second lifter opening;
   ii) the second lifter cavity includes a second inner lifter surface; and
d) the second inner lifter surface has, at least in part, been machined to provide a plurality of cylindrical surfaces.

87. The valve lifter body of claim 86 further comprising a socket body that has, at least in part, been fabricated through cold forming.

88. The valve lifter body of claim 86 further comprising a leakdown plunger that has, at least in part, been fabricated through cold forming.

89. The valve lifter body of claim 86 further comprising:

a) a socket body that has, at least in part been fabricated through cold forming; and
b) a leakdown plunger that has, at least in part, been fabricated through cold forming.

90. The valve lifter body of claim 86 further comprising:

a) a first end that has, at least in part, been cold formed into the forgeable material and included the first lifter opening;
b) a second end that has, at least in part, been cold formed into the forgeable material and includes the second lifter opening; and
c) an undercut surface that has, at least in part, been cold formed to extend from the second end.

91. The valve lifter body of claim 86 wherein the second lifter cavity has, at least in part, been cold formed into the forgeable material to provide, at least in part, a lifter well.

92. The valve lifter body of claim 86 further comprising an outer lifter surface located on the forgeable material that has, at least in part, been machined to provide a first cylindrical surface and a second cylindrical surface wherein the first cylindrical surface is provided with a first radius and the second cylindrical surface is provided with a second radius that is smaller than the first radius.

93. The valve lifter body of claim 86 wherein the forgeable material has been cold formed, at least in part, to provide an outer lifter surface that includes a cylindrical surface with a reduced diameter.

94. The valve lifter body of claim 86 wherein the second inner lifter surface has been machined to provide, at least in part, a lifter well that is generally cylindrical in shape with a diameter that is smaller than a diameter of the second inner lifter surface.

95. A valve lifter body that includes a valve lifter axis, comprising:

a) a forgeable material;

b) a first lifter cavity that has been cold formed into the forgeable material so that:

i) a first end is provided wherein the first end includes a first lifter opening shaped to accept a roller;

ii) the first lifter cavity includes a first inner lifter surface provided with a first wall, a second wall, a third wall, a fourth wall, a first curved lifter surface, a second curved lifter surface, and a lifter surface;

iii) the walls extend axially into the forgeable material from the first lifter opening and are positioned so that:

1) the first wall faces the second wall;

2) the second wall faces the first wall;

3) the third wall extends axially into the valve lifter body from the first lifter opening, faces the fourth wall, and is located adjacent to the second curved lifter surface;

4) the fourth wall extends axially into the valve lifter body from the first lifter opening, faces the third wall and is located adjacent to the first curved lifter surface;

iv) the first curved lifter surface extends from the fourth wall and is located adjacent to the lifter surface;

v) the second curved lifter surface extends from the third wall and is located adjacent to the lifter surface;

vi) the lifter surface is, relative to the curved lifter surface, generally flat and oriented to be generally orthogonal to the valve lifter axis;

c) a second lifter cavity that has been cold formed into the forgeable material so that:

i) a second end is provided wherein the second end includes a second lifter opening that is generally cylindrical in shape;

ii) the second lifter cavity extends axially into the valve lifter body from the second lifter opening;

iii) the second lifter cavity includes a second inner lifter surface;

d) the valve lifter body has been heat treated; and e) the second inner lifter surface has been machined to provide a plurality of cylindrical surfaces.

96. The valve lifter body of claim 95 further comprising a socket body that has, at least in part, been fabricated through cold forming.

97. The valve lifter body of claim 95 further comprising a leakdown plunger that has, at least in part, been fabricated through cold forming.

98. The valve lifter body of claim 95 further comprising:

a) a socket body that has, at least in part, been fabricated through cold forming; and b) a leakdown plunger that has, at least in part, been fabricated through cold forming.

99. The valve lifter body of claim 95 further comprising an undercut surface that has been cold formed into the forgeable material to extend from the second end.

100. The valve lifter body of claim 95 wherein the second lifter cavity has been cold formed into the forgeable material to provide, at least in part, a lifter well.

101. The valve lifter body of claim 95 further comprising:

a) an outer lifter surface that is provided on the forgeable material; and b) the outer lifter surface has been machined, at least in part, to provide a first cylindrical surface and a second cylindrical surface, wherein the first cylindrical surface is provided with a first radius and the second cylindrical surface is provided with a second radius that is smaller than the first radius.

102. The valve lifter body of claim 95 further comprising:

a) an outer lifter surface that is provided on the forgeable material; and b) the forgeable material has been cold formed to provide, at least in part, a cylindrical surface with a reduced diameter located on the outer surface.

103. The valve lifter body of claim 95 wherein the second inner lifter surface has been machined to provide, at least in part, a lifter well that is generally cylindrical in shape with a diameter that is smaller than a diameter of the second inner lifter surface.

104. A valve lifter body that includes a valve lifter axis, comprising:

a) a forgeable material;

b) first lifter cavity provided with a first inner lifter surface that extends from a first lifter opening, which is located at a first end;

c) a second lifter cavity provided with a second inner lifter surface that extends from a second lifter opening, which is located at a second end;

d) the first inner lifter surface includes a first wall, a second wall, a third wall, a fourth wall, a first angled wall, a second angled wall, a third angled wall, fourth angled wall, a first angled lifter surface, a second angled lifter surface, a third angled lifter surface, and a fourth angled lifter surface;

e) the walls, the angled walls, and the angled lifter surfaces have been cold formed so that:

i) the walls extend axially into the forgeable material from the first lifter opening and are positioned so that the first wall faces the second wall and the third wall faces the fourth wall;

ii) the first angled lifter surface is located adjacent to the first wall and the fourth wall;

iii) the second angled lifter surface is located adjacent to the first wall and the third wall;

iv) the third angled lifter surface is located adjacent to the second wall and the third wall;

v) the fourth angled lifter surface is located adjacent to the second wall and the fourth wall;

vi) the first angled wall extends axially into the forgeable material from the first lifter opening and terminates, at least in part, at the first angled lifter surface;

vii) the second angled wall extends axially into the valve lifter body from the first lifter opening and terminates, at least in part, at the third angled lifter surface;

viii) the third angled wall extends axially into the valve lifter body from the first lifter opening and terminates, at least in part, at the fourth angled lifter surface;

ix) the fourth angled wall extends axially into the valve lifter body from the first lifter opening and terminates, at least in part, at the second angled lifter surface;

f) the second lifter cavity has been cold formed into the forgeable material so that the second lifter cavity extends axially into the forgeable material from the second lifter opening and includes a second inner lifter surface that is generally cylindrical in shape;

g) the valve lifter body has been heat treated; and h) the second inner lifter surface of the second lifter cavity has been machined to provide a plurality of generally cylindrical surfaces.

105. The valve lifter body of claim 104 wherein the walls, the angled walls, and the angled lifter surfaces have been cold formed so that at least one of the angled lifter surfaces is oriented to be at an angle relative to a plane that is orthogonal to the valve lifter axis, the angle measuring between twenty-five and about ninety degrees.

106. The valve lifter body of claim 104 wherein the walls, the angled walls, and the angled lifter surfaces have been cold formed so that the fourth angled lifter surface is oriented to extend from the third angled wall at an angle relative to a plane that is orthogonal to the valve lifter axis, the angle measuring between 45 degrees and 65 degrees.

107. The valve lifter body of claim 104 further comprising:

a) a combustion engine;

b) a lash adjuster body that has, at least in part, been fabricated through cold forming;

c) the lash adjuster body is located within the valve lister body so that the lash adjuster body telescopes within the valve lifter body; and d) the valve lifter body is located within the combustion engine where it functions, at least in part, to operate a valve.

108. The valve lifter body of claim 104 wherein the walls, the angled walls, and the angled lifter surfaces have been cold formed so that at least one of the angled lifter surfaces is oriented to extend from at least one of the angled walls at an angle relative to a plane that is orthogonal to the valve lifter axis, the angle measuring between 25 degrees and 75 degrees.

109. The valve lifter body of claim 104 wherein the walls, the angled walls, and the angled lifter surfaces have been cold formed so that at least one of the angled surfaces is oriented to be at an angle relative to a plane that is orthogonal to the valve lifter axis.

110. The valve lifter body of claim 104 further comprising a first curved lifter surface and a second curved lifter surface that have been cold formed so that:

a) the fourth wall extends axially into the forgeable material from the first lifter opening and terminates, at least in part, at the first curved lifter surface; and b) the third wall extends axially into the forgeable material from the first lifter opening and terminates, at least in part, at the second curved lifter surface.

111. The valve lifter body of claim 104 further comprising a first curved lifter surface and a second curved lifter surface that have been cold formed so that:

a) the fourth wall extends axially into the valve lifter body from the first lifter opening and terminates, at least in part, at the first curved lifter surface;

b) the third wall extends axially into the valve lifter body from the first lifter opening and terminates, at least in part, at the second curved lifter surface;

c) the first angled lifter surface is located adjacent to the first wall, the fourth wall, the first angled wall, and the first curved lifter surface;

d) the second angled lifter surface is located adjacent to the first wall, third wall, the fourth angled wall, and the second curved lifter surface;

e) the third angled lifter surface is located adjacent to the second wall, the third wall, the second angled wall, and the second curved lifter surface; and f) the fourth angled lifter surface is located adjacent to the second wall, the fourth wall, the third angled wall, and the first curved lifter surface.

112. The valve lifter body of claim 104 wherein the walls, the angled walls, and the angled lifter surfaces have been cold formed so that:

a) the first angled lifter surface is located adjacent to the first wall, the fourth wall, and the first angled wall;

b) the second angled lifter surface is located adjacent to the first wall, third wall, and the fourth angled wall;

c) the third angled lifter surface is located adjacent to the second wall, the third wall, and the second angled wall;

d) the fourth angled lifter surface is located adjacent to the second wall, the fourth wall, and the third angled wall;

e) at least one of the angled lifter surfaces extends from at least one of the angled walls towards the valve lifter axis; and f) at least one of the angled lifter surfaces is oriented to be at an angle relative to a plane that is orthogonal to the valve lifter axis, the angle measuring between twenty-five and about ninety degrees.

113. The valve lifter body of claim 104 further comprising:

a) a lash adjuster body that has, at least in part, been fabricated through cold forming;

b) a socket body that has, at least in part, been fabricated through cold forming; and c) a leakdown plunger that has, at least in part, been fabricated through cold forming.

114. The valve lifter body of claim 113 wherein:

a) at least a portion of the lash adjuster body has been machined so that the lash adjuster body telescopes within the valve lifter body; and b) at least a portion of the leakdown plunger has been machined.

115. A valve lifter body that includes a valve lifter axis, comprising:

a) a forgeable material;

b) a first lifter cavity that has been cold formed into the forgeable material so that:

i) the forgeable material is provided with a first lifter opening that is shaped to accept a roller;

ii) the first lifter cavity extends axially into the forgeable material from the first lifter opening and includes a first inner lifter surface that is provided with a first wall, a second wall, a third wall, a fourth wall, a first angled wall, a second angled wall, a third angled wall, fourth angled wall, a first curved lifter surface, a second curved lifter surface, and a lifter surface;

iii) the first wall and the second wall extend axially into the forgeable from the first lifter opening and are positioned so that the first wall faces the second wall;

iv) the third wall extends axially into the forgeable material from the first lifter opening and terminates, at least in part, at the second curved lifter surface;

v) the fourth wall extends axially into the forgeable material from the first lifter opening and terminates, at least in part, at the first curved lifter surface;

vi) the third wall and the fourth wall are positioned so that the third wall faces the fourth wall;

vii) the first angled wall extends axially into the forgeable material from the first lifter opening, faces the second angled wall, and is located between the fourth wall and the first wall;

viii) the second angled wall extends axially into the forgeable material from the first lifter opening, faces the first angled wall, and is located between the second wall and the third wall;

ix) the third angled wall extends axially into the forgeable material from the first lifter opening, faces the fourth angled wall, and is located between the second wall and the fourth forth wall;

x) the fourth angled wall extends axially into the forgeable material from the first lifter opening, faces the third angled wall, and is located between the first wall and the third wall;

xi) the first and second curved lifter surfaces are, at least in part, located adjacent to the lifter surface, which is relative to the curved lifter surfaces, generally flat and oriented to be generally orthogonal to the valve lifter axis;

c) a second lifter cavity that has been cold formed into the forgeable material so that:

i) the forgeable material is provided with a second lifter opening;

ii) the second lifter cavity extends axially into the forgeable material from the second lifter opening and includes a second inner lifter surface; and d) the second inner lifter surface has been machined to provide a plurality of cylindrical surfaces.

116. The valve lifter body of claim 115 further comprising a socket body that has, at least in part, been fabricated through cold forming.

117. The valve lifter body of claim 115 further comprising a leakdown plunger that has, at least in part, been fabricated through cold forming.

118. The valve lifter body of claim 115 further comprising:

a) a socket body that has, at least in part, been fabricated through cold forming; and; and b) a leakdown plunger that has, at least in part, been fabricated through cold forming.

119. The valve lifter body of claim 115 wherein the forgeable material has been cold formed to provide, at least in part, a first end wherein the first lifter opening is located, a second end wherein the second lifter opening is located, and an undercut surface that extends from the second end.

120. The valve lifter body of claim 115 wherein the second lifter cavity has been cold formed to provide, at least in part, a lifter well.

121. The valve lifter body of claim 115 wherein:

a) the forgeable material is provided with an outer lifter surface; and b) the outer lifter surface has been machined, at least in part, to provide a first cylindrical surface and a second cylindrical surface, wherein the first cylindrical surface is provided with a first radius and the second cylindrical surface is provided with a second radius that is smaller than the first radius.

122. The valve lifter body of claim 115 wherein:

a) the forgeable material is provided with an outer lifter surface; and b) the forgeable material has been cold formed to provide, at least in part, a cylindrical surface with a reduced diameter located on the outer surface.

123. The valve lifter body of claim 115 wherein the second inner lifter surface has been machined to provide, at least in part, a lifter well that is generally cylindrical in shape with a diameter that is smaller than a diameter of the second inner lifter surface.

124. The valve lifter body of claim 115 wherein first lifter cavity has been cold formed so that the lifter surface with a generally circular shape.

125. The valve lifter body of claim 115 wherein first lifter cavity has been cold formed so that the lifter surface with a generally rectangular shape.

126. The valve lifter body of claim 115 wherein the first lifter opening is a chamfered opening that has been fabricated, at least in part, through cold forming.

127. The valve lifter body of claim 115 further comprising:

a) a combustion engine;

b) a lash adjuster body that has, at least in part, been fabricated through cold forming;

c) the lash adjuster body is located within the valve lifter body so that the lash adjuster body telescopes within the valve lifter body; and d) the valve lifter body is located within the combustion engine where it functions, at least in part, to operate a valve.

128. The valve lifter body of claim 115 wherein the first lifter cavity has been cold formed to provide:

a) a first angled lifter surface that it is located adjacent to the first wall, the fourth wall, and the first angled wall;

b) a second angled lifter surface that it is located adjacent to the first wall, third wall, and the fourth angled wall;

c) a third angled lifter surface that it is located adjacent to the second wall, the third wall, and the second angled wall;

d) a fourth angled lifter surface that it is located adjacent to the second wall, the fourth wall, and the third angled wall;

e) at least one of the angled lifter surfaces is oriented so that it extends from at least one of the angled walls towards the valve lifter axis; and f) at least one of the angled lifter surfaces is oriented to be at an angle relative to a plane that is orthogonal to the valve lifter axis, the angle measuring between twenty-five and about ninety degrees.

129. The valve lifter body of claim 115 further comprising:

a) a lash adjuster body that has, at least in part, been fabricated through cold forming;

b) a socket body that has, at least in part, been fabricated through cold forming; and c) a leakdown plunger that has, at least in part, been fabricated through cold forming.

130. The valve lifter body of claim 129 wherein:

a) at least a portion of the lash adjuster body has been machined so that the lash adjuster body telescopes within the valve lifter body; and b) at least a portion of the leakdown plunger has been machined.

131. A valve lifter body that includes a valve lifter axis, comprising:

a) a forgeable material;

b) first lifter cavity provided with a first inner lifter surface that extends from a first lifter opening, which is located at a first end;

c) a second lifter cavity provided with a second inner lifter surface that extends from a second lifter opening, which is located at a second end;

d) the first inner lifter surface includes a first wall; a second wall, a third wall, a fourth wall, a first curved lifter surface, a second curved lifter surface, and a lifter surface;

e) he walls, the curved lifter surfaces, and the lifter surface have been cold formed so that:

i) the first wall faces the second wall;

ii) the second wall faces the first wall;

iii) the third wall extends axially into the forgeable material from the first lifter opening, faces the fourth wall, and terminates, at least in part, at the second curved surface;

iv) the fourth wall extends axially into the forgeable material from the first lifter opening, faces the third wall, and terminates, at least in part, at the first curved surface;

v) the first curved lifter surface extends from the fourth wall and terminates, at least in part, at the lifter surface;

vi) the second curved lifter surface extends from the third wall and terminates, at least in part, at the lifter surface;

vii) the lifter surface is, relative to the curved lifter surfaces, generally flat and oriented to be generally orthogonal to the valve lifter axis;

f) the second lifter cavity has been cold formed into the forgeable material so that the second lifter cavity extends axially into the forgeable material from the second lifter opening, and includes a second inner lifter surface that is generally cylindrical in shape; and g) the second inner lifter surface of the second lifter cavity has been machined to provide a plurality of generally cylindrical surfaces.

132. The valve lifter body of claim 131 further comprising a socket body that has been fabricated, at least in part, through cold forming.

133. The valve lifter body of claim 131 further comprising a leakdown plunger that has been fabricated, at least in part, through cold forming.

134. The valve lifter body of claim 131 further comprising:

a) a socket body that has been fabricated, at least in part, through cold forming; and b) a leakdown plunger that has been fabricated, at least in part, through cold forming.

135. The valve lifter body of claim 131 wherein the forgeable material has been cold formed to include an undercut surface that extends from the second end.

136. The valve lifter body of claim 131 wherein the second lifter cavity has been cold formed to provide, at least in part, a lifter well.

137. The valve lifter body of claim 131 wherein:

a) the forgeable material is provided with an outer lifter surface; and b) the outer lifter surface has been machined, at least in part, to provide a first cylindrical surface and a second cylindrical surface wherein the first cylindrical surface is provided with a first radius and the second cylindrical surface is provided with a second radius that is smaller than the first radius.

138. The valve lifter body of claim 131 wherein:

a) the forgeable material is provided with an outer lifter surface; and b) the forgerable material has been cold formed to provide, at least in part, a cylindrical surface with a reduced diameter located on the outer surface.

139. The valve lifter body of claim 131 wherein the second inner lifter surface has been machined to provide, at least in part, a lifter well that is generally cylindrical in shape with a diameter that is smaller than a diameter of the second inner lifter surface.

140. The valve lifter body of claim 131 wherein the walls, the curved lifter surfaces, and the lifter surface have been cold formed so that the lifter surface is provided with a generally circular shape.

141. The valve lifter body of claim 131 wherein the walls, the curved lifter surfaces, and the lifter surface have been cold formed so that the lifter surface is provided with a generally rectangular shape.

142. The valve lifter body of claim 131 wherein the first lifter opening is a chamfered opening that has been fabricated, at least in part, through cold forming.

* * * * *